United States Patent [19]

Ishikawa et al.

[11] Patent Number: 4,906,554

[45] Date of Patent: Mar. 6, 1990

[54] COLOR DEVELOPING SOLUTION OF LIGHT-SENSITIVE SILVER HALIDE COLOR PHOTOGRAPHIC MATERIAL AND PROCESSING METHOD OF LIGHT-SENSITIVE SILVER HALIDE COLOR PHOTOGRAPHIC MATERIAL USING THE SAME

[75] Inventors: Masao Ishikawa; Shigeharu Koboshi; Kazuhiro Kobayashi; Keiji Ohbayashi; Mitsuhiro Okumura; Shigeo Chino, all of Hino; Kaoru Onodera, Odawara, all of Japan

[73] Assignee: Konishiroku Photo Industry Co., Ltd., Tokyo, Japan

[21] Appl. No.: 143,854

[22] PCT Filed: Apr. 16, 1987

[86] PCT No.: PCT/JP87/00243

§ 371 Date: Dec. 11, 1987

§ 102(e) Date: Dec. 11, 1987

[87] PCT Pub. No.: WO87/06360

PCT Pub. Date: Oct. 22, 1987

[30] Foreign Application Priority Data

| | | | |
|---|---|---|---|
| Apr. 16, 1986 | [JP] | Japan | 61-87489 |
| Apr. 18, 1986 | [JP] | Japan | 61-91089 |
| Apr. 19, 1986 | [JP] | Japan | 61-91109 |
| Apr. 19, 1986 | [JP] | Japan | 61-91110 |
| Apr. 21, 1986 | [JP] | Japan | 61-92655 |

[51] Int. Cl.[4] ..... G03C 5/24

[52] U.S. Cl. ..... 430/467; 430/434; 430/435; 430/484; 430/486; 430/487; 430/490; 430/491

[58] Field of Search ..... 430/491, 490, 467, 567, 430/434, 435, 484, 486, 487

[56] References Cited

U.S. PATENT DOCUMENTS

| | | | |
|---|---|---|---|
| 4,155,763 | 3/1979 | Hasebe et al. | 430/380 |
| 4,252,892 | 2/1981 | Case | 430/491 |
| 4,264,716 | 4/1981 | Vincent et al. | 430/491 |
| 4,330,616 | 5/1982 | Kurematsu et al. | 430/376 |
| 4,482,626 | 11/1984 | Twist et al. | 430/380 |
| 4,546,068 | 10/1985 | Kuse | 430/375 |
| 4,587,195 | 5/1986 | Ishikawa et al. | 430/139 |
| 4,588,677 | 5/1986 | Ishikawa et al. | 430/491 |
| 4,672,025 | 7/1987 | Yamada et al. | 430/491 |

FOREIGN PATENT DOCUMENTS

| | | |
|---|---|---|
| 57-185434 | 11/1982 | Japan . |
| 59-184341 | 10/1984 | Japan . |

OTHER PUBLICATIONS

WO 87/04534, "Photographic Color . . . ", Vincent et al., 7/30/87.

International Search Report for International Application No. PCT/JP87/00243 (English translation), 3 pages.

*Primary Examiner*—Roland E. Martin

*Assistant Examiner*—Patrick A. Doody

*Attorney, Agent, or Firm*—Finnegan, Henderson, Farabow, Garrett, and Dunner

[57] ABSTRACT

This invention relates to a color developing solution for processing of a light-sensitive silver halide color photographic material which comprises containing a compound represented by the following formula [I] and at least one compound selected from a compound represented by the following formula [II] and a compound represented by the following formula [III], and a processing method of a light-sensitive silver halide color photographic material, which comprises, after imagewise exposure of a light-sensitive silver halide color photographic material, carrying out processing including at least a color developing step, wherein the light-sensitive silver halide color photographic material has silver halide emulsion layers containing silver halide grains substantially comprised of silver chloride, and a color developing solution used in the color developing step contains the compound represented by the following formula [I] and at least one compound selected from the compound represented by the following formula [II] and the compound represented by the following formula [III]:

Formula [I]

(wherein $R^1$ and $R^2$ each represent an alkyl group having 1 to 3 carbon atoms.)

Formula [II]

Formula [III]

(in the formulae [II] and [III], L represents an alkylene group, a cycloalkylene group, a phenylene group, —$L_8$—O—$L_8$—O—$L_8$— or —$L_9$—Z—$L_9$—, where Z represents $L_1$ to $L_{13}$ each represent an alkylene group, $R_3$ to $R_{13}$ each represent a hydrogen atom, a hydroxyl group, a carboxylic acid group (including its salt), or a phosphonic acid group (including its salt), provided that at least two of $R_3$ to $R_6$ are the carboxylic acid group (including its salt) or the phosphonic acid group (including its salt), and at least two of $R_5$ to $R_7$ are the carboxylic acid group (including its salt) or the phosphonic acid group (including its salt).

19 Claims, No Drawings

COLOR DEVELOPING SOLUTION OF LIGHT-SENSITIVE SILVER HALIDE COLOR PHOTOGRAPHIC MATERIAL AND PROCESSING METHOD OF LIGHT-SENSITIVE SILVER HALIDE COLOR PHOTOGRAPHIC MATERIAL USING THE SAME

TECHNICAL FIELD

This invention relates to a color developing solution for a light-sensitive silver halide photographic material and a processing method of a light-sensitive silver halide photographic material using the same, more particularly it relates to a color developing solution for a light-sensitive silver halide photographic material having a silver halide emulsion layer containing silver halide grains substantially comprised of silver chloride and excellent in the photographic performances for fog and maximum density and a processing method of a light-sensitive silver halide photographic material using the same.

This invention further relates to a processing solution and a processing method in which photographic performances are usually maintained stably even when quick processing is carried out. More specifically, it relates to a quick processing method which causes less decomposition of a processing solution by oxidation and generates less tar.

BACKGROUND ART

Generally, in the method of forming dye images by processing light-sensitive silver halide color photographic materials, the dye images are formed, after imagewise exposure, by reacting an oxidized p-phenylenediamine type color developing agent with a dye image-forming coupler. In such a method, a color reproduction method according to the subtractive color process is usually used to form dye images of cyan, magenta and yellow respectively corresponding to red, green and blue colors. Recent years, in the formation of such dye images, it is generally practiced to carry out a high temperature developing and simplify processing steps in order to achieve a shortened developing processing time. In particular, in order to achieve the shortened developing processing time, it becomes very important to increase the developing speed in color development. The developing speed in color development is governed from two approaches. One of them is a light-sensitive silver halide color photographic material, and the other of them is a color developing solution. In the former, the composition of the grains in a silver halide emulsion to be used may give great influence to the developing speed, and, in the latter, the conditions or composition of the color developing solution may give great influence to the developing speed.

Light-sensitive silver halide color photographic materials wherein a light-sensitive silver halide emulsion is substantially comprised of silver chloride (hereinafter referred to as light-sensitive silver chloride color photographic materials) can be rapidly developed as compared with conventional light-sensitive color photographic materials comprising a silver halide emulsion containing silver bromides or silver iodides such as silver chlorobromide, silver chloroiodobromide and silver iodobromide, and moreover can be free from accumulation in the color developing solution, of bromide ions or iodide ions which are susceptible to suppress development reactions. Thus, they are very useful as light-sensitive materials for a rapid processing. The present inventors have made various studies by using light-sensitive silver chloride color photographic materials suited for used in the rapid processing, and, as a result, find that the materials have the following disadvantages.

That is, as a first instance, hydroxylamine conventionally used as one of preservatives tends to act as a developing agent for the silver chloride so that the silver development may proceed, to lower color density of color images finally obtained.

As a second instance, sulfite conventionally used as other preservatives tends to act as a dissolving agent for the silver chloride so that the physical development due to a color developing agent may rapidly proceed, to lose the balance between the silver development reaction and the coupling reaction, in other words, the silver development may overly precede and the coupling reaction may delay, whereby the color density is lowered.

To solve the above first and second problems, the present inventors have made various studies. As a result, they have found that the above can be solved by using a particular compound as a preservative in place of the hydroxylamine and suppressing the sulfite to a concentration not more than a specific level whereby decrease in color density caused by the above problems, respectively, can be prevented well.

That is, the present inventors have combined the above two techniques, whereby it is made possible for the first time to obtain, at the first time, a light-sensitive silver halide color photographic material substantially comprised of silver chloride, being free from the decrease in color density and having good preservativity even with lower concentration of the sulfite in a color developing solution. As a result of further studies, it was also found that fog is liable to appear, especially when the solution is contaminated with a heavy metal ion.

This heavy ion may raise a problem especially when a large quantity of light-sensitive materials is continuously processed.

In a developing processing method of continuously processing light-sensitive silver halide color photographic materials by use of an automatic processor and the like, it is also necessary to take a measure for keeping components in a concentration in order to prevent the change in the development finishing performance due to the change in the concentration of the components. As such a measure, there has been usually used a method in which a replenishing solution is supplied to replenish short components and dilute unnecessary increased components. Supplying such a replenishing solution may bring about an overflow in a large quantity, which must be abandoned, throwing a great problem from an economical viewpoint and an environmental viewpoint. For this reason, in recent years, the so-called concentrated low replenishing system wherein the replenishing solution is made to have a higher concentration and supplies in a small quantity has been extensively used in order to decrease the above overflow solution. In such a system, however, heavy metal ions are liable to be accumulated, thereby raising the above problem of fog due to heavy metals. It has thus been sought after to solve these problems.

On the other hand, what is recently sought after in the present industrial fields is a technique that can practice rapid processing of a light-sensitive silver halide color photographic material, and yet can achieve good processing stability and stable photographic performances. Particularly sought after is a method of processing a light-sensitive silver halide color photographic material feasible for rapid processing.

More specifically, it is practiced to continuously process light-sensitive silver halide color photographic materials in an automatic processing machine installed in every photofinishing laboratory. However, as a part of improvements in services to users, it is demanded to finish processing and returns products to users in the day the development orders were received, and nowadays, it is further demanded even to return products in several hours after receipt of orders. Thus, a further progress is hastened for a technique that can carry out the processing more rapidly.

Further, in recent years, there is even a demand that an automatic processing machine is installed in the front of a camera shop or a supermarket, where light-sensitive materials received from users are processed on the spot and returned to them.

Also, a copying apparatus by which an original copy is irradiated with a light and copied on a light-sensitive material has also become commercially available, and it is also demanded in such an apparatus to develop in a short time the light-sensitive material on which the original copy has been copied. The state of affairs in such an apparatus is such that users are desirous of obtaining at once the copied light-sensitive materials.

For example, methods to enable rapid processing have been hitherto studied, and known methods include a method in which the processing is carried out by making high the temperature of a color developing solution, a method in which the pH of a color developing solution is kept in the high pH range, and a method in which development accelerator is used or a color developing agent is incorporated in a light-sensitive silver halide color photographic material. However, any of these methods mentioned above are involved in serious problems, and have not been put into practical use at present.

For example, in the instance the processing is carried out by making high the temperature of a color developing solution, the rapid processing is made possible to a certain degree, but there can be involved in the problems such that the oxidation decomposition of the developing solution itself may be greatly accelerated to cause a great compositional change of the developing solution, or the evaporation may take place so vigorously that the developing solution may suffer condensation seriously to make unstable the photographic performances. It can not necessarily be said that the oxidation decomposition of the developing solution have never occured at all in a conventional apparatus not designed for the rapid processing. However, they have occured only at a very low rate, not particularly resulting in any great damage on the photographic performances. These difficulties have been made extremely greater as a result of the high temperature processing, to cause serious problems in the photographic performances, for example, bring about hard gradation at the toe to make it impossible to achieve appropriate color reproduction. The method in which the pH range may have disadvantages that the photographic performances tend to vary and the stain tends to be generated since no agent is available that has buffering ability suited for maintaining the high pH.

In the instance a development accelerator is used, the development accelerator may include the compounds as disclosed in U.S. Pat. No. 2,950,970, No. 2,515,147, No. 2,496,903, No. 4,038,075 and No. 4,119,462; G.B. Pat. No. 1,430,998 and No. 1,455,413; Japanese Provisional Patent Publications No. 15831/1978, No. 62450/1980, No. 62451/1980, No. 62452/1980, No. 62453/1980, No. 12422/1981 and No. 62453/1980; Japanese Patent Publications No. 12422/1976 and No. 49728/1980; and the like. Among these, most frequently used in the so-called paper sensitive material in the light-sensitive silver halide color photographic material is benzyl alcohol that can exhibit good effect in accelerating the reaction of a color developing agent with an image-forming coupler.

However, the benzyl alcohol has problems that there is a limit in the amount for its use because of its poor solubility, and tar tends to be formed during its use over a long period of time.

As another technique for rapid processing, also known is a method in which a color developing agent is increased in a color developing solution to make greater the activity. This method, however, can not be put into practical use because the color developing agent is so expensive that the processing solution may be of comparatively high cost and at the same time there may be of comparatively high cost and at the same time there may be caused unstableness such that the developing agent is hardly soluble in water and readily deposits.

On the other hand, in order to achieve rapid processing of a color development by improving a light-sensitive material, there has been known a method in which the above-mentioned color developing agent is beforehand incorporated into a light-sensitive material. For example, there has been known a method in which a color developing agent is incorporated in the form of a metal salt (U.S. Pat. No. 3,719,492). This method, however, has had a disadvantage that the light-sensitive material shows poor storage properties when it is stored in a raw state, and therefore tends to be fogged before it is used or to be fogged at the time of color development.

In order to inactivate the amine moiety of the color developing agent, there has been also known a method in which the color developing agent is incorporated in the form of a Schiff base (U.S. Pat. No. 3,342,559; Research Disclosure No. 15159, 1976). This method, however, has had a disadvantage that color development can be initiated only after the color developing solution was hydrolyzed using an alkali, rather resulting in slow color development.

Further, in the instance the color developing agent is directly incorporated, there has also been a disadvantage that, in addition to the disadvantage that an emulsion may be fogged during storage because of unstableness of the color developing agent, various troubles on the processing may be caused because of weakened properties of an emulsion coating.

Thus, although it is possible to increase the development speed to a certain level when it is attempted to achieve the rapid processing with use of the above methods, there has greatly occurred compositional variation of a processing solution or deterioration of a processing solution, resulting in greatly harmful influence given to the photographic performances. Moreover, in the above methods, the color development speed can not be actually increased so much.

As a result of intensive studies, to enable sufficiently rapid processing, the present inventors have improved a light-sensitive material to find out that a silver chlorobromide emulsion or silver chloride emulsion containing silver chloride in a large amount may be used as the silver halide emulsion contained in said light-sensitivve material, and actually tried the rapid processing.

According to the present method, there is no change in the processing solution, and there may not be any great compositional variation or any extreme oxidation or evaporation of the processing solution. Moreover, there may not be caused the problem such as the storage properties in a raw state or the lowered color development efficiency as in the instance the color developing agent has been incorporated into a light-sensitive material, and thus it was made possible to carry out the rapid processing.

However, in the course of the studies the present inventors had proceeded, it was found that the emulsion containing rich silver chloride, though having good developing properties and being very suited for the rapid processing, has the problems as follows:

That is, although the sensitivity at the toe can be exhibited because of the good developing properties, the maximum color density tends to change to cause a great lowering of the density, and another problem is that the maximum color density tends to remarkably change particularly when the processing is carried out continuously.

DISCLOSURE OF THE INVENTION

Accordingly, an object of the present invention is to provide a solution for and a method of processing a light-sensitive silver halide color photographic material by using a color developing solution having good storage stability, that can achieve excellent photographic performances for fog and maximum density and makes it possible to carry out rapid processing.

Also, other object of the present invention is to provide a processing solution and a processing method which enable rapid processing and usually give stable photographic performances even when continuous processing is carried out, and more specifically to provide a rapid processing method which causes less decomposition of a processing solution by oxidation and generates less tar.

CONSTITUTION OF THE INVENTION

The above object of the present invention can be achieved by a color developing solution for processing of a light-sensitive silver halide color photographic material which comprises containing a compound represented by the following formula [I] and at least one compound selected from a compound represented by the following formula [II] and a compound represented by the following formula [III], and a method of processing a light-sensitive silver halide color photographic material, which comprises, after imagewise exposure of a light-sensitive silver halide color photographic material, carrying out processing including at least a color developing step, wherein said light-sensitive silver halide color photographic material has silver halide emulsion layers containing silver halide grains substantially comprised of silver chloride, and a color developing solution used in said color developing step contains the compound represented by the following formula [I] and at least one compound selected from the compound represented by the following formula [II] and the compound represented by the following formula [III]:

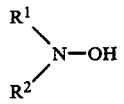

Formula [I]

(wherein $R^1$ and $R^2$ each represent an alkyl group having 1 to 3 carbon atoms.)

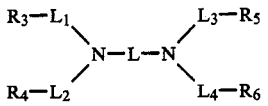

Formula [II]

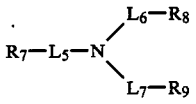

Formula [III]

(in the formulae [II] and [III], L represents an alkylene group, a cycloalkylene group, a phenylene group, $-L_8-O-L_8-O-L_8-$ or $-L_9-Z-L_9-$, where Z represents

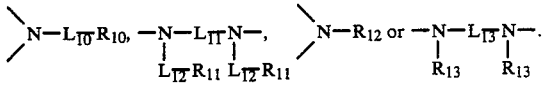

$L_1$ to $L_{13}$ each represent an alkylene group, $R_3$ to $R_{13}$ each represent a hydrogen atom, a hydroxyl group, a carboxylic acid group (including its salt), or a phosphonic acid group (including its salt), provided that at least two of $R_3$ to $R_6$ are the carboxylic acid group (including its salt) or the phosphonic acid group (including its salt), and at least two of $R_5$ to $R_7$ are the carboxylic acid group (including its salt) or the phosphonic acid group (including its salt)).

The above objects of the present invention are more effectively accomplished by employing silver halide grains containing at least 70 mole % of silver chloride, and yet the objects of the present invention are further effectively accomplished by being contained substantially no hydroxylamine salt and further being contained substantially no benzyl alcohol in the color developing solution. CL BEST MODE FOR CARRYING OUT THE INVENTION In the color developing processing in case of using a light-sensitive material having an emulsion containing high concentration of silver chloride as in the present invention, it was found that the color density will be lowered. Also, the gradation may greatly change depending on the time lapsed or the quantity processed when the above light-sensitive material is continuously processed with use of the above color developing solution. This was found, as a result of analytical researches made by the present inventors, to be chiefly caused by the presence of hydroxylamine sulfate conventionally used in color developing solutions without exception.

That is, it became clear that the presence of the above hydroxylamine sulfate in a color developing solution may cause development restraint to a great extent with increase in the proportion of silver chloride in a light-sensitive material. It was further found that, in the continuous processing where a processing solution stands with time lapse, the ammonium ions to be formed by the decomposition of hydroxylamine may more readily cause physical development with more increase in the proportion of silver chloride than the conventional, to change the photographic performances.

It was further found that the sulfite ion concentration in the developing solution tends to change with time, but, in a light-sensitive material using the emulsion containing rich silver chloride, the photographic performances may sensitively change depending on the concentration of sulfite.

As a result of intensive studies based on these results of analytical researches, the present inventors have discovered that the disadvantages mentioned above can be perfectly eliminated, sufficiently high photographic density can be always stably obtained and also the storage properties of a processing solution can be improved, when the silver chloride in the silver halide grains contained in a light-sensitive material is controlled to be in concentration higher than a particular value, when a particular compound substituting the conventional hydroxylamine is used in a color developing solution used for processing said light-sensitive material, and further when the sulfite ion concentration in said color developing solution is controlled to be in the range of particular concentration. This invention has thus been accomplished.

In the color developing solution used in the present invention, the compound represented by the formula [I] (hereinafter referred to as the preservative of the present invention) is used in place of hydroxylamine conventionally used as a preservative.

Accordingly, in the present invention, it is also important that it contains no hydroxylamine sulfate.

In the formula [I], $R^1$ and $R^2$ each represent an alkyl group having 1 to 3 carbon atoms, and the alkyl group having 1 to 3 carbon atoms represented by $R^1$ and $R^2$ may be the same or different, including, for example a methyl group, an ethyl group, an n-propyl group, an iso-propyl group, etc.

$R^1$ and $R^2$ are preferably both an ethyl group.

Specific examples of the compound represented by the formula [I] are shown below, but the present invention is by no means limited to these.

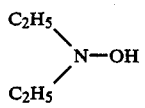
(I-1)

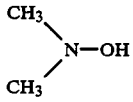
(I-2)

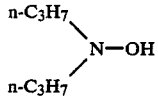
(I-3)

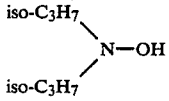
(I-4)

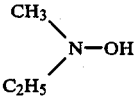
(I-5)

-continued

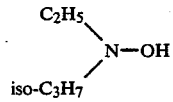
(I-6)

Particularly preferred compound may be mentioned dimethylhydroxylamine and diethylhydroxylamine, and of these, diethylhydroxylamine is particularly preferably used in view of preservativity.

These compounds of the present invention are usually used in the form of salts such as hydrochlorides, sulfate, p-toluenesulfonate, oxalate, phosphate and acetate.

Concentration of the compound of the present invention in the color developing solution may be approximately the same as the concentration of the hydroxylamine usually used as a preservative, and it may be used preferably in concentration of 0.1 g/l to 50 g/l, more preferably 0.5 g/l to 20 g/l, particularly preferably 1 g/l to 15 g/l.

Particularly, the compound represented by the formula [I] of the present invention can retain stability of the solution with lapse of time with sufficiently high extend even when the concentration of sulfite is made low, whereby it can be found that change in color concentration of the light-sensitive material with lapse of time can be made little, and as a result, photographic performances can be remarkably stabilized.

Of the compound represented by the formula [I] in the present invention, N,N-diethlydroxylamine, for example, is known to be used as a preservative of a black and white developing agent in a color developing solution to which a balck and white developing agent is added.

It is known that usually the black and white developing agent, i.e., hydroquinone, hydroquinonemonosulfonic acid, phenidone, p-aminophenol, etc. is relatively stable when used as the black and white developing agent in the black and white developing solution, and can be sufficiently preserved by using sulfite as a preservative, but one it is added to a color developing solution, there takes place a cross oxidation reaction with a color developing agent, resulting in its very poor storage stability. Hydroxylamine is hardly effective for the preservation of the black and white developing agent added to such a color developing solution.

As an example in which N,N-diethylhydroxylamine is used as a preservative of the black and white developing agent added to a color developing solution, it is known to use it together with phenidone in the so-called external color process, which is a process by which a light-sensitive color photographic material is developed according to a reversal process by using a color developing solution containing a coupler. In such an instance, a role of the phenidone is to increase the developing speed of the light-sensitive material of external system having poor developing performance and to increase the density of a dye image.

In, for example, a magenta color developing solution not containing such phenidone, N,N-diethylhydroxylamine is also known to adversely affect the preservativity of the color developing solution of external system as it destroys the coupler (see Japanese Patent Publication No. 22198/1970).

Also, other example in which the compound of this invention such as N,N-diethylhydroxylamine or the like is used as a preservative of the black and white developing agent in a color developing solution, reference can be made to a technique by which a phenidone derivative added to a color developing agent is preserved (see Japanese Provisional Patent Publication No. 32035/1978) or a technique by which a phenidone derivative is similarly preserved together with hydroquinones (see Japanese Provisional Patent Publication No. 153437/1977).

As mentioned above, the compound of the present invention has been conventionally known to be used as a preservative of the black and white developing agent added to a color developing solution, but has not been known as a preservative of a color developing agent in an ordinary color developing solution.

In the present invention, sulfite in containing in the range of $5.0\times10^{-4}$ mole or higher and $2.0\times10^{-2}$ mole or less per 1 liter of a color developing solution. Said sulfite has usually been used as a preservative of a color developing agent, but an excessive large amount thereof contained in the color developing agent may cause an extreme lowering of the color density of a light-sensitive material as mentioned above. If the sulfite can be contained with in the range of $2.0\times10^{-2}$ mole or less per 1 liter of the color developing solution, there can be no problem mentioned above, in other words, there can be no lowering of the color density of a light-sensitive material. However, the sulfite is contained as a preservative of the above color developing agent, and has been considered not to be able to preserve the color developing agent with such lower content. Nonetheless, to be surprising, it became clear that the storage properties of the solution can be maintained by using the dialkyl type hydroxylamine represented by the formula [I] of the present invention, even if the sulfite ion concentration is low to a certain degree, and, in particular, the photographic performances can be sufficiently kept stable even at $2.0\times10^{-2}$ mole or less.

In the processing method of the present invention, the sulfite is contained, in the range of $5.0\times10^{-4}$ mole or higher to $2.0\times10^{-2}$ mole or less per 1 liter of the color developing solution, but preferably, it is useful when it is contained in the range of $1.0\times10^{-3}$ mole or higher to $1.5\times10^{-2}$ mole or less per 1 liter of said color developing solution to obtain the effect of the present invention.

The sulfite used in the present invention may include alkali metal salts such as sodium sulfite and potassium sulfite, alkali metal bisulfites such as sodium bisulfite and potassium bisulfite, and ammonium salts of these compounds, etc.

Further, said sulfite may be added in the form of a compound which forms a stable sulfite ion adduct with a sulfite ion, for example, a compound having an aldehyde group, a compound containing a cyclic hemiacetal, a compound having -dicarbonyl group or a compound having a nitrile group.

Thus, a part of the compound of the present invention has been already known as a preservative of the black and white developing agent added to a color developing solution. However, in the present invention, not only the sulfite can effectively act as a preservative of an ordinary color developing solution when it is in concentration of $5\times10^{-4}$ mole/l to $2\times10^{-2}$ mole/l, but also the color density may not be lowered by using the compound in combination with a chelating agent represented by the formula [II] and/or [III], generation of fog due to the contamination with heavy metals can be desirably prevented, and further, there can be obtained a developing solution having excellent stability without lowering of pH and formation of tar. These are surprising effects that can not be expected at all.

In the color developing solution to be used in the present invention, the compound represented by the formula [II] and/or [III] (hereinafter referred to as the chelating agent of the present invention) is contained.

The alkylene group, cycloalkylene group and phenylene group represented by L in the formulae [II] and [III], and the alkylene group represented by $L_1$ to $L_{13}$ include those having substituents.

Next, preferable specific exemplary compounds represented by these formulae [II] and [III] are shown below.

| [Exemplary compounds] | |
|---|---|
| [II-1] | Ethylenediaminetetraacetic acid |
| [II-2] | Diethylenetriaminepentaacetic acid |
| [II-3] | Ethylenediamine-N—(β-oxyethyl)-N,N',N'—triacetic acid |
| [II-4] | Propylenediaminetetraacetic acid |
| [II-5] | Nitrilotriacetic acid |
| [II-6] | Cyclohexanediaminetetraacetic acid |
| [II-7] | Iminodiacetic acid |
| [II-8] | Dihydroxyethylglycinecitric acid (or tartaric acid) |
| [II-9] | Ethyl ether diaminetetraacetic acid |
| [II-10] | Glycol ether diaminetetraacetic acid |
| [II-11] | Ethylenediaminetetrapropionic acid |
| [II-12] | Phenylenediaminetetraacetic acid |
| [II-13] | Ethylenediaminetetraacetic acid disodium salt |
| [II-14] | Ethylenediaminetetraacetic acid tetra(trimethyl ammonium) salt |
| [II-15] | Ethylenediaminetetraacetic acid tetrasodium salt |
| [II-16] | Diethylenetriaminepentaacetic acid pentasodium salt |
| [II-17] | Ethylenediamine-N—(β-oxyethyl)-N,N',N'—triacetic acid sodium salt |
| [II-18] | Propylenediaminetetraacetic acid sodium salt |
| [II-19] | Nitrilotriacetic acid sodium salt |
| [II-20] | Cyclohexanediaminetetraacetic acid sodium salt |
| [II-21] | Diethylenetriaminepentamethylenephosphonic acid |
| [II-22] | Cyclohexanediaminetetramethylenephosphonic acid |
| [III-1] | Nitrilotriacetic acid |
| [III-2] | Iminodiacetic acid |
| [III-3] | Nitrilotripropionic acid |
| [III-4] | Nitrilotrimethylenephosphonic acid |
| [III-5] | Iminodimethylenephosphonic acid |
| [III-6] | Nitrilotriacetic acid trisodium salt |

Of the chelating agents represented by the above formula [II] or [III], the compounds particularly preferably used from the point of the effect of the object of the present invention may include [II-1], [II-2], [II-5], [II-8], [II-19], [III-1] and [III-4].

The amount of the chelating agent represented by the formula [II] or [III] may be preferably in the range of 0.1 to 20 g per liter of the color developing solution, particularly preferably in the range of 0.3 to 5 g, from the point of the object of the present invention.

In the color developing solution to be used in the present invention, it is preferred to use the compounds represented by the formulae [IV] to [VII] shown below as a chelating agent. These chelating agents may be used any of one kind or may be contained in combination.

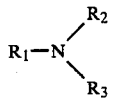

Formula [IV]

(wherein $R_1$ is a hydroxyalkyl group having 2 to 6 carbon atoms, $R_2$ and $R_3$ each represent a hydrogen atom, an alkyl group having 1 to 6 carbon atoms, a hydroxyalkyl group having 2 to 6 carbon atoms, a benzyl group or a group of the formula:

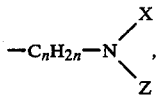

and n in the above formula represents an integer of 1 to 6, X and Z each represents a hydrogen atom, an alkyl group having 1 to 6 carbon atoms or a hydroxyalkyl group having 2 to 6 carbon atoms.)

In the formula [IV], $R_1$ is a hydroxyalkyl group having 2 to 6 carbon atoms, $R_2$ and $R_3$ each represent a hydrogen atom, an alkyl group having 1 to 6 carbon atoms, a hydroxyalkyl group having 2 to 6 carbon atoms, a benzyl group or a group of the formula:

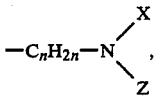

and n in the above formula represents an integer of 1 to 6, X and Z each represents a hydrogen atom, an alkyl group having 1 to 6 carbon atoms or a hydroxyalkyl group having 2 to 6 carbon atoms.

Of the compounds represented by the above formula [IV], particularly the compounds represented by the formula [IVa] show below may preferably used.

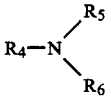

Formula [IVa]

(wherein $R_4$ is a hydroxyalkyl group having 2 to 4 carbon atoms, $R_5$ and $R_6$ each represent an alkyl group having 1 to 4 carbon atoms, a hydroxyalkyl group having 2 to 4 carbon atoms.)

Preferable specific examples represented by the above formula [IV] are as follows.

Ethanolamine, diethanolamine, triethanolamine, diisopropanolamine, 2-methylaminoethanol, 2-ethylaminoethanol, 2-dimethylaminoethanol, 2-diethylaminoethanol, 1-diethylamino-2-propanol, 3-diethylamino-1-propanol, 3-dimethylamino-1-propanol, isopropylaminoethanol, 3-amino-1-propanol, 2-amino-2-methyl-1,3-propanediol, ethylenediaminetetraisopropanol, benzyldiethanolamine, 2-amino-2-(hydroxymethyl-1,3-propanediol.

These compounds represented by the above formula [IV] may be preferably used in amounts within the range of 3 g to 100 g per one liter of the color developing solution from the point of the effect of the object of the present invention, more preferably in the range of 6 g to 50 g.

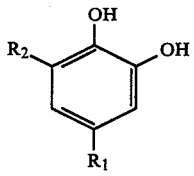

Formula [V]

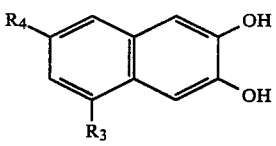

Formula [VI]

In the formula [V] and [VI], $R_1$, $R_2$, $R_3$ and $R_4$ each represent a hydrogen atom, a halogen atom, a sulfonic acid group, an alkyl group having 1 to 7 carbon atoms, $—OR_5$, $—COOR_6$,

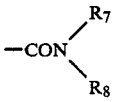

or a phenyl group. $R_5$, $R_6$, $R_7$ and $R_8$ each represent a hydrogen atom or an alkyl group havin 1 to 18 carbon atoms. Provided that when $R_2$ represent —OH or a hydrogen atom, $R_1$ represents a halogen atom, a sulfonic acid group, an alkyl group having 1 to 7 carbon atoms, $—OR_5$, $—COOR_6$,

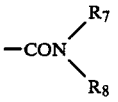

or a phenyl group.

As the alkyl group represented by the above $R_1$, $R_2$, $R_3$ and $R_4$, for example, there may be included a methyl group, an ethyl group, an iso-propyl group, an n-propyl group, a t-butyl group, an n-butyl group, a hydroxymethyl group, a hydroxyethyl group, a methylcarboxylic acid group, a benzyl group, etc. and the alkyl group represented by $R_5$, $R_6$, $R_7$ and $R_8$ has the same meaning as defined above, and further an octyl group, etc. can be included.

Also, as the phenyl group represented by $R_1$, $R_2$, $R_3$ and $R_4$, a phenyl group, a 2-hydroxyphenyl group, a 4-aminophenyl group, etc. can be included.

Typical specific examples of the compounds represented by the above formulae [V] and [VI] are shown below, but the present invention is not limited thereto.

(V-1) 4-Isopropyl-1,2-dihydroxybenzene
(V-2) 1,2-Dihydroxybenzene-3.5-disulfonic acid
(V-3) 1,2,3-Trihydroxybenzene-5-carboxylic acid
(V-4) 1,2,3-Trihydroxybenzene-5-carboxymethyl ester
(V-5) 1,2,3-Trihydroxybenzene-5-carboxy-n-butyl ester
(V-6) 5-t-Butyl-1,2,3-trihydroxybenzene
(V-7) 1,2-Dihydroxybenzene-3,4,5-trisulfonic acid
(V-8) 1,2-Dihydroxybenzene-6-chloro-3,5-disulfonic acid
(V-9) 1,2-Dihydroxybenzene-3,4,5,6-tetrasulfonic acid
(VI-1) 2,3-Dihydroxynaphthalene-6-sulfonic acid
(VI-2) 2,3,8-Trihydroxynaphthalene-6-sulfonic acid
(VI-3) 2,3-Dihydroxynaphthalene-6-carboxylic acid
(VI-4) 2,3-Dihydroxy-8-isopropyl-naphthalene (VI-5) 2,3-Dihydroxy-8-chloro-naphthalene-6-sulfonic acid Of the above compounds, the compound particularly preferably employed in the present invention may be 1,2-dihydroxybenzene-3,5-disulfonic acid, which can be also used as an alkali metal salt such as sodium salt, potassium salt, etc.

In the present invention, the above compounds can be used in the range of 5 mg to 20 g per liter of the developing solution, and good results can be obtained by addition of preferably 10 mg to 10 g, more preferably 20 mg to 3 g.

The above compounds of the present invention may be used alone or in combination. Furthermore, they may be used combinedly with other chelating agents including aminopolyphosphonic acids such as aminotri(methylenephosphonic acid) and ethylenediaminetetraphosphoric acid, oxycarboxylic acids such as citric acid and gluconic acid, phosphonocarboxylic acids such as 2-phosphonobutan-1,2,4-tricarboxylic acid, polyphosphoric acids such as tripolyphosphoric acid and hexametaphosphoric acid, and others.

Formula [VII]

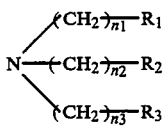

In the above formula [VII], $R_1$, $R_2$ and $R_3$ each represent a hydrogen atom, a hydroxy group, a carboxylic acid group (including its salt) or a phosphoric acid group (including its salt), and as the salt of the carboxylic acid group and the phosphoric acid group, there may be mentioned, for example, salts of an alkali metal atom and salts of an alkaline earth metal atom, preferably a salt of the alkali metal atom such as sodium, potassium, etc. Also, at least one of $R_1$, $R_2$ and $R_3$ is a hydroxyl group, and only either one of $R_1$, $R_2$ and $R_3$ is a carboxylic acid group (including its salt) or a phosphoric acid group (including its salt). Preferred is the case where $R_1$, $R_2$ and $R_3$ are each selected from a hydroxy group, a carboxylic acid group (including its salt) or a phosphoric acid group (including its salt). $n_1$, $n_2$ and $n_3$ each represent an integer of 1 to 3.

In the following, specific examples of the chelating agent of the present invention are shown, but the present invention is not limited to these.

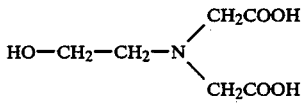

VII - 1

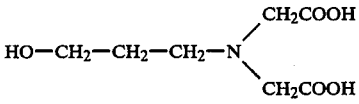

VII - 2

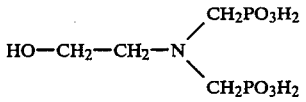

VII - 3

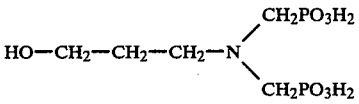

VII - 4

-continued

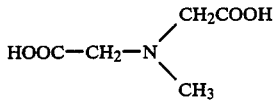

VII-5

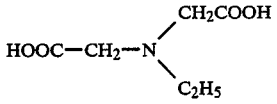

VII - 6

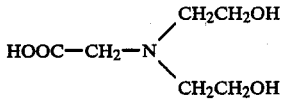

VII - 7

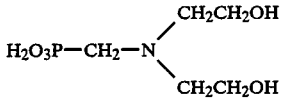

VII - 8

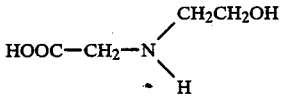

VII - 9

The amounts of the above compounds represented by the formulae [V], [VI] and [VII] may be in the range of 0.1 to 100 g, preferably in the range of 1 to 50 g per 1 liter of the color developing solution.

As the color developing agent to be used in the color developing solution used in the present invention, preferred is a p-phenylenediamine type compound having a water-soluble group.

The p-phenylenediamine type compound having a water-soluble group have advantages not only that they may produce no stain on light-sensitive materials and hardly cause a rash on skin even if the skin was smeared with them, as compared with p-phenylenediamine type compounds having no water-soluble group such as N,N-diethyl-p-phenylenediamine or the like, but also that they can afford to effectively achieve the objects of the present invention by using them, particularly in combination with the compound represented by the formula [I] in the present invention.

The above water-soluble group may be such that at least one water-soluble group is possessed on an amino group or benzene ring of the p-phenylenediamine type compounds. Specific water-soluble group may preferably include $-(CH_2)_n-CH_2OH$, $-(CH_2)_m-NHSO_2-(CH_2)_n-CH_3$, $-(CH_2)_mO-(CH_2)_n-CH_3$, $-(CH_2CH_2O)_nC_mH_{2m+1}$ (wherein m and n each represent an integer of 0 or more), a —COOH group and a $-SO_3H$ group.

Specific exemplary compounds of the color developing agent preferably used in the present invention are shown below.

Exemplary color developing agents

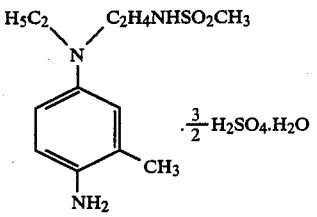
(A-1)
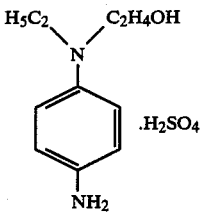
(A-2)
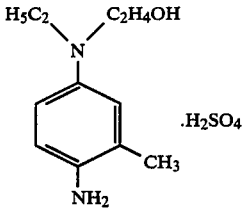
(A-3)
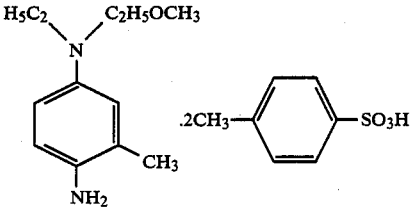
(A-4)
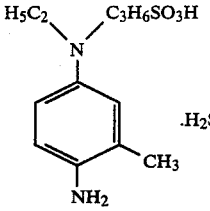
(A-5)
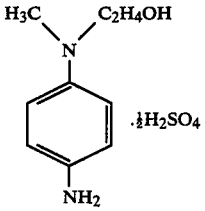
(A-6)
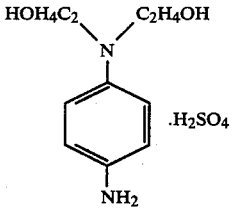
(A-7)
-continued
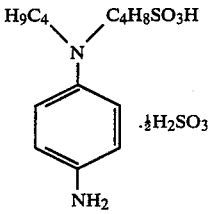
(A-8)
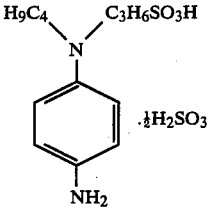
(A-9)
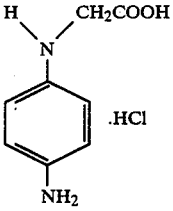
(A-10)
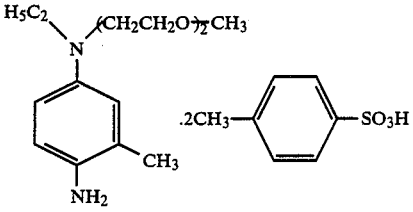
(A-11)
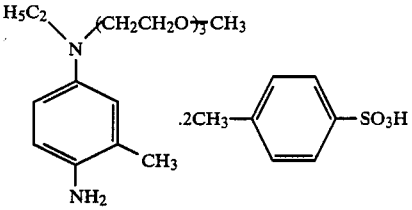
(A-12)
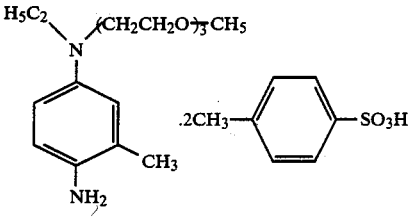
(A-13)
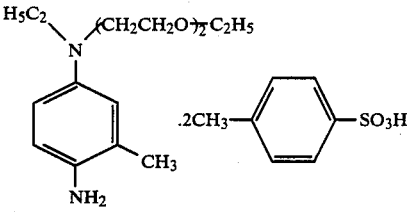
(A-14)

-continued (A-15)

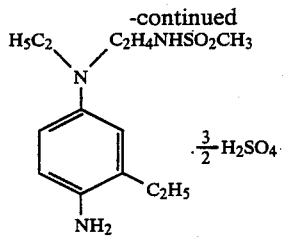

(A-16)

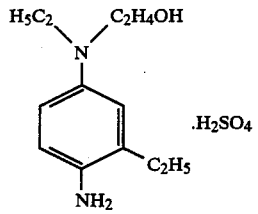

Among the color developing agents exemplified in the above, those which can be preferably used in the present invention as being free from generation of fog are compounds shown as exemplary Nos. (A-1), (A-2); (A-3), (A-4), (A-6), (A-7) and (A-15), and particularly preferred compound is No. (A-1).

The above color developing agents are generally used in the form of salts such as hydrochlorides, sulfate, p-toluenesulfonate, etc.

The color developing agent having a water-soluble group used in the present invention may be used preferably in the range of $1\times10^{-2}$ to $2\times10^{-1}$ mole per 1 liter of the color developing solution, more preferably from a viewpoint of the rapid processing, in the range of $1.5\times10^{-2}$ to $2\times10^{-1}$ mole per 1 liter of the color developing solution.

In the present invention, when employing the triazylstylbene type fluorescent brightening agent represented by the formula [VIII] in the color developing solution according to the present invention, the objective effect of the present invention is more effectively given.

Formula [VIII]

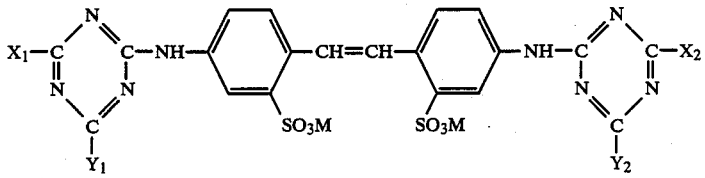

In the formula, $X_1$, $X_2$, $Y_1$ and $Y_2$ each represent a hydroxy group, a halogen atom such as chlorine or bromine, a morpholino group, an alkoxy group (e.g., methoxy, ethoxy, methoxyethoxy, etc.), an aryloxy group (e.g., phenoxy, p-sulfophenoxy, etc.), an alkyl group (e.g., methyl, ethyl), an aryl group (e.g., phenyl, methoxyphenyl, etc.), an amino group, an alkylamino group (e.g., methylamino, ethylamino, propylamino, dimethylamino, cyclohexylamino, β-hydroxyethylamino, di(β-hydroxyethyl)amino, β-sulfoethylamino, N-(β-sulfoethyl)-N'-methylamino, N-(β-hydroxyethyl)-N'-methylamino, etc.), an arylamino group (e.g., anilino, o-, m-, p-sulfoanilino, o-, m-, p-chloroanilino, o-, m-, p-toluidino, o-, m-, p-carboxyanilino, o-, m-, p-hydroxyanilino, sulfonaphthylamino, o-, m-, p-aminoanilino, o-, m-, p-anizino, etc.). M represents a hydrogen atom, sodium, potassium, ammonium or lithium.

More specifically, the following compounds may be enumerated, but by no means limited to these.

[Exemplary compounds]

(A'-1)

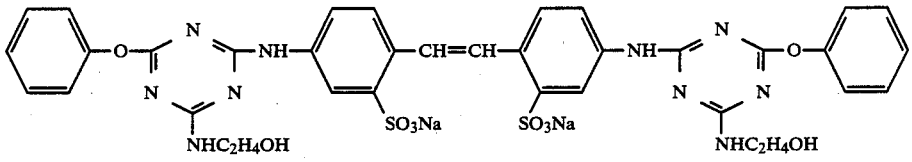

(A'-2)

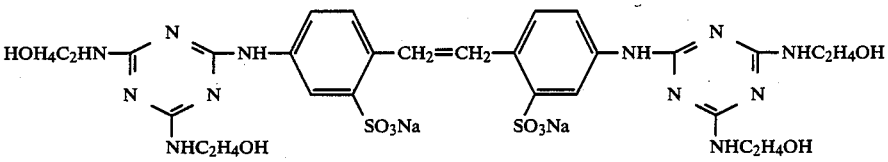

(A'-3)

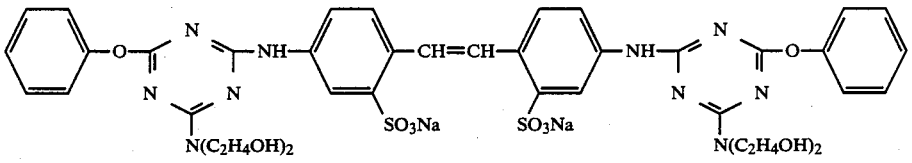

-continued
[Exemplary compounds]
(A'-4)
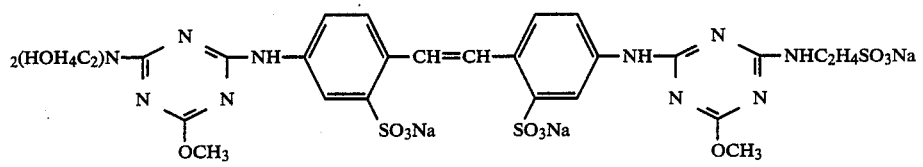
(A'-5)
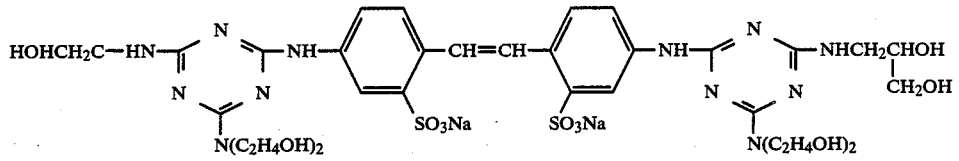
(A'-6)
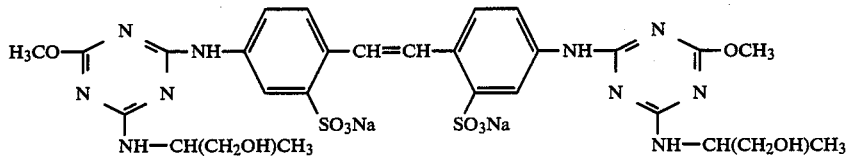
(A'-7)
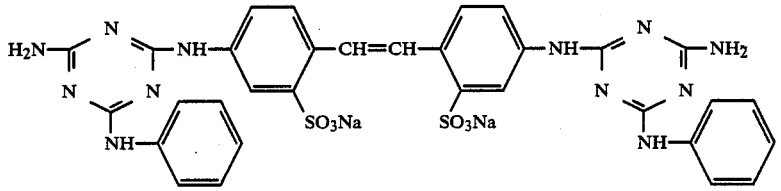
(A'-8)
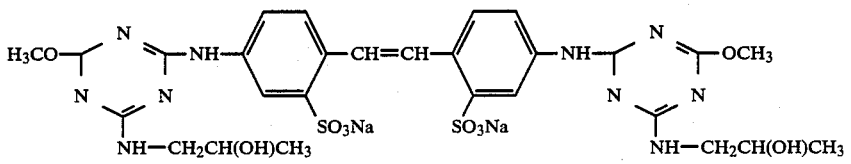
(A'-9)
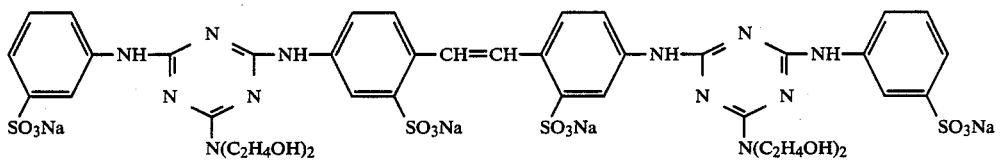
(A'-10)
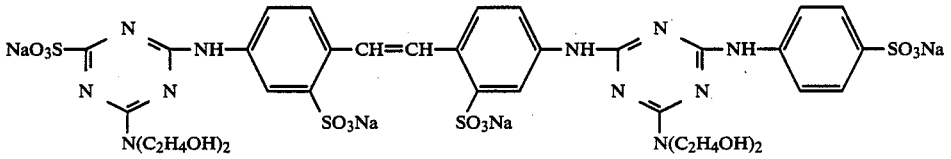
(A'-11)
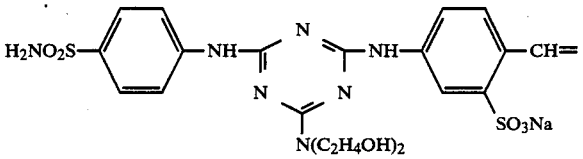
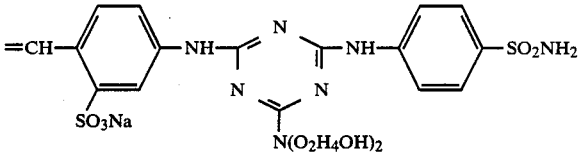

-continued

[Exemplary compounds]

(A'-12)

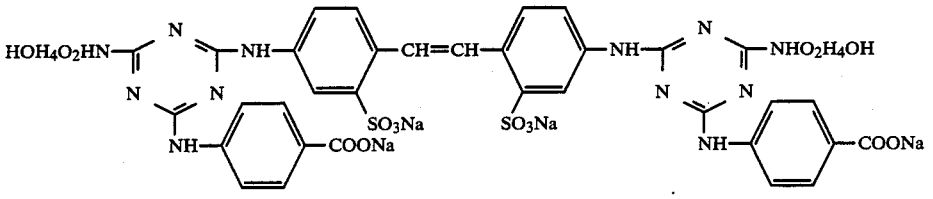

(A'-13)

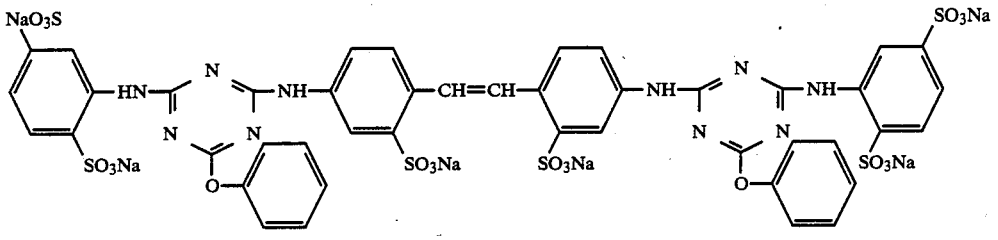

(A'-14)

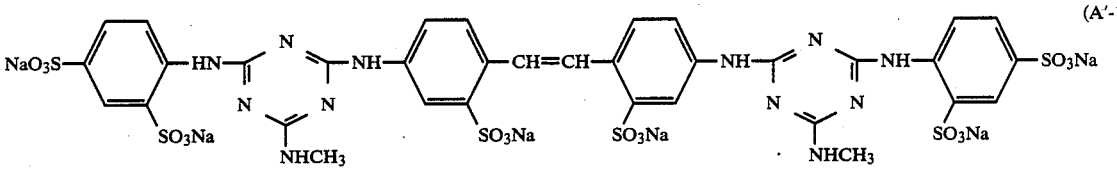

The triazylstilbene type fluorescent brightening agent represented by the formula [V] can be synthesized by the conventional method as described in, for example, "Fluorescent brightening agent", edited by Kaseihin Kogyo Kyokai (published on August, 1976), page 8.

These triazylstilbene type fluorescent brightening agent is preferably used in the range of 0.2 to 6 g per 1 liter of the color developing solution to be used in the present invention, particularly preferably 0.4 to 3 g.

The color developing solution of the present invention may contain the following developing solution components, in addition to the above component.

As alkali agents other then the above carbonates, sodium hydroxide, potassium hydroxide, silicate, sodium metaborate, potassium metaborate, trisodium phosphate, tripotassium phosphate, borax, etc. may be used alone or in combination so far as the above effects of the present invention, namely, the effect of making the pH stable can be maintained. If necessary for the preparation of the solution, or for the purpose of increasing intensity of ions, there can be used a variety of salts such as disodium hydrogenphosphate, dipotassium hydrogenphosphate, sodium bicarbonate, potassium bicarbonate and borate.

If necessary, an inorganic or organic antifoggant may be also added.

If necessary, a development accelerator can be also used. Such a developing accelerator may include every kind of pyridinium compounds as typified by those disclosed in U.S. Pat. No. 2,648,604 and No. 3,671,247 and Japanese Patent Publication No. 9503/1969 and other cationic compounds, cationic dyes such as phenosafranine, neutral salts such as thallium nitrate, polyethylene glycol or derivatives thereof disclosed in U.S. Pat. No. 2,533,990, No. 2,531,832, No. 2,950,970 and No. 2,577,127 and Japanese Patent Publication No. 9504/1969, nonionic compounds such as polythioethers, organic solvents disclosed in Japanese Patent Publication No. 9509/1969, or organic amines, ethanolamine, ethylenediamine, diethanolamine, triethanolamine, etc. It may also include benzyl alcohol, phenethyl alcohol, and bisides these, acetylene glycol, methyl ethyl ketone, cyclohexane, thioethers, pyridine, ammonia, hydrazine, amines, etc. disclosed in U.S. Pat. No. 2,304,925.

In the above, the poor solubility organic solvent particularly typified by benzyl alcohol tends to cause appearance of tar after use of the color developing solution for a long period of time, particularly during the running processing according to a low replenishing system. Appearance of such tar, when appeared in the neighborhood of a paper light-sensitive material to be processed, may even bring about such a serious trouble that a commercial value of the product is extremely damaged.

Also, since the poor solubility organic solvent has poor solubility to water, there is not only a cumbersomeness that a stirring instrument is needed to prepare the color developing solution itself, but also a limit to the development accelerating effect due to the badness of its solbility rate even with use of such a stirring instrument.

Further, the poor solubility organic solvent does have problems such that it has a great value for the burden to envvironmental pollution such as biochemical oxygen demand (BOD), and cannot be abandoned in sewerages, rivers or the like, so that much labor and cost are needed for waste liquor disposal. Accordingly, it is preferably used in a decreased amount, or not used.

In the color developing solution of the present invention, if necessary, ethylene glycol, methyl cellosolve, methanol, acetone, dimethylformamide, $\beta$-cyclodextrin and other compounds disclosed in Japanese Patent Publications No. 33378/1972 and No. 9509/1969 can be used as an organic solvent for increasing the dissolving degree of a developing agent.

Moreover, an auxiliary developing agent can be used together with the developing agent. Such an auxiliary developing agent is known to include, for example, N-methyl-p-aminophenol hexasulfate (Metol), phenidone, N,N'-diethyl-p-aminophenol hydrochloride, N,N,N'N'-tetramethyl-p-phenylenediamine hydrochloride, and may be added usually in an amount of 0.01 g to 1.0 g/l. Besides these, if necessary, there can be further added competing couplers, fogging agents, colored couplers, development restrainer-releasing type couplers (the so-called DIR couplers) or development restrainer-releasing compounds.

Still further, besides, color development can be carried out in the presence of various additives such as antistain agents, sludge prventive agents, interlayer effect accelerators, ph buffering agents, development inhibitors, fog preventives, complex forming agents in order to make hydrophilic, preservatives, development accelerators, competing couplers, fogging agents, supplemental developing agent compounds and viscosity adjusting agents (see Research Disclosure No. 17544, December 1978, Section XXI, Industrial Opportunities Ltd., published by Homewell Havant, Hampshire, Great Britain; and Ullumannes Enzyklopadie der Technishen Chemie, 4th Edition, Vol. 18, (1979), particularly pages 451, 452 and 463 to 465). Suitable compositions for developing solution are given in Grant Haist, "Modern Photographic Processing", John Wiley and Sons (1973), Vol. 1 and 2.

The respective components of the above color developing agent can be prepared by successively adding them to a given amount of water, followed by stirring. In this occasion, a component having poor solubility to water may be added by mixing it with the above organic solvent such as triethanolamine. More generally, a mixture of a plurarity of components that can be stably present together with each other, prepared in the form of a concentrated aqueous solution or a solid, may be added in water and stirred to obtain a solution as the color developing solution of the present invention.

In the present invention, the above color developing agent can be used in a desired pH renge, and generally in the range of pH 8 or more, but, from a viewpoint of rapid processing, preferably in the range of pH 9.5 to 13.0, more preferably pH 9.8 to 13.0.

In the present invention, the color developing processing temperature may be not lower than 30° C. and not higher than 50° C., within which the higher it is, the more preferably it becomes possible to carry out rapid processing in a short time, but, from a view point of image preservation stability, the temperature should bot be so high. Thus, the processing is preferably carried out at not lower than 33° C. and not higher than 45° C.

In general, the color developing is conventionally carried out in about 3 minutes and 30 seconds, but, in the present invention, it can be carried out in 2 minutes or less, or can be also carried out in the range of 30 seconds to 1 minute and 30 seconds.

In the present invention, a supplemental amount of the color developing solution is treated in the range of 300 ml to 10 ml per $lm^2$ of a photographic material. In order to make the effect of the present invention greatest, processing may be carried out in the range of 150 ml to 30 ml. Most preferably, the processing is carried out in the range of 100 ml to 80 ml.

That is, in the present invention, the bromide having greater restraint effect among the halides serving as restraint components is dissolved out in a very small amount, and, on the other hand, the chloride is dissolved out in a very large amount. However, this chloride has only a very weak restraint action in the light-sensitive silver halide photographic material of the present invention having higher proportion of silver chloride, as compared with the case where greater development acceleration action is seen in a conventional photographic material using a silver chlorobromide emulsions having higher proportion of silver bromide. Accordingly, if the chloride having concentration higher than a certain level is in advance added in the developing solution, the developing effect may be masked as a result, so that the change in the resulting photographic density can be made very small whether the replenishing amount is large or small.

The present invention can be applied in any system if it is a system using the color developing solution containing the above compound represented by the above formula [I] and at least one compound selected from the above compound represented by the formula [II] and the above compound represented by the formula [III], and preferably having the sulfite concentration of $5\times10^{-4}$ mole to $2\times10^{-2}$ mole per 1 liter of the color developing solution. For example, there can be used a monobath processing system, as well as other various types of processing systems such as spray system in which a processing solution is formed into a spray, a web system utilizing the contact with a carrier impregnated with a processing solution, or a developing system using a viscous processing solution. However, the processing step should substantially comprise the steps of color developing, bleach-fixing and washing or stabilizing that can be substituted with the washing.

In the present invention, after color developing processing, the photographic material is processed with a processing solution having fixing ability, but when the processing solution having fixing ability is a fixing solution, bleaching processing is carried out before it.

The bleach-fixing step may be constituted separately of a bleaching step and a fixing step, or may comprise a bleach-fixing bath carrying out the bleaching and fixing in a bath.

Bleaching agents that can be used in the bleach-fixing solution used in the present invention are metal complex salts of organic acids. The complex salts are compounds formed by coordination of a metal ion such as iron, cobalt, copper, etc. with an organic acid such as aminopolycarboxylic acid or oxalic acid and citric acid. Most preferred organic acid used for the formation of metal complex salts may include polycarboxylic acid. These polycarboxylic acid and aminopolycarboxylic acid may be alkali metal salts, ammonium salts or water soluble amine salts. Specific examples of these may include the following.

[1] Ethylenediaminetetraacetic acid
[2] Diethylenetriaminepentaacetic acid
[3] Ethylenediamine-N-(62-oxyethyl)-N,N',N'-triacetic acid
[4] Propylenediaminetetraacetic acid
[5] Nitrilotriacetic acid
[6] Cyclohexanediaminetetraacetic acid
[7] Iminodiacetic acid
[8] Dihydroxyethylglycinecitric acid (or tartaric acid)
[9] Ethyl ether diaminetetraacetic acid
[10] Glycol ether diaminetetraacetic acid
[11] Ethylenediaminetetrapropionic acid
[12] Phenylenediaminetetraacetic acid
[13] Ethylenediaminetetraacetic acid disodium salt
[14] Ethylenediaminetetraacetic acid tetra(trimethylammonium) salt
[15] Ethylenediaminetetraacetic acid tetrasodium salt
[16] Diethylenetriaminepentaacetic acid pentasodium salt

[17] Ethylenediamine-N-(β-oxyethyl)-N,N',N'-triacetic acid sodium salt
[18] Propylenediaminetetraacetic acid sodium salt
[19] Nitrilotriacetic acid sodium salt
[20] Cyclohexanediaminetetraacetic acid sodium salt These bleaching agent may be used preferably in an amount of 5 to 450 g/l, more preferably 20 to 250 g/l. The bleach-fixing solution may contain a silver halide fixing agent in addition to the bleaching agent mentioned above, and, if necessary, a solution of the composition containing sulfite as a preservative may be used. There can be also used a bleach-fixing solution of the composition to which an ethylenediaminetetraacetic acid iron (III) complex salt belaching agent and a halide such as ammonium bromide other than the above silver halide fixing agent are added in a small amount, or, on the contrary, a bleach-fixing solution of the composition to which a silver halide such as ammonium bromide is added in a large amount, or a special bleach-fixing solution or the composition comprising a combination of an ethylenediaminetetraacetic acid iron (III) complex salt bleaching agent and a large amount of silver halide such as ammonium bromide. The above halide that can be used may include, besides ammonium bromide, hydrochloric acid, hydrobromic acid, lithium bromide, sodium bromide, potassium bromide, sodium iodide, potassium iodide, ammonium iodide, etc.

The silver halide fixing agent contained in the bleach-fixing solution may typically include the compounds capable of forming a water soluble complex salt be reacting with a silver halide, as used in ordinary fixing processing, for example, thiosulfates such as potassium thiosulfate, sodium thiosulfate and ammonium thiosulfate; thiocyanates such as potassium thiocyanate, sodium thiocyanate and ammonium thiocyanate; thioureas; thioethers; etc. These fixing agents may be used in an amount of 5 g/l or more and in the range of the amount can be dissolved, and, in general, may be used in an amount of 70 g/l to 250 g/l.

The bleach-fixing solution may contain, solely or in combination, a variety of pH buffering agents such as boric acid, borax, sodium hydroxide, potassium hydroxide, sodium carbonate, potassium carbonate, sodium bicarbonate, potassium bicarbonate, acetic acid, sodium acetate and ammonium hydroxide. It may also contain various brightening agents, anti-foeming agents or surface active agents. It may further appropriately contain preservatives such as bisulfate addition producs of hydroxylamine, hydrazine or an aldehyde compound, organic chelating agents such as aminopolycarboxylic acid or stabilizers such as nitroalcohol and nitrate, and organic solvents such as methanol, dimethylsulfonamide and dimethylsulfoxide.

To the bleach-fixing solution used in the present invention, various bleach accelerating agents may be added, disclosed in Japanese Provisional Patent Publication No. 280/1971, Japanese Patent Publications No. 8506/1970 and No. 556/1971, Belgian Patent No. 770/910, Japanese Patent Publications No. 8836/1970 and No. 9854/1978, Japanese Provisional Patent Publications No. 71634/1979 and No. 42349/1974, etc. can be added.

The bleach-fixing solution may be used at the pH of 4.0 or more, but, in general, at the pH of not less than 5.0 and not more than 9.5, more preferably at the pH of not less than 6.0 and not more than 8.5, and still more preferably at the pH of not less than 6.5 and not more than 8.5 to carry out the processing. The processing temperature to be used may be a temperature of not less than 3° C. preferably not less than 5° C., lower than the processing temperature in a color developing tank, and, desirably, a temperature of not less than 55° C. while suppressing the evaporation or the like.

In the present invention, the bleaching solution may be carried out by blowing an air or blowing oxygen in a bleach-fixing bath and a storage tank of the bleach-fixing supplementing solution in order to heighten activity of the bleach-fixing solution, if desired, or suitable oxidizing agent such as hydrogen peroxide, bromates, persulfates, etc. may optionally be added thereto.

In the present invention, subsequent to the above color developing and bleach-fixing steps, water washing or processing (stabilizing processing substituting for water washing) with a low supplemental washing solution (stabilizing solution substituting for water washing) is applied.

In the following, the processing (stabilizing processing substituting for water washing) with a low supplemental washing solution (stabilizng solution substituting for water washing) which can be substituted for washing to be applied to the present invention will be explained.

The low supplemental washing solution and the processing according to said low supplemental washing solution of the present invention mean a processing solution and a processing which is carried out after a fixing step or a bleach-fixing step substituting for water washing.

Conventional washing processing is to wash away a processing solution of a previous bath contained in constituent layers of a light-sensitive material, more specifically, a large amount of thiosulfates, chemicals or silver complex salts in a fixing solution or a bleach-fixing solution, or chemicals in a developing solution and the like, by washing with water. This processing method may be mentioned a method in which dipping a material in a water washing bath so that a large amount of flowing water is flown on the surface of a light-sensitive material and rapidly flown out, a substitution water washing method in which a light-sensitive material is dipped in a predetermined amount of water and the water is replaced with fresh one after lapse of predetermined time, and the like. While it is usually processed only with water, it may be employed a method in which before processing with water, a light-sensitive material is dipped in a bath containing salts such as sodium sulfite, etc. for several minutes in order to accelerate the processing rate and then conducting water washing processing. In any event, the water washing processing is carried out with water. Accordingly, an extremely large amount of water for washing is reqired to prevent any troubles such as drying of the light-sensitive material, stain, discoloration or fading of images during storage which is caused by chemicals such as thiosulfate remaining in the light-sensitive material. Further, it is required an equipment for discharging the waste water after water washing processing, thus the method is not preferred from spatial and economical view points. The low supplemental washing solution and the low supplemental washing processing of the present invention are those improved these defects, and the processing solution to be used is not simple water, but an aqueous solution having an antimildw, antiseptic and bactericidal means, and may be an aqueous solution further containing a chelating agent having a chelating stabilizaton degree against ferric ion of 8 or more, an ammonia compound, an organic acid salt, a pH adjusting agent, a surfactant, a sulfite, a brightening agent, etc., if necessary.

In the conventional water washing processing, by supplementing about 5 liters to 150 liters of water per unit area 1 $m^2$ of a light-sensitive material to be processed, the compounds such as thiosulfate, etc. adhered or permeated to the light-sensitive material were washed away. On the other hand, according to the low supplemental washing processing of the present invention, such compounds adhered or permeated to the light-sensitive material can be washed away with a supplemental amount of about 0.01 liter to 2.5 liters per unit area 1 $m^2$ thereof. Further, in the processing method of the present invention, since the supplemental amount is extremely small as compared with the conventional water washing processing as mentioned above, feed and discharge piping equipments which are inevitably required in the conventional water washing processing step are not necessarily required so that miniaturizaton of the equipment can be accomplished.

The pH of the stabilizing solution substituting for water washing applicable in the present invention may range between 5.5 and 10.0. The pH adjusting agents that can be contained in the stabilizing solution substituting for water washing applicable in the present invention may be any of those of alkali agents or acid agents generally known in the art.

The stabilizing processing may be carried out at a temperature ranging between 15° C. and A60° C., preferably 20° C. and 45° C. The processing time as short as possible is also more preferable from a view point of the rapid processing, but, in general, may be in the range of 20 seconds ro 10 minutes, most preferably 1 minute 3 minutes. In the case of multiple tank stabilizing processing, it is also preferably to carry out the processing in a shorter time in anterior tanks and in a longer time in posterior tanks. It is particularly preferable to successively carry out the processing in such a time that is 20% to 50% longer than the processing time in an anterior tank. No washing is required at all after the stabilizing processing applicable in the present invention, but rinsing with use of small amount of water in a very short time or surface washing may be optionally carried out, if necessary.

The stabilizing solution substituting for water washing in the stabilizing step applicable to the present invention may be supplied, in the case of a multiple tank counter current system, in such a manner that the solution is supplied to a posterior tank and overflowed from an anterior tank. As a matter of course, the processing may be carried out in a single tank. As the method of adding above compounds, various methods are available, including a method in which the compounds are added to a stabilizing tank in the form of a concentrated solution, or a method in which the above compounds and the resulting solution is used as a supplemental solution for supplementing the stabilizing solution substituting for water washing. Any of these methods may be used for the addition.

Thus, in the present invention, the processing by the stabilizing solution substituting for water washing refers to the processing for stabilizing, wherein stabilizing processing is carried out immediately after processing by a processing solution having bleach-fixing ability without substantially carrying out washing with water, and the processing solution used in such stabilizing solution is called the stabilizing solution substituting for water washing and the processing tank is called a stabilizing bath or a stabilizing tank.

The stabilizing tank in the stabilizing processing applicable in the present invention may preferably comprise 1 to 5 tanks, particularly 1 to 3 tanks, and not more than 9 tanks at most.

In the processing of the present invention, silver may be recovered according to a known method from a processing solution containing a soluble silver complex salt, including washing water or a stabilizing solution substituting for water washing, as well as a fixing solution and a bleach-fixing solution. For example, effectively utilizable are the electrolytic process (French Patent No. 2,299,667), the precipitation process (Japanese Provisional Patent Publication No. 73037/1977, German Patent No. 2,548,237), the metal substitution process (British Patent No. 1,353,805), etc.

In the processing method according to the present invention, once the bleaching and fixing (or bleach-fixing) have been carried out after the color developing, the stabilizing can be carried out without the washing, or, alternatively, the washing may be carried out and thereafter the stabilizing may be carried out. In addition to the above steps, known auxiliary steps such as reversal processing, and washing with a small amount of water may be added. Typical examples of preferred processing steps may include the following respective steps:

(1) Color developing→Bleach-fixing→Washing (2) Color developing →Bleach-fixing→Washing with small amount water→Washing (3) Color developing →Bleach-fixing→Washing →Stabilizing (4) Color developing →Bleach-fixing→Stabilizing (5) Color developing →Bleach-fixing →First stabilizing →Second stabilizing (6) Color developing →Washing (or Stabilizing)→ Bleach-fixing→Washing (or Stabilizing)

(7) Color developing→Stopping→Bleach-fixing-→Washing (or Stabilizing)

(8) Color developing→Bleaching→Washing→Fixing→Stabilizing (9) Color developing→Bleaching→Fixing→Stabilizing

(10) Color developing→Bleaching→Washing with small amount water→Fixing→First stabilizing-→Second stabilizing

(11) Color developing→Bleaching→Washing with small amount water→Fixing→Washing with small amount water→Washing→Stabilizing

(12) Color developing→Washing with small amount water→Bleaching→Washing with small amount water→Fixing→Washing with small amount water→ Stabilizing

(13) Color developing→Stopping→Bleaching-→Washing with small amount water→Fixing→Washing with small amount water→Washing→Stabilizing The method of processing the light-sensitive silver halide color photographic material of the present invention is to process a light-sensitive silver halide color photographic material having a silver halide emulsion layer containing silver halide grains substantially comprised of silver chloride, by using the aforesaid color developing solution used in the present invention, i.e., the color developing solution containing as preservatives the compounds of the present invention, and preferably containing sulfite in concentration of $5\times10^{-4}$ mole/l to $2\times10^{-2}$ mole/l, and further containing a specific chelating agent.

The silver halide grains used in the light-sensitive silver halide color photographic material applied in the present invention are substantially comprised of silver chloride. In the present invention, the terms "silver halide grains substantially comprised fo silver chloride" are meant to be silver halide grains containing at least not less than 80 mole %, preferably not less than 90 mole %, and more preferably not less than 95 mole %, of silver chloride.

The silver halide emulsion containing the above siliver halide grains substantially comprised of silver chloride may contain, besides silver chloride, silver bromide and/or silver iodide as the silver halide composition. In such a case, silver bromide may be contained in an amount of 20 mole % or less, preferably 10 mole % or less, more preferably 5 mole % or less. When silver iodide is present, it may be contained in an amount of 1 mole % or less, preferably 0.5 mole % or less. Such ailver halide grains of the present invention, substantially comprised of silver chloride may be contained preferably to account for 80% or more, more preferably 100%, in % by weight, of total silver halide grains in the silver halide emulsion layers which contain the silver halide grains.

Crystals of the silver halide grains used in the present invention may be of regular crystals, twin crystals or others, and these can be used those having any ratio of [100] face to [111] face. The crystal structure of these silver halide grains may be uniform through inside to outside, or may be of layered structure comprising an inside and outside of different nature (a core/shell type). These silver halide grains may be also of the type such that a latent image is chiefly formed on the surface, or of the type wherein it is formed in the inside of a grain. Plate-like silver halide grains (see Japanese Provisional Patent Publications No. 113934/1983 and No. 47959/1986) can also be used.

The silver halide grains to be used in the present invention may be obtained by any preparative methods inlcuding an acidic method, a neutral method and an ammoniacal method.

Also, seed grains may be prepared according to an acidic method, which are allowed to grow according to an ammoniacal method that can achieve higher growth rate, until they grow to have given size. When growing the silver halide grains, it is preferable to control the pH and pAg in a reaction vessel, and pouring and mixing silver ions and halide ions successively or simultaneously in the amount corresponding to the growth rate of silver halide grains as disclosed in, for example, in Japanese Provisional Patent Publication No. 48521/1978.

In one embodiment, the grains comprises at least two regions different in halide composition, for example, comprises one core and at least one shell and at least one region B contains at least 10 mole % of silver bromide, preferably at least 25 mole % of silver bromide, provided that the silver bromide is 50% or less.

The region B may be present as a core or a shell surrounding the core. The grains preferably contain the core covered with at least one region B. In this case, the region B may be present as a shell in the silver halide grains or on the surface of crystals.

As the other embodiment, the grains may have at least one band region ZBr having high content of at least 10 mole % of bromide and have no bromide rich band region on the surface of the silver halide grains.

These silver bromide rich band region ZBr in the grains may be present either a core or a layer in the silver halide grains.

The silver halide grains according to the present invention are preferably prepared in the above-mentioned manner. In the present specification, a composition containing such silver halide grains are referred to as a silver halide emulsion.

The silver halide emulsion may be chemically sensitized by using active gelatin; sulfur sensitizer, for example, thiourea and cystine; selenium sensitizer; reduction sensitizer, for example stunnous salts, thiourea dioxide, polyamine, etc.; noble metal sensitizer, for example, gold sensitizer, specifically including sensitizer such as potassium aurothiocyanate, potassium chloroaurate and 2-aurothio-3-methylbenzothiazolium chloride, or sensitizing agents having a water soluble group, for example, ruthenium, palladium, platinum, rhodium, iridium, etc., specifically including ammonium chloropalladate, potassium chloroplatinate and sodiun chloropalladate (Some of these act as a sensitizer or a fog-suppressing agent depending on whether they are in a large amount or a small amount.), etc., which may be used alone or in appropriate combination (for example, combination of a gold sensitizer with a sulfur sensitizer, combination of a gold sensitizer with a selenium sensitizer, etc.).

The silver halide emulsion according to the present invention may be subjected to chemical ripening by adding a sulfur-containing compound, and, before such chemical ripening, during the ripening, or after the ripening, at least one of hydroxytetrazaindenes and at least one of nitrogen-containing heterocyclic compounds having a mercapto group may be contained.

The silver halide used in the present invention may be optically sensitized by adding a suitable sensitizing dye in an amount of $5\times10^{-8}$ mole to $3\times10^{-3}$ mole per mole of silver halide so that sensitivities to respectively desired light-sensitive wavelength regions can be imparted thereto. There can be various types of sensitizing dyes, which sensitizing dyes can be used alone or in combination with two or more of them. The sensitizing dyes advantageously used in the present invention may include, for example, the following:

That is, sensitizing dyes to be used in a blue-sensitive silver halide emulsion may include, for example, those disclosed in West German Patent No. 929,080, U.S. Pat. No. 2,231,658, No. 2,493,748, No. 2,503,776, No. 2,519,001, No. 2,912,329, No. 3,656,959, No. 3,672,897, No. 3,694,217, No. 4,025,349 and No. 4,046,572, British Patent No. 1,242,588, Japanese Patent Publications. No. 14033/1969 and No. 24844/1977, etc. Sensitizing dyes to be used in a green-sensitive silver halide emulsion may typically include, for example, cyanine dyes, merocyanine dyes or composite cyanine dyes disclosed in U.S. Pat. No. 1,939,201, No. 2,072,908, No. 2,739,149 and No. 2,945,763, British Patent No. 505,979, etc. Further, sensitizing dyes to be used in a red-sensitive silver halide emulsion may typically include, for example, cyanine dyes, merocyanine dyes or composite cyanine dyes disclosed in U.S. Pat. No. 2,269,234, No. 2,270,378, No. 2,442,710, No. 2,454,629 and No. 2,776,280, etc. Still further, the cyanine dyes, merocyanine dyes or composite cyanine dyes as disclosed in U.S. Pat. No. 2,213,995, No. 2,493,748 and No. 2,519,001, West German Patent No. 929,080 can advantageously used in the green-sensitive silver halide emulsion or the red-sensitive silver halide emulsion.

These sensitizing dyes may be used alone or in combination of these.

If necessary, the light-sensitive photographic material of the present invention may be optically sensitized a desired wavelength region according to a spectral sensitization method by using a cyanine dye or a merocyanine dye alone or in combination.

A particularly preferable spectral sensitization method may typically include the methods disclosed in Japanese Patent Publications No. 4936/1968, No. 22884/1968, No. 18433/1970, No. 37433/1972, No. 28293/1973, No. 6209/1974 and No. 12375/1978, Japanese Provisional Patent Publications No. 23931/1977, No. 51932/1977, No. 80118/1979, No. 153926/1983, No. 116646/1984 and No. 116647/1984, etc., which are concerned with the combination of benzimidazolocarbocyanine with benzoxazolocarbocyanine.

Those concerned with the combination of carbocyanine having a benzimidazole nucleus with other cyanines or merocyanines may include, for example, those disclosed in Japanese Patent Publications No. 25831/1970, No. 11114/1972, No. 25379/1972, No. 38406/1973, No. 38407/1973, No. 34535/1979 and No. 1569/1980, Japanese Provisional Patent Publications No. 33220/1975, No. 38526/1975, No. 107127/1976, No. 115820/1976, No. 135528/1976 and No. 104916/1977 and No. 917/1977, etc.

Those concerned with the combination of benzoxazolocarbocyanine (oxa.carboxyanine) with other carbocyanines may include, for example, those disclosed in Japanese Patent Publications No. 32753/1969 and No. 11627/1971, Japanese Provisional Patent Publication No. 1483/1982, etc., and those concerned with merocyanine may include, for example, those disclosed in Japanese Patent Publications No. 38408/1973, No. 41204/1973 and No. 40662/1975, Japanese Provisional Patent Publications No. 25728/1981, No. 10753/1983, No. 91445/1983, No. 116645/1984 and No. 33828/1975, etc.

Also, the methods concerned with the combination of thiacarbocyanine with other carbocyanines may include, for example, those disclosed in Japanese Patent Publications No. 4932/1968, No. 4933/1968, No. 26470/1970, No. 18107/1971 and No. 8741/1972, Japanese Provisional Patent Publication No. 114533/1984, etc., and the methods disclosed in Japanese Patent Publication No. 6207/1974, employing zeromethine- or dimethinemerocyanine, monomethine- or trimethinecyanine and styryl dyes, can be advantageously used.

In adding these sensitizing dyes to the silver halide emulsion according to the present invention, they are used as a dye solution obtained by previously dissolving them in a hydrophilic solvent such as methyl alcohol, ethyl alcohol, acetone, dimethylformamide and fluorinated alcohol disclosed in Japanese Patent Publication No. 40659/1975.

They may be added at any time at the initiation of chemical ripening of the silver halide emulsions, during the ripening, or after completion of the ripening, or in some cases, at the step right before the coating of the emulsion.

Dyes that are water soluble or decolored by a color developing solution (AI dyes) may be added to photographic constituent layers of the light-sensitive silver halide color photographic material of the present invention. The AI dyes may include oxonol dyes and merocyanine dyes and azo dyes. Among them, particularly useful are oxonol dyes, hemioxonol dyes and merocyanine dyes. Examples of the AI dyes may include those disclosed in British Patents No. 584,609 and No. 1,277,429, Japanese Provisional Patent Publications No. 85130/1973, No. 99620/1974, No. 114420/1974, No. 129537/1974, No. 108115/1977, No. 25845/1984, No. 111640/1984 and No. 111641/1984, U.S. Pat. No. 2,274,782, No. 2,533,472, No. 2,956,079, No. 3,125,448, No. 3,148,187, No. 3,177,078, No. 3,247,127, No. 3,260,601, No. 3,540,887, No. 3,575,704, No. 3,653,905, No. 3,718,472, No. 4,071,312 and No. 4,070,352.

In general, these AI dyes may be used preferably in an amount of $2\times10^{-3}$ to $5\times10^{-1}$ mole, more preferably $1\times10^{-2}$ to $1\times10^{-1}$ mole, per mole of silver in an emulsion layer.

In the present invention, cyan coupler represented by the formula [C-1] or [C-2] may preferably be contained in at least one layer of the silver halide emulsion layers.

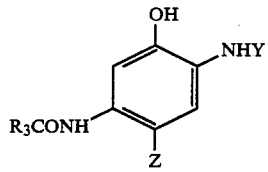

Formula [C - 1]

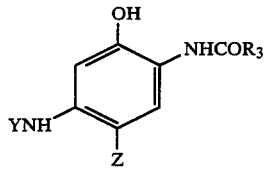

Formula [C - 2]

In the formulae, Y represents —$COR_4$,

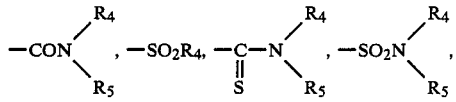

—$CONHCOR_4$ or —$CONHSO_2R_4$ (where $R_4$ represents an alkyl group, an alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring); $R_3$ represents a ballast group; and Z represents a hydrogen atom or a group eliminatable through the coupling reaction with the oxidized product of an aromatic primary amine series color developing agent.

In the above formulae [C-1] and [C-2], Y is the group represented by —$COR_4$,

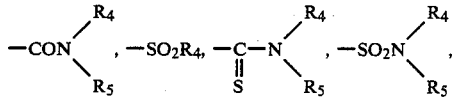

—$CONHCOR_4$ or —$CONHSO_2R_4$. Here, $R_4$ represents an alkyl group, preferably an alkyl group having 1 to 20 carbon atoms (for example, methyl, ethyl, t-butyl, dodecyl, etc.), an alkenyl group, preferably an alkenyl group having 2 to 20 carbon atoms (for example, an allyl group, a heptadecenyl group, etc.), a cycloalkyl group, preferably those having 5 to 7-membered ring (for example, cyclohexyl, etc.), an aryl group (for example, a phenyl group, a tolyl group, a naphthyl group, etc.), a heterocyclic group, preferably 5-membered or 6-membered heterocyclic group containing 1 to 4 nitrogen atom, oxygen atom or sulfur atom (for example, a furyl group, a thienyl group, a benzothiazolyl group, etc.). $R_5$ represents a hydrogen atom or a group represented by $R_4$. $R_4$ and $R_5$ may be bonded with each other to form a 5-membered or 6-membered heterocyclic ring containing a nitrogen atom. In $R_2$ and $R_3$, optional substituents can be introduced therein, and there may be mentioned, for example, an alkyl group having 1 to 10 carbon atoms (for example, ethyl, i-propyl, i-butyl, t-butyl, t-octyl, etc.), an aryl group (for example, phenyl, naphthyl, etc.), a halogen atom (fluorine, chlorine, bromine, etc.), a cyano group, a nitro group, a sulfoneamido group (for example, methanesulfonamido, butansulfonamido, p-toluenesulfonamido, etc.), a sulfamoyl group (for example, methylsulfamoyl, phenylsulfamoyl, etc.), a sulfonyl group (for example, methanesulfonyl, p-toluenesulfonyl, etc.), a fluorosulfonyl group, a carbamoyl group (e.g., dimethylcarbamoyl, phenylcarbamoyl, etc.), and oxycarbonyl group (e.g., ethoxycarbonyl, phenoxycarbonyl, etc.), a heterocyclic group (e.g., a pyridyl group, a pyrazolyl group, etc.), an alkoxy group, an aryloxy group, an acyloxy group and the like.

In the formulae [C-1] and [C-2], $R_3$ represents a ballast group necessary for providing a diffusion resistance to the cyan coupler represented by the formulae [C-1] and [C-2] and a cyan dye derived from said cyan coupler. Preferably, $R_3$ may be an alkyl group having 4 to 30 carbon atoms, an aryl group or a heterocyclic group. For example, $R_3$ may include a straight or branched alkyl group (e.g. t-butyl, n-octyl, t-octyl, n-dodecyl, etc.), an alkenyl group, a cycloalkyl group, a 5-membered or 6-membered heterocyclic group and the like.

In the formulae [C-1] and [C-2], Z represents a hydrogen atom or a group eliminatable through the coupling reaction with an aromatic primary amine color developing agent. For example, Z may include a halogen atom (e.g. chlorine, bromine, fluorine, etc.), a substituted or unsubstituted alkoxy group, an aryloxy group, a heterocyclyloxy group, an acyloxy group, a carbamoyloxy group, a sulfonyloxy group, an alkylthio group, an arylthio group, a heterocyclicthio group or a sulfonamide group, and more specifically, those as disclosed in U.S. Pat. No. 3,741,563, Japanese Provisional Patent Publication No. 37425/9172, Japanese Patent Publication No. 36894/1973, Japanese Provisional Patent Publications No. 10135/1975, No. 108841/1976, No. 120343/1975, No. 18315/1977, No. 105226/1978, No. 14736,1979, No. 48237/1979, No. 32071/1980, No. 65957/1980, No. 1938/1981, No. 12643/1981, No. 27147/1981, No. 146050/1984, No. 166956/1984, No. 24547/1985, No. 35731/1985 and No. 37557/1985.

In the present invention, the cyan couplers represented by the following formulae [C-3], [C-4] or [C-5] are more preferred.

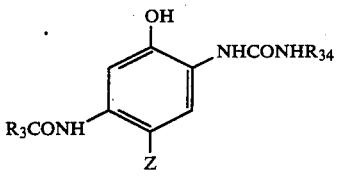

Formula [C-3]

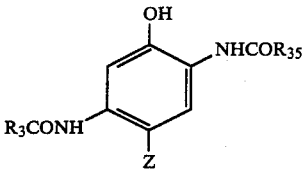

Formula [C-4]

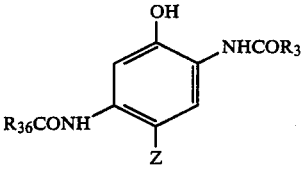

Formula [C-5]

In the formula [C-3], $R_{34}$ is a substituted or unsubstituted aryl group (particularly preferred is a phenyl group). As the substituent for said aryl group represented by $R_{34}$, they may be mentioned at least one substituent selected from $-SO_2R_{37}$ a halogen atom (e.g., fluorine, bromine, chlorine, etc.), $-CF_3$, $-NO_2$, $-CN$, $-COR_{37}$, $-COOR_{37}$, $-SO_2OR_{37}$,

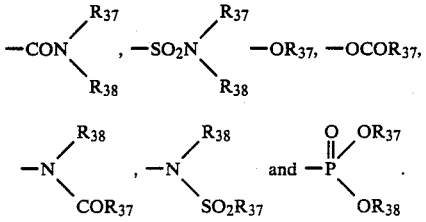

In the above, $R_{37}$ represents an alkyl group, preferably an alkyl group having 1 to 20 carbon atoms (e.g., methyl, ethyl, tert-butyl, dodecyl, etc.), an alkenyl group, preferably an alkenyl group having 2 to 20 carbon atoms (e.g., an aryl group, a heptadecenyl group, etc.), a cycloalkyl group, preferably 5 to 7-membered ring group (e.g., a cyclohexyl group, etc.), an aryl group (e.g., a phenyl group, a tolyl group, a naphthyl group, etc.); and $R_{38}$ is a hydrogen atom or a group represented by the above $R_{37}$.

The preferred compounds of the phenol type cyan coupler represented by [C-3] includes a compound in which $R_{37}$ is a substituted or unsubstituted phenyl group, and the substituent for the phenyl group includes a cyano group, a nitro group, $-SO_2R_{39}$ (in which $R_{39}$ is an alkyl group), a halogen atom or a trifluoromethyl group.

In the formulae [C-4] and [C-5], $R_{35}$ and $R_{36}$ each represent an alkyl group, preferably an alkyl group having 1 to 20 carbon atoms (e.g. methyl, ethyl, tert-butyl, dodecyl, etc.), an alkenyl group, preferably an alkenyl group having 2 to 20 carbon atoms (e.g. allyl, oleyl, etc.), a cycloalkyl group, preferably a 5 to 7-membered cyclic group (e.g. cyclohexyl, etc.), an aryl group (e.g. a phenyl group, a tolyl group, a naphthyl group, etc.), a heterocyclic group (preferably a hetero ring of 5-membered or 6-membered ring having 1 to 4 hetero atoms of a nitrogen atom, an oxygen atom or a sulfur atom, such as a furyl group, a thienyl group, a benzothiazolyl group, etc.) and the like.

In the aforesaid $R_{37}$ and $R_{38}$, and $R_{35}$ and $R_{36}$ of the formulae [C-4] and [C-5], optional substituents may be introduced therein and such substituents may by those which may be introduced in $R_4$ and $R_5$ in the formulae [C-1] and [C-2] as mentioned above. As to the substituents, a halogen atom (a chlorine atom, a fluorine atom, etc.) is particularly preferred.

In the above formulae [C-3], [C-4] and [C-5], Z and $R_3$ each have the same meanings as in the formulae [C-1] and [C-2]. Preferred examples of the ballast group represented by $R_3$ is a group represented by the following formula [C-6]:

Formula [C - 6]

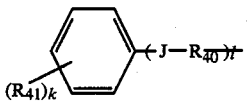

In the formula, J represents an oxygen atom, a sulfur atom or a sulfonyl group; k represents an integer of 0 to 4; l represents 0 or 1; provided that k is 2 or more, 2 or more of $R_{42}$ may be the same or different from each other; $R_{40}$ represents a straight or branched alkylene group having 1 to 20 carbon atoms which may be substituted by an aryl group, etc.; $R_{41}$ represents a monovalent group, preferably a hydrogen atom, a halogen atom (e.g., chlorine, bromine, etc.), an alkyl group, preferably a straight or branched alkyl group having 1 to 20 carbon atoms (e.g., methyl, t-butyl, t-pentyl, t-octyl, dodecyl, pentadecyl, benzyl, phenethyl, etc.), an aryl group (e.g., a phenyl group), a heterocyclic group (preferably a nitrogen containing heterocyclic group), an alkoxy group, preferably a straight or branched alkoxy group having 1 to 20 carbon atoms (e.g., methoxy, ethoxy, t-butyloxy, octyloxy, decyloxy, dodecyloxy, etc.), an aryloxy group (e.g., a phenoxy group), a hydroxy group, an acyloxy group, preferably an alkylcarbonyloxy group, an arylcarbonyloxy group (e.g., an acetoxy group, a benzoyloxy group), a carboxy group, an alkyloxycarbonyl group, preferably a stranght or branched alkyloxycarbonyl group having 1 to 20 carbon atoms, an aryloxycarbonyl group, preferably a phenoxycarbonyl group, an alkylthio group preferably having 1 to 20 carbon atoms, an acyl group, a straight or branched alkylcarbonyl group which may preferably have 1 to 20 carbon atoms, an acylamino group, a straight or branched alkylcarboamido group which may preferably have 1 to 20 carbon atoms, a benzenecarboamido group, a sulfonamido group, preferably a straight or branched alkylsulfonamido group having 1 to 20 carbon atoms or a benzenesulfonamido group, a carbamoyl group, a straight or branched alkylaminocarbonyl group which may preferably have 1 to 20 carbon atoms or a phenylaminocarbonyl group, a sulfamoyl group, a straight or branched alkylaminosulfonyl group which may preferably have 1 to 20 carbon atoms or a phenylaminosulfonyl group, and the like.

Next, representative exemplary compounds of the cyan coupler represented by the formulae [C-1] or [C-2] are shown below, but the present invention is not limited by these compounds.

[Exemplary compounds]

C-1

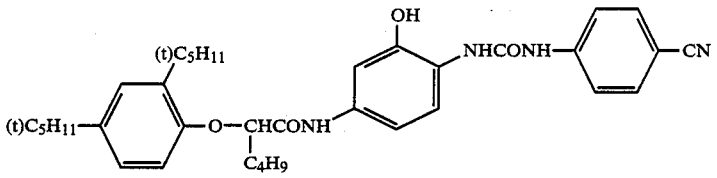

C-2

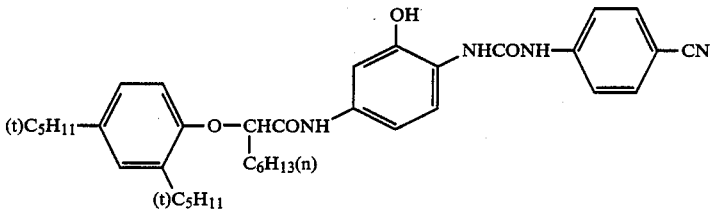

C-3

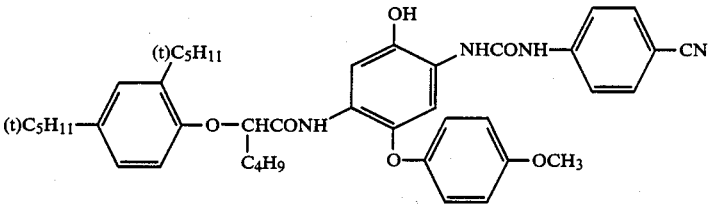

-continued
[Exemplary compounds]
C-4
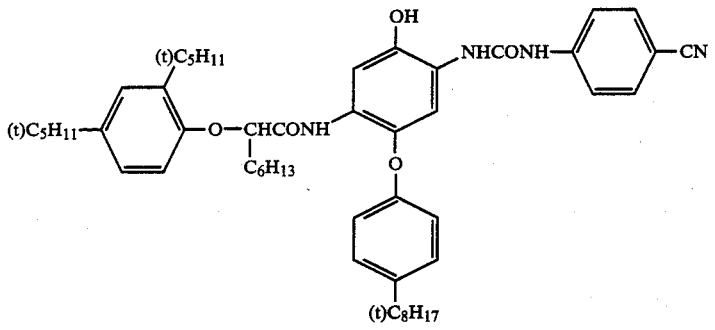
C-5
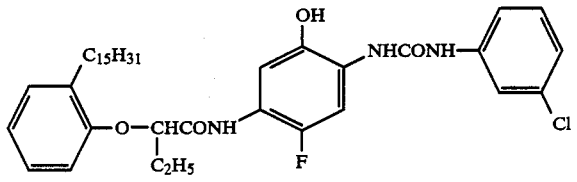
C-6
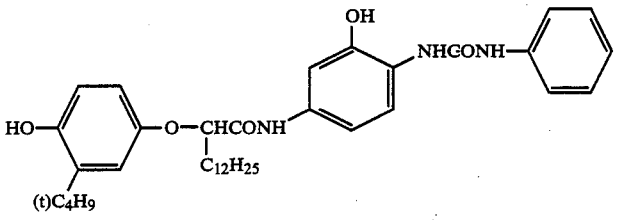
C-7
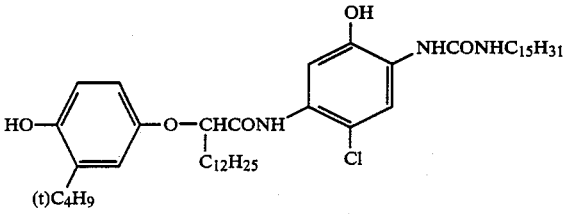
C-8
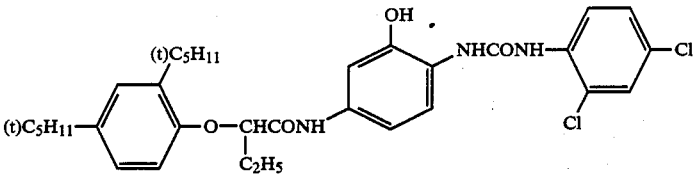
C-9
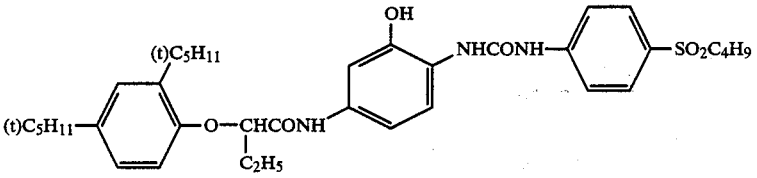
C-10
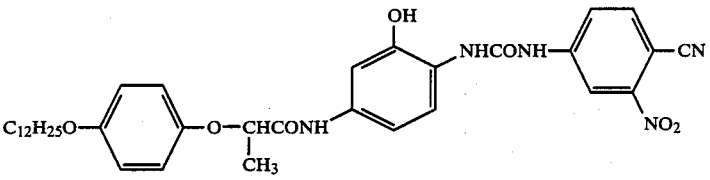

-continued
[Exemplary compounds]
C-11
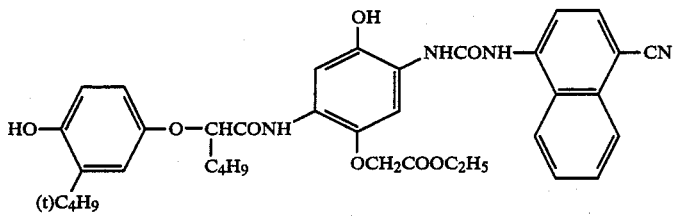
C-12
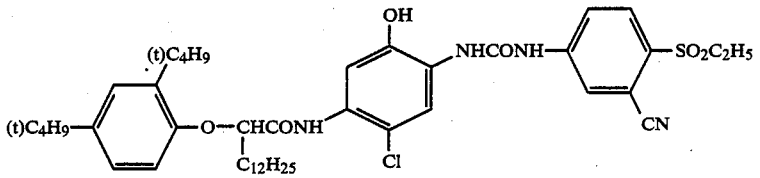
C-13
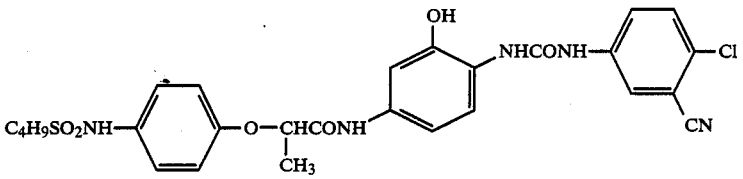
C-14
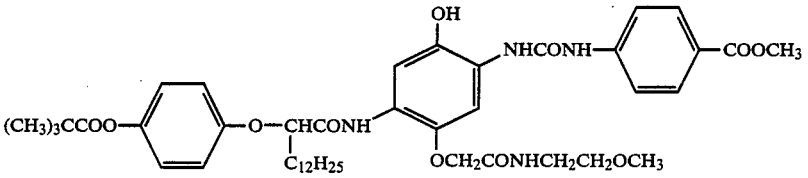
C-15
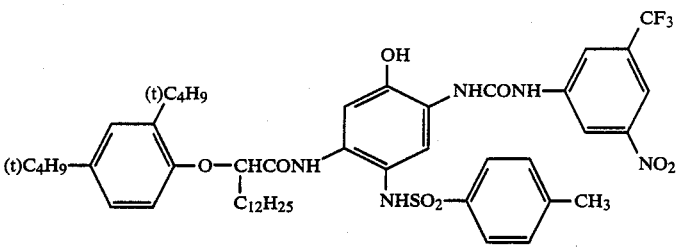
C-16
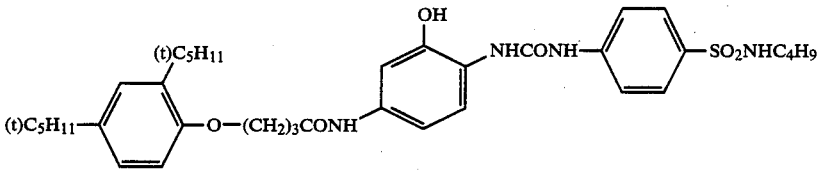
C-17
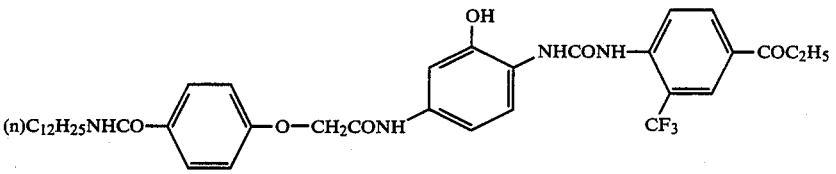

-continued
[Exemplary compounds]
C-18
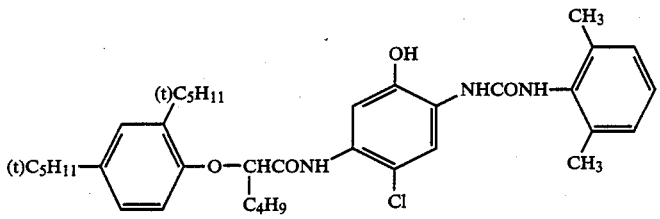
C-19
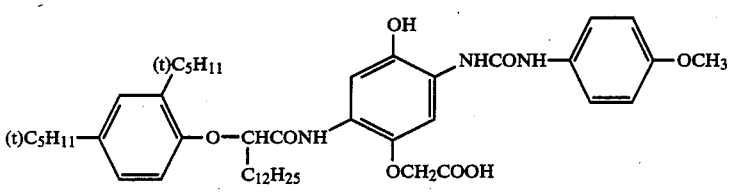
C-20
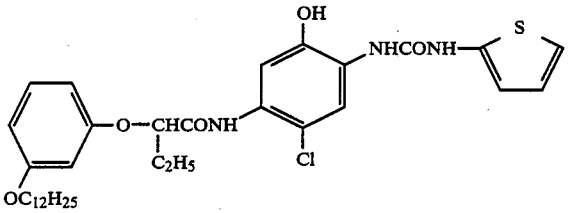
C-21
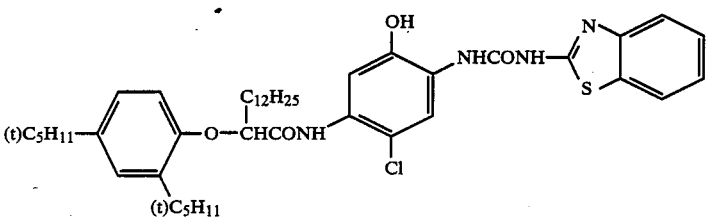
C-22
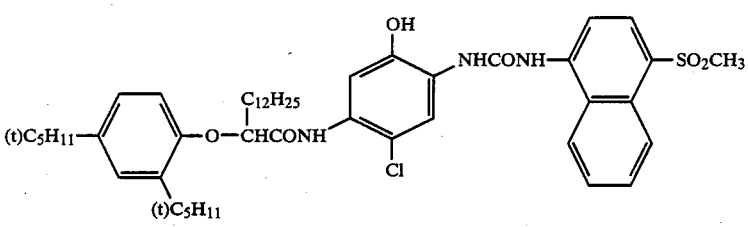
C-23
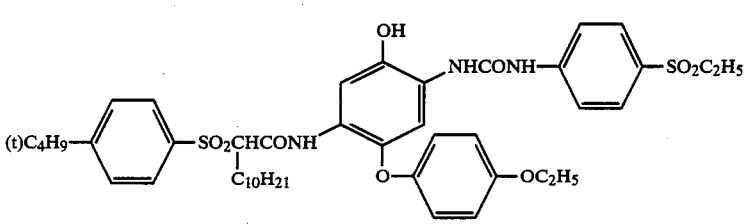
C-24
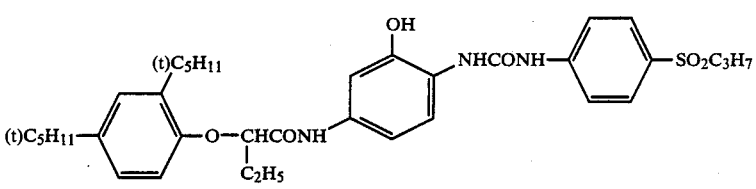

-continued
[Exemplary compounds]
C-25
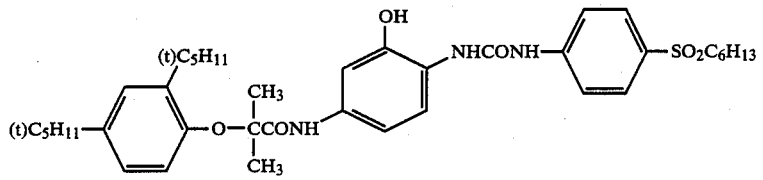
C-26
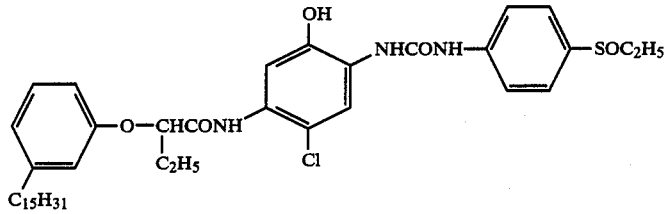
C-27
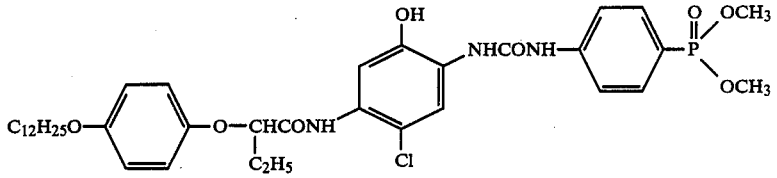
C-28
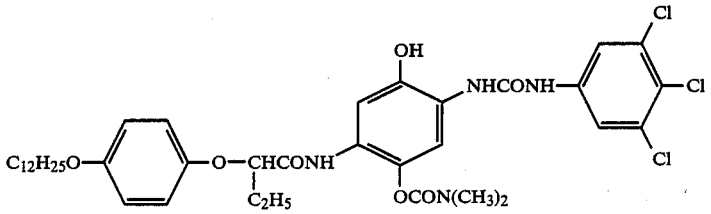
C-29
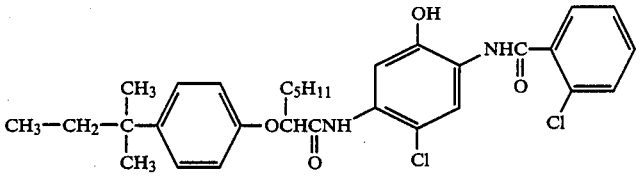
C-30
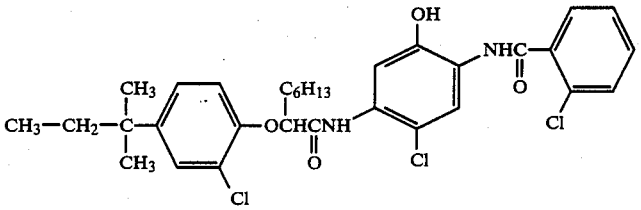
C-31
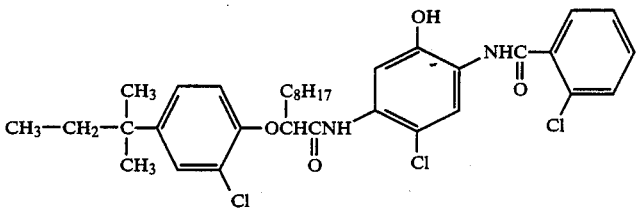

-continued
[Exemplary compounds]
C-32
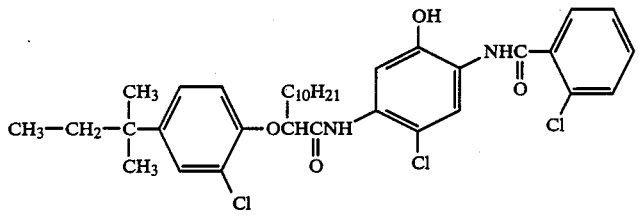
C-33
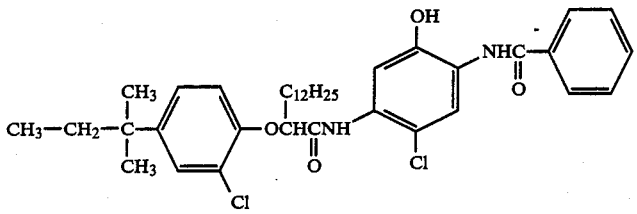
C-34
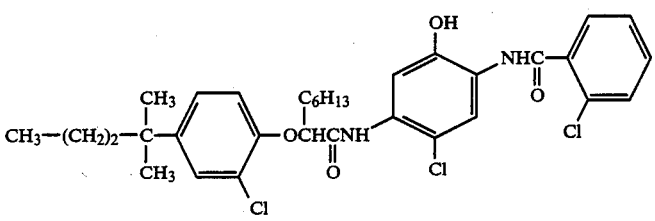
C-35
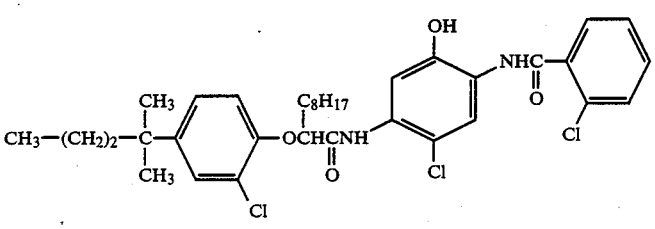
C-36
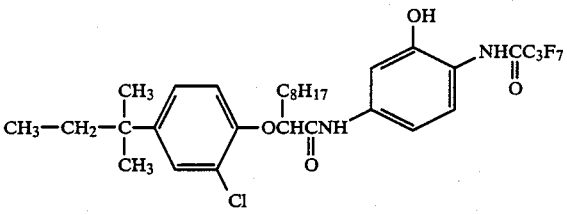
C-37
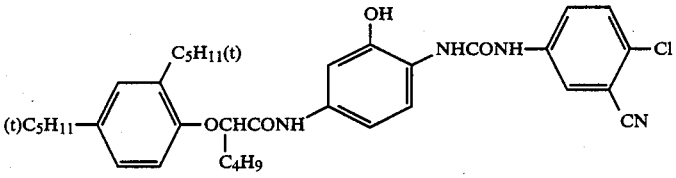
C-38
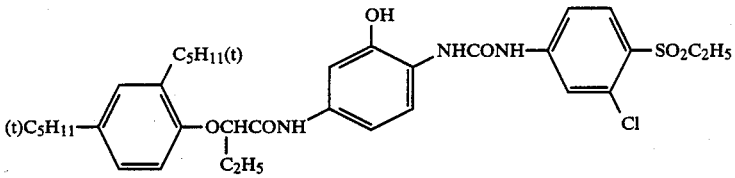

-continued
[Exemplary compounds]
C-39
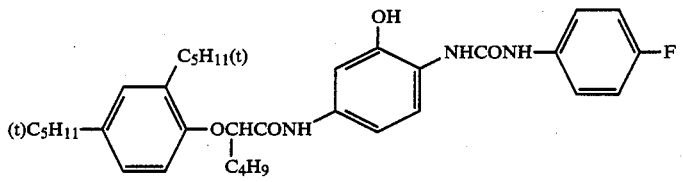
C-40
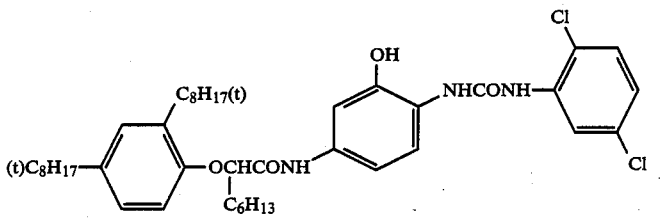
C-41
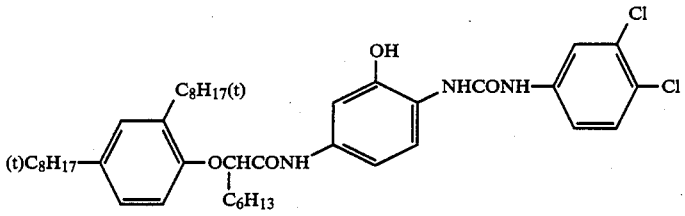
C-42
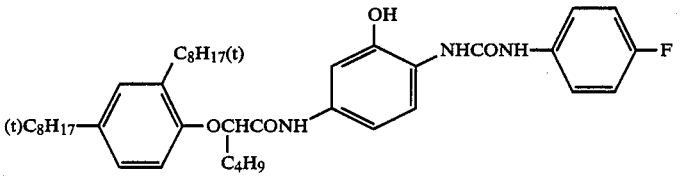
C-43
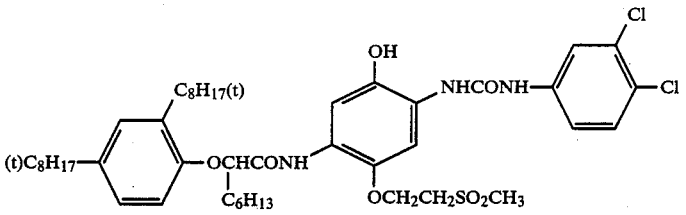
C-44
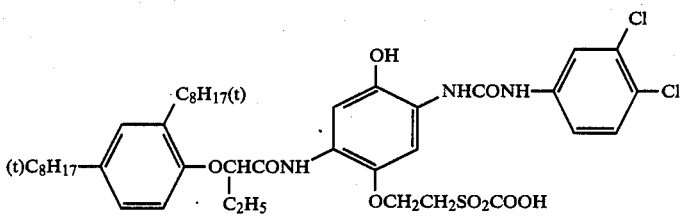
C-45
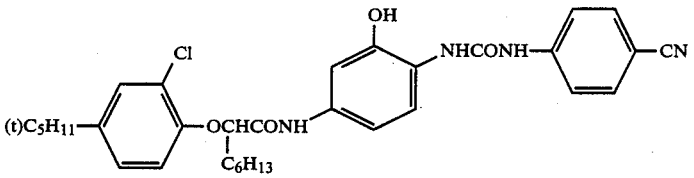

-continued
[Exemplary compounds]
C-46
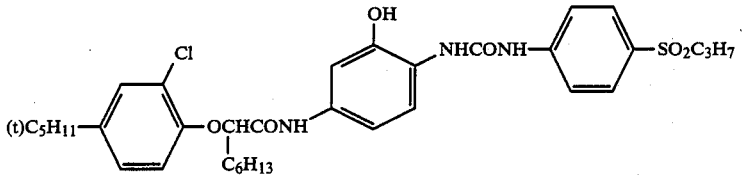
C-47
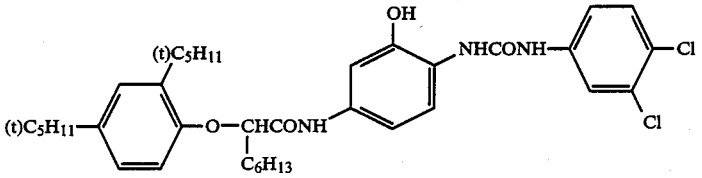
C-48
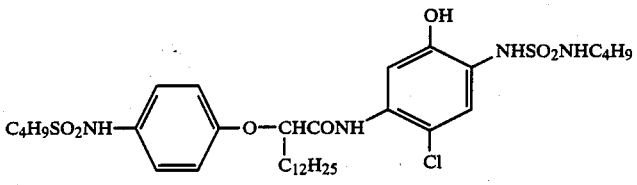
C-49
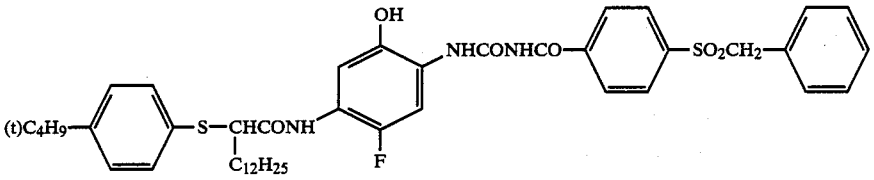
C-50
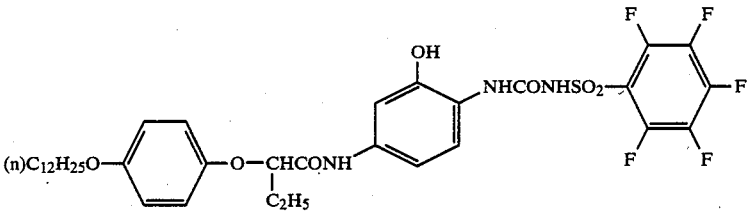
C-51
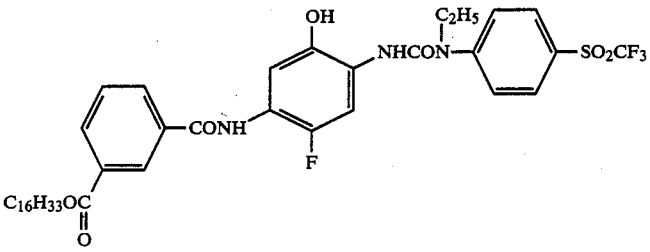
C-52
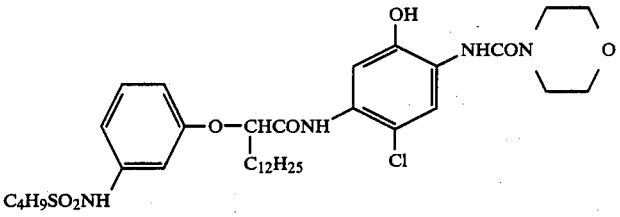

-continued
[Exemplary compounds]
C-53
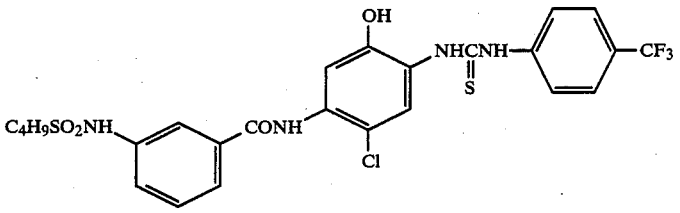
C-54
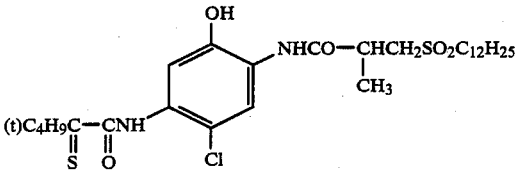
C-55
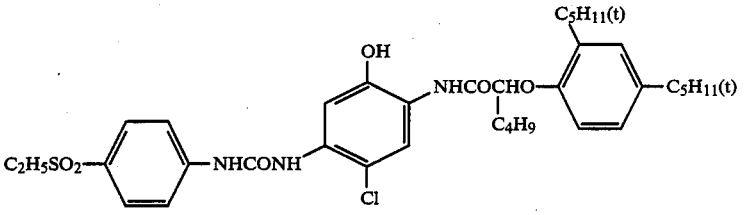
C-56
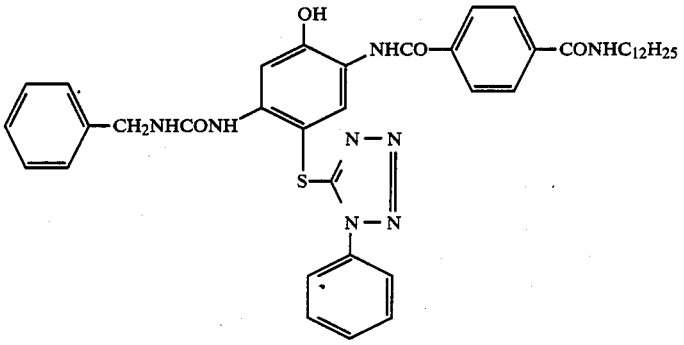
C-57
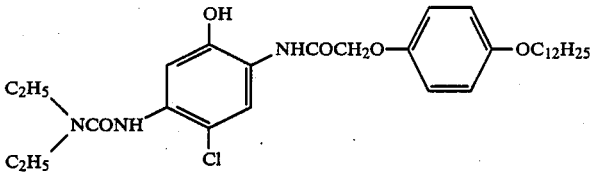
C-58
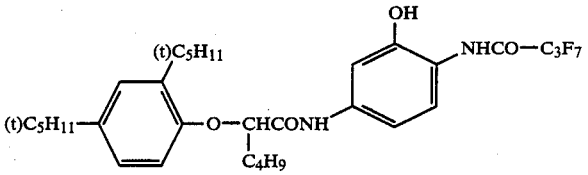
C-59
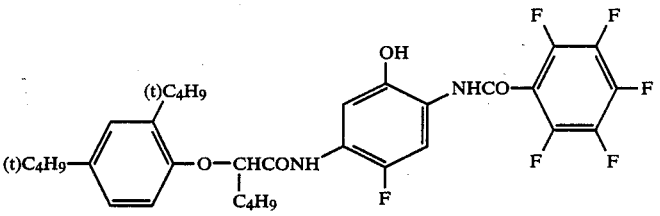

-continued
[Exemplary compounds]
C-60
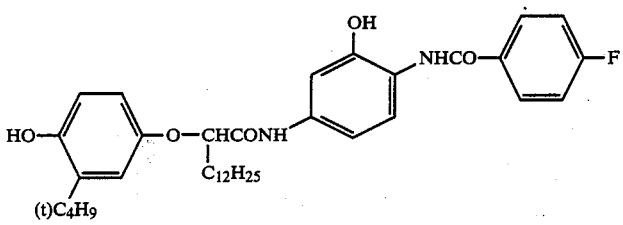
C-61
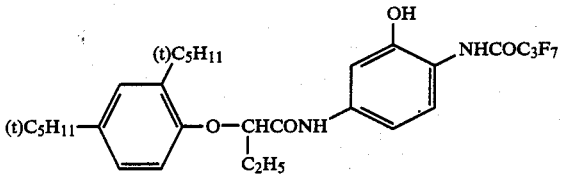
C-62
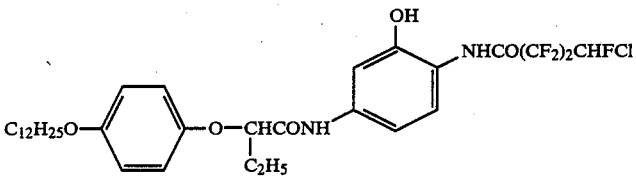
C-63
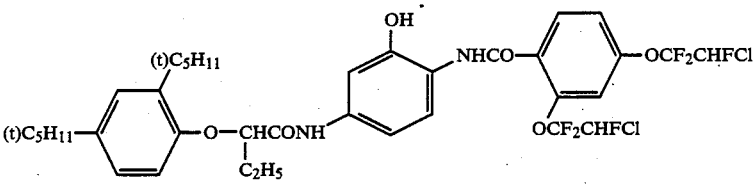
C-64
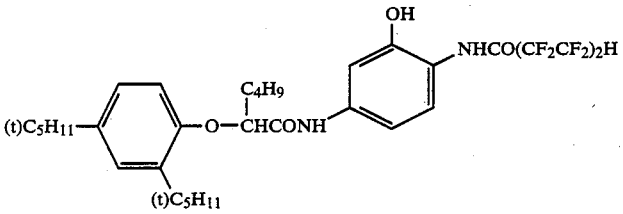
C-65
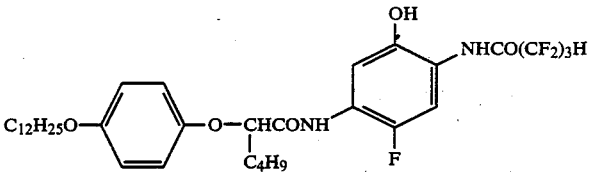
C-66
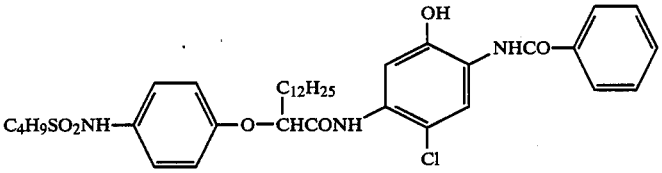
C-67
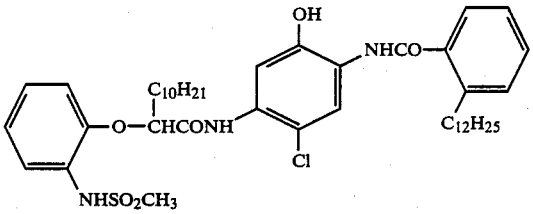

-continued
[Exemplary compounds]
C-68
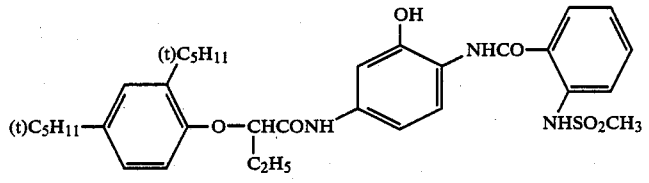
C-69
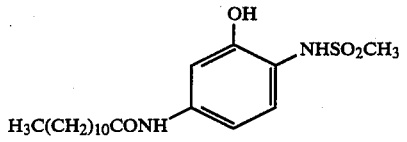
C-70
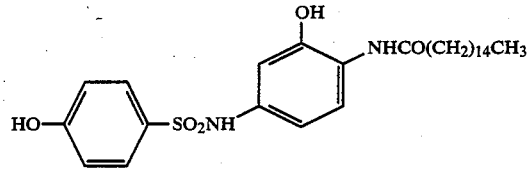
C-71
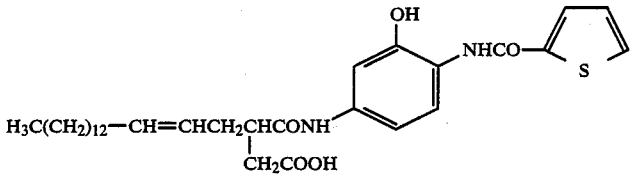
C-72
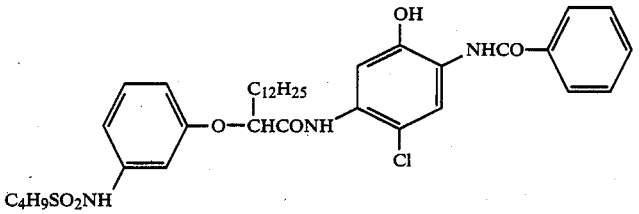
C-73
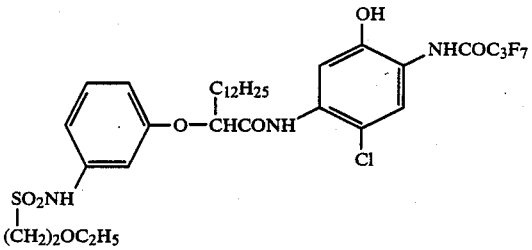
C-74
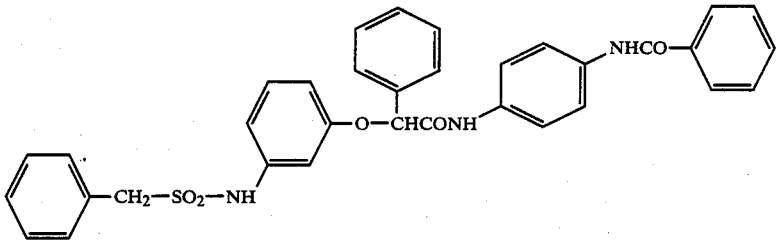

-continued
[Exemplary compounds]
C-75
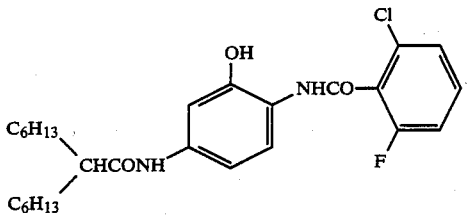
C-76
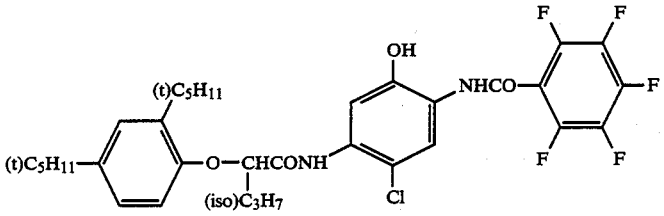
C-77
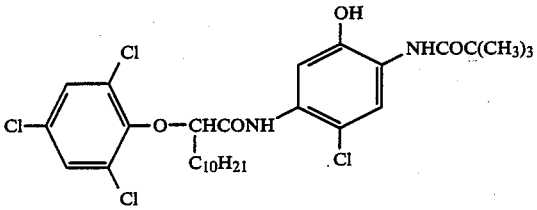
C-78
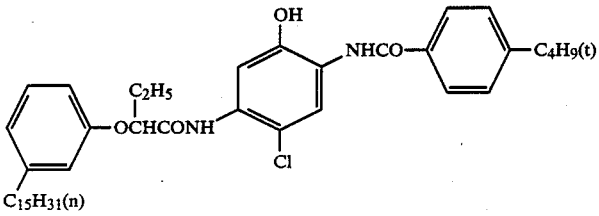
C-79
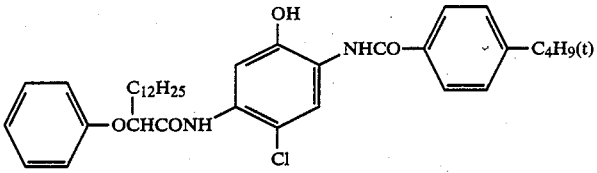
C-80
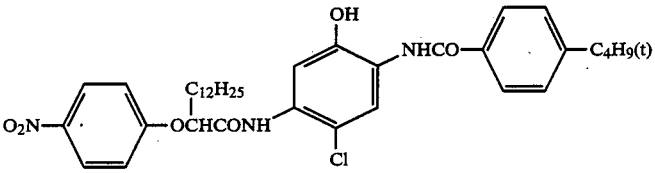
C-81
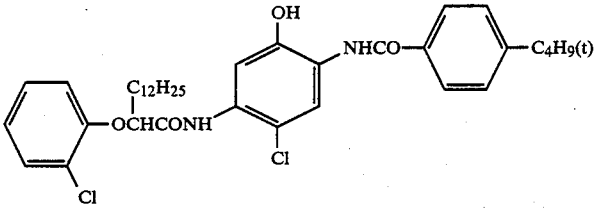

-continued
[Exemplary compounds]
C-82
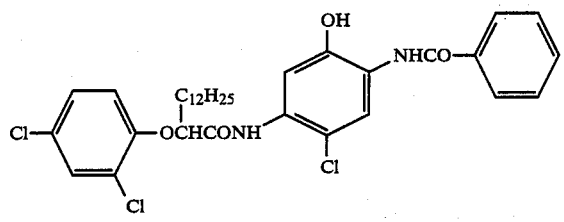
C-83
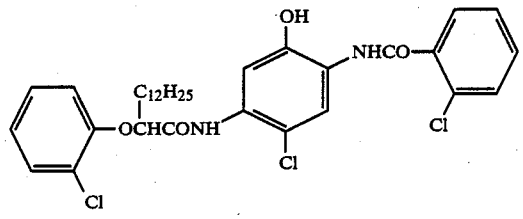
C-84
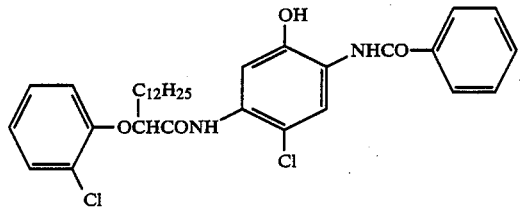
C-85
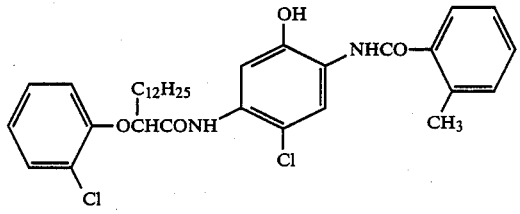
C-86
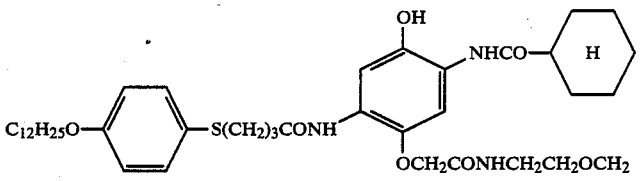
C-87
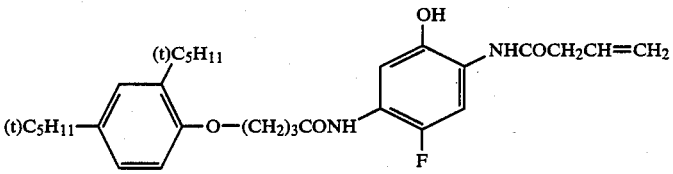
C-88
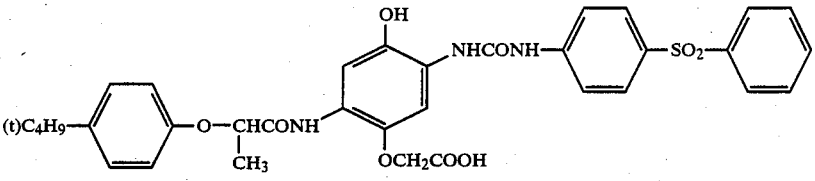

-continued
[Exemplary compounds]
C-89
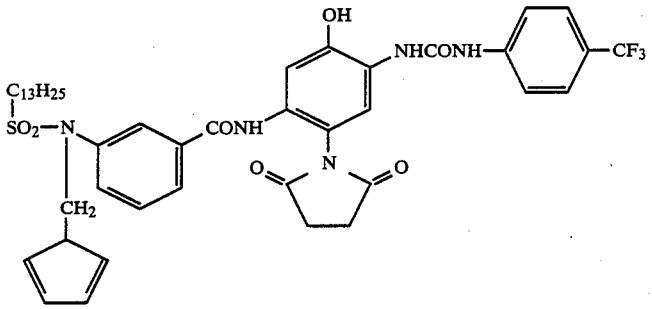
C-90
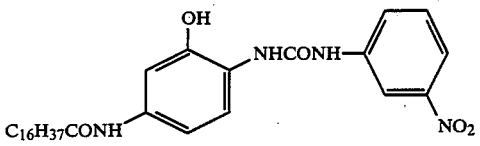
C-91
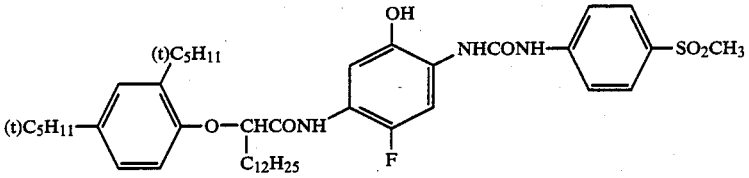
C-92
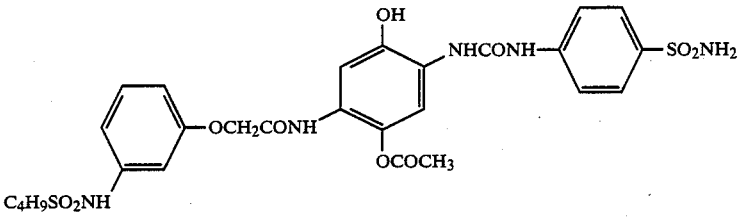
C-93
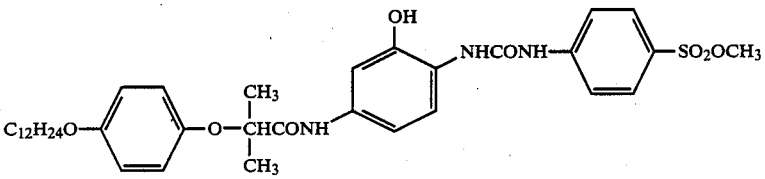
C-94
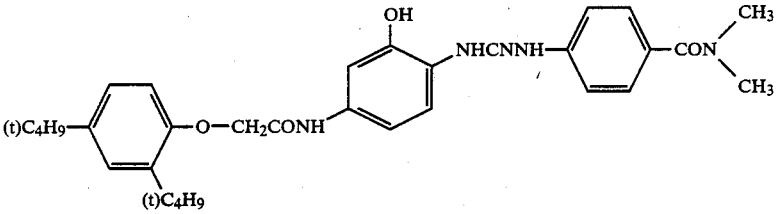

-continued

[Exemplary compounds]

C-95

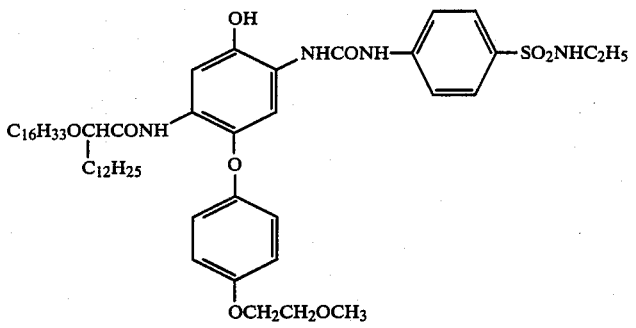

C-96

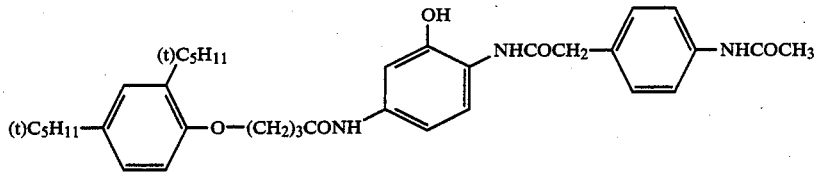

C-97

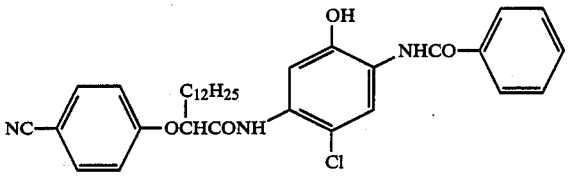

C-98

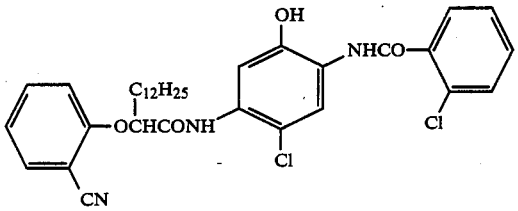

C-99

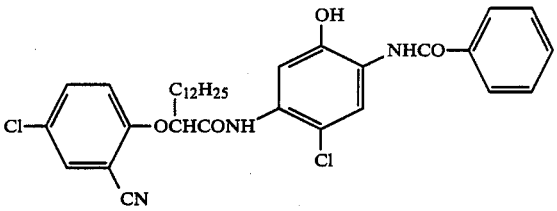

C-100

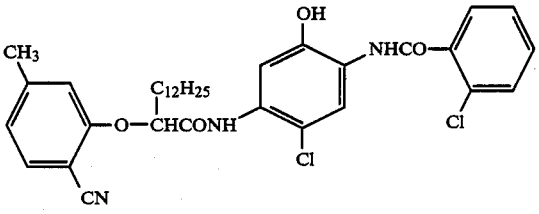

These cyan couplers represented by the formula [C-1] or [C-2] can be synthesized by the known method, and for example, they can be synthesized by the methods as disclosed in U.S. Pat. No. 2,772,162, No. 3,758,308, No. 3,880,661, No. 4,124,396 and No. 3,222,176; British Patent No. 975,773; Japanese Provisional Patent Publications No. 21139/1972, No. 112038/1975, No. 163537/1980, No. 29235/1981, No. 99341/1980, No. 116030/1981, No. 69329/1977, No. 55945/1981, No. 80045/1981 and No. 134644/1975; British Patent No. 1,011,940; U.S. Pat. No. 3,446,622 and No. 3,996,253; Japanese Provisional Patent Publications No. 65134/1981, No. 204543/1982, No. 204544/1982, No. 204545/1982, No. 33249/1983, No. 33251/1983, No. 33252/1983, No. 33250/1983, No. 33248/1983, No. 46645/1984, No. 31334/1983, No. 146050/1984, No. 166956/1984, No. 24547/1985, No. 35731/1985 and No. 37557/1985 and the like.

In the present invention, the cyan couplers represented by the formula [C-1] or [C-2] may be used in combination with the conventionally known cyan couplers so long as it does not contradict to the object of the present invention. Further, the cyan couplers represented by the formulae [C-1] and [C-2] may be used in combination therewith.

The cyan couplers represented by the formula [C-1] or [C-2] in accordance with the present invention is typically used in an amount of about 0.005 to 2 moles, preferably 0.01 to 1 mole per one mole of silver.

In the processing method of the silver halide color photographic material of the present invention, it is preferred to combinedly use the cyan coupler represented by the following formula [C] in addition to the coupler represented by the formula [C-1] or [C-2].

Formula [C]

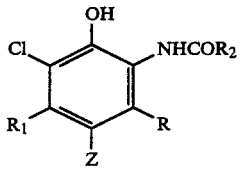

In the formula [C], one of R and $R_1$ represents a hydrogen atom and the other is a straight or branched alkyl group having at least 2 to 12 carbon atoms; X represents a hydrogen atom or a group eliminatable through the coupling reaction with a oxidized product of an aromatic primary amine series color developing agent; and $R_2$ represents a ballast group.

While the cyan color forming coupler in accordance with the present invention can be represented by the above formula [C], the formula [C] will further be explained in the following.

In the present invention, the straight or branched alkyl group having at least 2 to 12 carbon atoms represented by $R_1$ and R of the above formula [C] are, for example, an ethyl group, a propyl group, a butyl group.

In the formula [C], the ballast group represented by $R_2$ is an organic group having a size and form which affords a coupler molecule bulkiness sufficient to substantially prevent the coupler from diffusing from the layer in which it has been contained to the other layer. As the representative ballast group, there may be mentioned an alkyl group or an aryl group each having total carbon atoms of 8 to 32, preferably those having total carbon atoms of 13 to 28. As the substituent for the alkyl group and the aryl group, there may be mentioned, for example, an alkyl group, an aryl group, an alkoxy group, an aryloxy group, a carboxy group, an acyl group, an ester group, a hydroxy group, a cyano group, a nitro group, a carbamoyl group, a carbonamido group, an alkylthio group, an arylthio group, a sulfonyl group, sulfonamido group, a sulfamoyl group, a halogen atom and the like, and as the substituent for the alkyl group, those as mentioned for the above aryl group except for the alkyl group.

Preferred ones for the ballast group represented by the following formula:

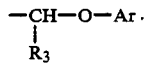

$R_3$ represents an alkyl group having 1 to 12 carbon atoms; and Ar represents an aryl group such as a phenyl group, etc., and the aryl group may have a substituent. As the substituent, an alkyl group, a hydroxy group, a halogen atom, an alkylsulfonamido group, etc. may be mentioned and the most preferred is a branched alkyl group such as a t-butyl group, etc.

The group represented by X in the above formula [C], which is capable of being released through the coupling reaction, determines not only the equivalence number of the coupler but also the reactivity thereof, as known well to one skilled in the art.

The representative examples for X includes halogen represented by chlorine and fluorine, an aryloxy group, a substituted or unsubstituted alkoxy group, an acyloxy group, a sulfonamido group, an arylthio group, a heteroylthio group, a heteroyloxy group, a sulfonyloxy group, a carbamoyloxy group and the like. As specific examples for X, there may be mentioned the groups as disclosed in Japanese Provisional Patent Publications No. 10135/1975, No. 120334/1975, No. 130414/1975, No. 48237/1979, No. 146828/1976, No. 14736/1979, No. 37425/1972, No. 123341/1975 and No. 95346/1983, Japanese Patent Publication No. 36894/1973, and U.S. Pat. No. 3,476,563, No. 3,737,316 and No. 3,227,551.

Next, exemplary compounds of the cyan coupler represented by the formula [C] which is specified $R_1$, X, $R_2$ and R, respectively, are shown below, but the present invention is not limited by these compounds.

(Exemplary compounds)

| Coupler No. | $R_1$ | X | $R_2$ | R |
|---|---|---|---|---|
| CC-1 | $-C_2H_5$ | —H | 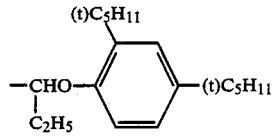 | —H |
| CC-2 | $-C_2H_5$ | —Cl | 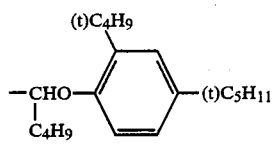 | —H |

-continued
(Exemplary compounds)
| Coupler No. | $R_1$ | X | $R_2$ | R |
|---|---|---|---|---|
| CC-3 | $-C_2H_5$ | $-H$ | 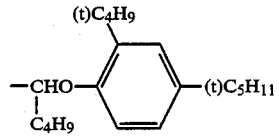 | $-H$ |
| CC-4 | $-C_2H_5$ | $-Cl$ | 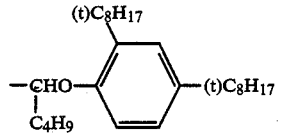 | $-H$ |
| CC-5 | $-C_2H_5$ | $-Cl$ | 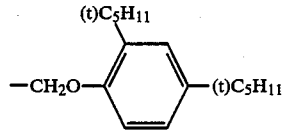 | $-H$ |
| CC-6 | $-C_2H_5$ | 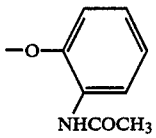 | 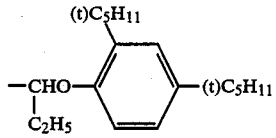 | $-H$ |
| CC-7 | 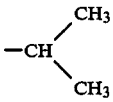 | $-Cl$ | 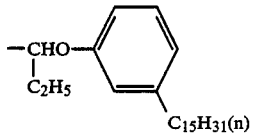 | $-H$ |
| CC-8 | $-C_2H_5$ | $-Cl$ | 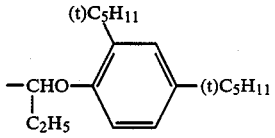 | $-H$ |
| CC-9 | $-C_2H_5$ | $-Cl$ | 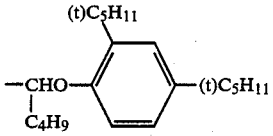 | $-H$ |
| CC-10 | $-C_4H_9$ | $-F$ | 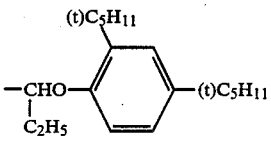 | $-H$ |
| CC-11 | $-C_2H_5$ | $-F$ | 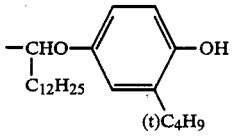 | $-H$ |
| CC-12 | $-C_2H_5$ | $-Cl$ | 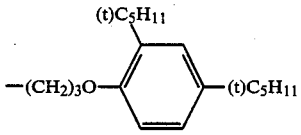 | $-H$ |

-continued
(Exemplary compounds)
| Coupler No. | $R_1$ | X | $R_2$ | R |
|---|---|---|---|---|
| CC-13 | $-C_2H_5$ | $-F$ | 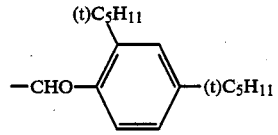 | $-H$ |
| CC-14 | $-C_4H_9$ | $-Cl$ | 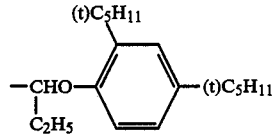 | $-H$ |
| CC-15 | $-C_2H_5$ | $-Cl$ | 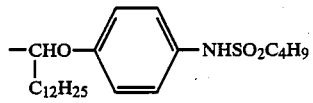 | $-H$ |
| CC-16 | $-C_2H_5$ | $-Cl$ | 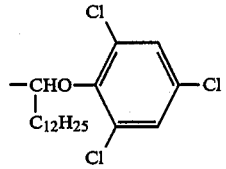 | $-H$ |
| CC-17 | 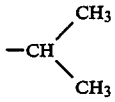 | $-Cl$ | $-C_{18}H_{37}$ | $-H$ |
| CC-18 | $-C_2H_5$ | $-F$ | 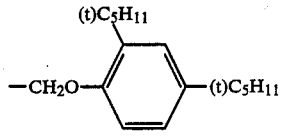 | $-H$ |
| CC-19 | $-C_2H_5$ | 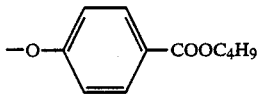 | 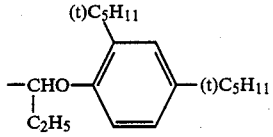 | $-H$ |
| CC-20 | $-C_2H_5$ | $-Cl$ | 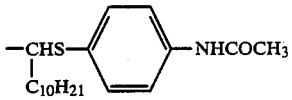 | $-H$ |
| CC-21 | $-C_3H_7$ | $-Cl$ | 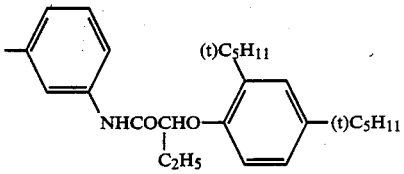 | $-H$ |
| CC-22 | $-C_3H_7$ | $-Cl$ | 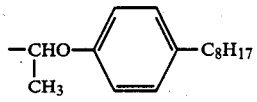 | $-H$ |
| CC-23 | $-C_2H_4NHCOCH_3$ | $-Cl$ | 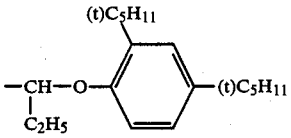 | $-H$ |

-continued (Exemplary compounds)

| Coupler No. | $R_1$ | X | $R_2$ | R |
|---|---|---|---|---|
| CC-24 | $-C_3H_6OCH_3$ | $-Cl$ | 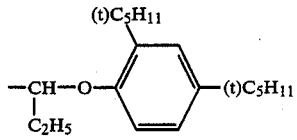 | $-H$ |
| CC-25 | $-H$ | $-Cl$ | 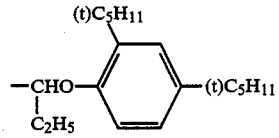 | $-C_2H_5$ |
| CC-26 | $-H$ | $-Cl$ | 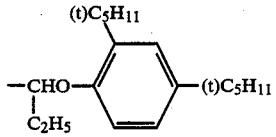 | $-C_3H_7$ |
| CC-27 | $-H$ | $-Cl$ | 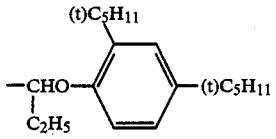 | $-C_5H_{11}$ |
| CC-28 | $-C_2H_5$ | $-Cl$ | 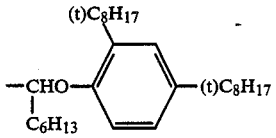 | $-H$ |

In the following, the synthesis method for obtaining exemplary compounds are shown, but the other exemplary compounds can also be synthesized similarly.

Synthesis of Exemplary compounds (1)

[(1)-a] Synthesis of 2-nitro-4,6-dichloro-5-ethylphenol

In 150 ml of glatial acetic acid were dissolved 33 g of 2-nitro-5-ethylphenol, 0.6 g of iodine and 1.5 g of ferric chloride. To the mixture was added dropwise 75 ml of sulfuryl chloride at 40° C. over 3 hours. After completion of the dropwise addition of the sulfuryl chloride, precipitates formed during the dripwise addition reacted and dissolved by heating under reflux. It took about 2 hours for the heating under reflux. Then, the reaction mixture was poured into water and the formed crystals were purified by recrystallization from methanol. Identification of (1)-a was carried out by the nuclear magnetic resonance spectrum and the elemental analysis.

[(1)-b] Synthesis of 2-amino-4,6-dichloro-5-ethylphenol

In 300 ml of alcohol was dissolved 21.2 g of the above compound [(1)-a], and to the solution was added a catalytic amount of Raney nickel and hydrogen was passed therethrough under ambient pressure until no hydrogen absorption was observed. After the reaction, the Raney nickel was removed and the alcohol was distilled out under reduced pressure. The resulting reside (1)-b was employed in the next acylation step without purification.

[(1)-c] Synthesis of 2-[(2,4-di-tert-acylphenoxy)acetamido]-4,6-dichloro-5-ethylphenol In a mixed solution comprising 500 ml of glacial acetic acid and 16.7 g of sodium acetate was dissolved a crude amino derivative obtained in [(1)-b], and to the resulting solution was added dropwise at room temperature an acetic acid solution which had dissolved 28.0 g of 2,4-di-tert-aminophenoxyacetic acid chloride in 50 ml of acetic acid. The acetic solution was added dropwise for 30 minutes, and after further stirring for 30 minutes, the reaction mixture was poured into ice-cold water. After the formed precipitates were collected by filtration and dried, recrystallized twice from acetnitrile to obtain the title compound. Identification the title compound was carried out by the elemental analysis and the nuclear magnetic resonance spectrum.

| | $C_{21}H_{35}NO_3Cl_2$ | | | |
|---|---|---|---|---|
| | C | H | N | Cl |
| Calculated (%) | 65.00 | 7.34 | 2.92 | 13.76 |
| Observed (%) | 64.91 | 7.36 | 2.99 | 14.50 |

An amount to be added of the cyan coupler of the present invention is not limitative, but preferred is $2\times10^{-3}$ to $5\times10^{-1}$ mole, more preferred is $1\times10^{-2}$ to $5\times10^{-1}$ mole per 1 mole of silver in the red-sensitive silver halide photographic material.

In the present invention, the aforesaid cyan couplers of the present invention may be used in combination with other cyan couplers, and as the cyan couplers which can be combinedly used, there may be mentioned phenol series compounds and naphthol series compounds, e.g., those as disclosed in U.S. Pat. No. 2,369,929, No. 2,434,272, No. 2,474,293, No. 2,895,826, No. 3,253,924, No. 3,034,892, No. 3,311,476, No. 3,386,301, No. 3,419,390, No. 3,458,315, No. 3,476,563, No. 3,531,383 and the like.

Synthesis methods for these compounds have also been described in these references.

As magenta couplers for photography, there may be mentioned a pyrazolone series compounds, a pyrazolotriazole series compound, a pyrazolinobenzimidazole series compound and an indazolone type compound. The pyrazolone type magenta couplers may include the compounds disclosed in U.S. Pat. No. 2,600,788, No. 3,062,653, No. 3,127,269, No. 3,311,476, No. 3,419,391, No. 3,519,429, No. 3,558,318, No. 3,684,514 and No. 3,888,680, Japanese Provisional Patent Publications No. 29639/1974, No. 111631/1974, No. 129538/1974 and No. 13041/1975, Japanese Patent Publications No. 47167/1978, No. 10491/1979 and No. 30615/1980. The pyrazolotriazole type magneta couplers may include the couplers disclosed in U.S. Pat. No. 1,247,493 and Belgian Patent No. 792,525. As non-diffusion colored magenta couplers, there may be generally used the compounds arylazo-substituted at the coupling position of a colorless magenta coupler, which may include, for example, the compounds disclosed in U.S. Pat. No. 2,801,171, No. 2,983,608, No. 3,005,712 and No. 3,684,514, British Patent No. 937,612, Japanese Provisional Patent Publications No. 123625/1974 and No. 31448/1974.

Further, there may also be used a colored magenta coupler of the type of which the dye elutes out in the processing solution by the reaction with an oxidized product of the color developing agent, as described in U.S. Pat. No. 3,419,391.

As the yellow coupler for photography, while there have conventionally been used open-chain ketomethine compounds, a benzoylaceanilide type yellow coupler and a pyvaloylacetanilide type yellow coupler, which have generally and widely been employed, may be used in the present invention. There may be advantageously be employed a two equivalent type yellow coupler in which the carbon atom at the coupling site has been substituted by a substituent which is eliminatable at the time of coupling reaction. These examples have been described, together with their synthesis methods, in U.S. Pat. No. 2,875,057, No. 3,265,506, No. 3,664,841, No. 3,408,194, No. 3,277,155, No. 3,447,728 and No. 3,415,652, Japanese Patent Publication No. 13576/1974, Japanese Provisional Patent Publications No. 29432/1973, No. 68834/1973, No. 10736/1974, No. 122335/1974, No. 28834/1975 and No. 132926/1975.

The amount of the above-mentioned non-diffusible to be used in the present invention may generally be in the range of 0.05 to 2.0 moles per one mole of silver in the light-sensitive silver halide emulsion.

The silver halide emulsion layer containing the aforesaid silver halide grains comprising at least 70 mole % silver chloride to be used in the present invention may further contain the following couplers. These colored couplers form a non-diffusible dye by reacting with an oxidized product of a color developing agent. The color coupler is advantageously combined in the light-sensitive layer or closely adjacent thereto in the non-diffusive form.

Thus, the red-light-sensitive layer can contain, for example, a non-diffusible colored coupler which forms a cyan part color image, generally a coupler of phenol or naphthol series. The green-light-sensitive layer can contain, for example, at least one of a non-diffusible colored coupler which forms a magenta part color image, generally a 5-pyrazolone series colored coupler. The blue-light-sensitive layer can contain, for example, at least one of a non-diffusible colored coupler which forms a yellow part color image, generally a colored coupler containing an open-chain ketomethylene group. The colored coupler may be 6-, 4- or 2-equivalent coupler. Suitable couplers are disclosed in the following publications of, for example, "Colored Coupler", W. Pelz in Research Report of Agfa (Mitteilungln aus den Forschungslaboratorien der Agfa), Leverkusen/München, Vol. III, p. 111 (1961); K. Venkataraman, "The Chemistry of Synthetic Dyes", Vol. 4, pp. 341 to 387, Academic Press (1971); T. H. James, "The theory of the Photographic Process, 4th Edition, pp. 353 to 362; and Reserach Disclosure, No. 17643, Section VII. According to the particularly preferred embodiment, a colored coupler which sufficiently accepts coupling reaction without benzyl alcohol which is generally added. Benzyl alcohol has usually been employed as a phase transferring agent which makes possible to form a image dye by proceeding coupling reaction between an oxidized color developing agent and a coupler with a desired speed. However, benzyl alcohol usually becomes a source of causing trouble in practical use as mentioned above, particularly becomes a source of hindrance due to formation of tar. The suitable couplers which can be used without benzyl alcohol are disclosed in German Patent Publications (OLS) No. 3,209,710, No. 2,441,779 and No. 2,640,601 and European Patent Publication (EP-A-) No. 0 067 689.

Particularly preferred yellow couplers have the structure corresponding shown below:

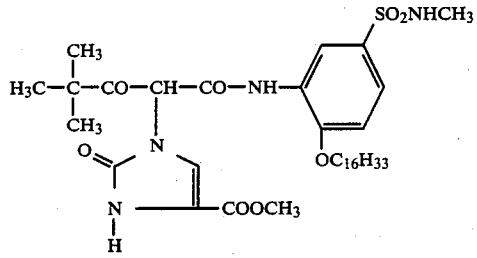

Y-1

-continued
Y-2
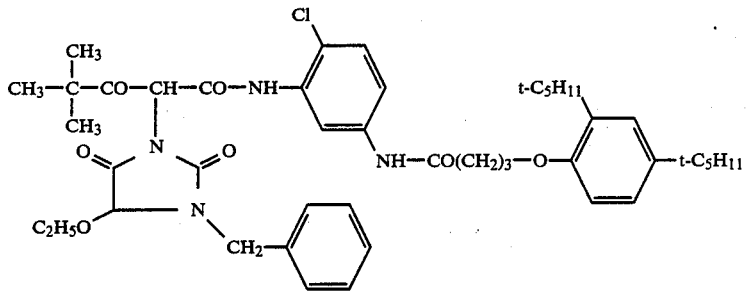
Y-3
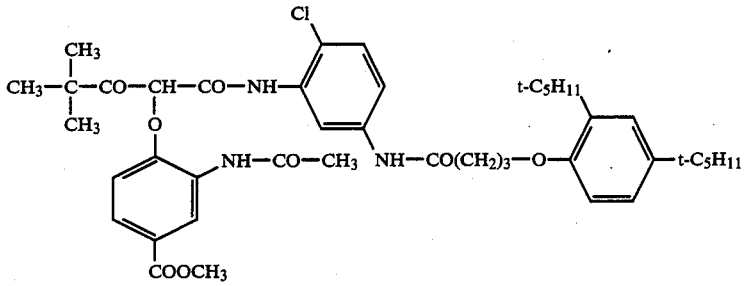
Y-4
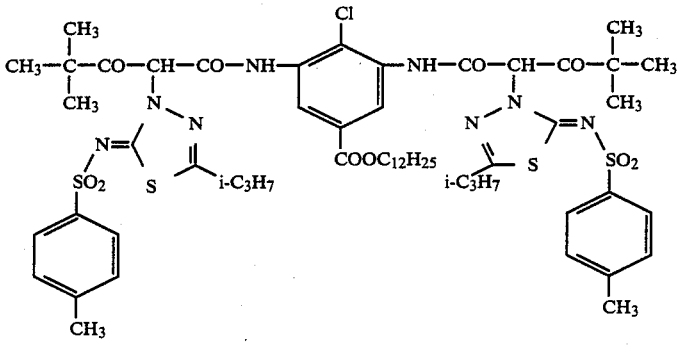
Y-5
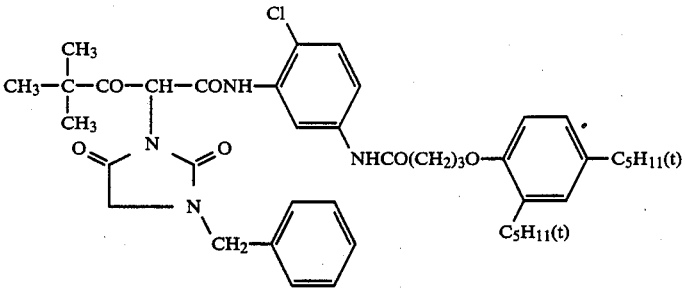
Y-6
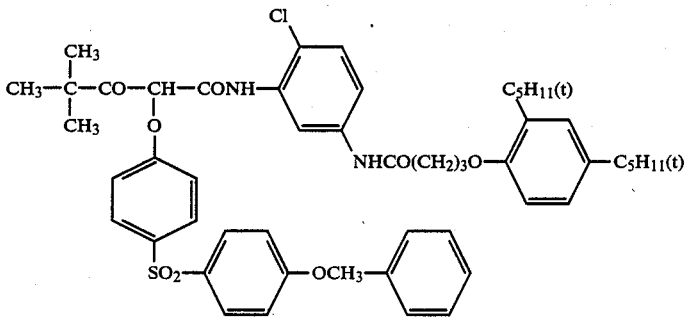
The following magenta couplers are particularly preferred.

M-1
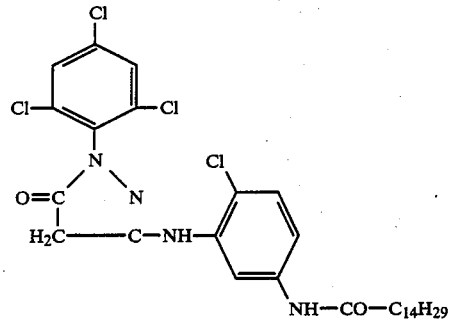
M-2
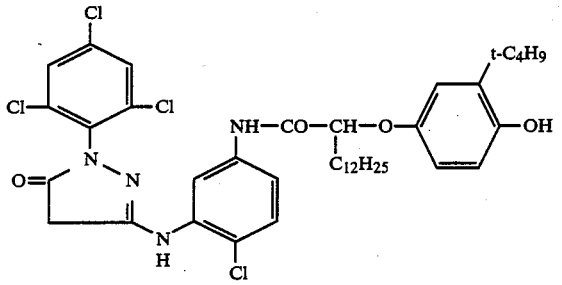
M-3
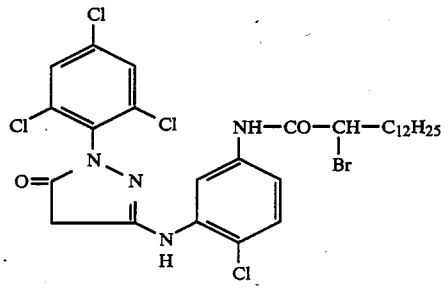
M-4
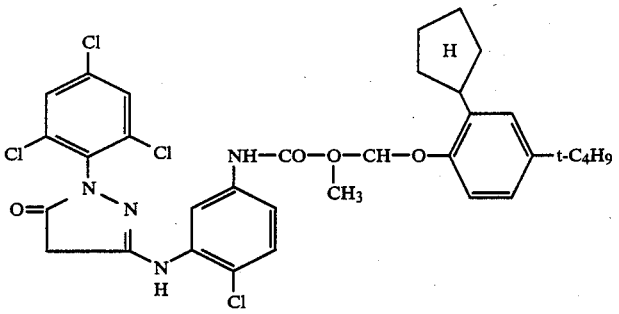
M-5
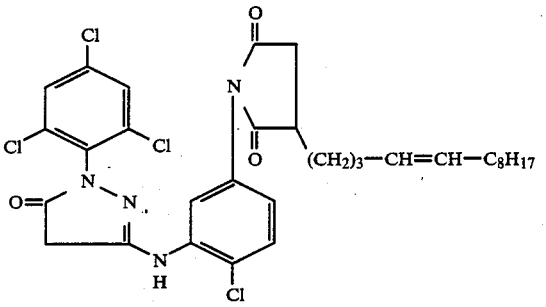

-continued

M-6

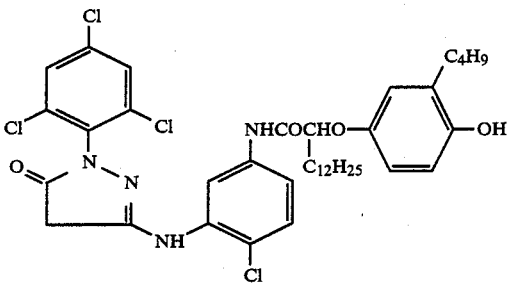

The following cyan couplers are particularly preferred.

C'-1

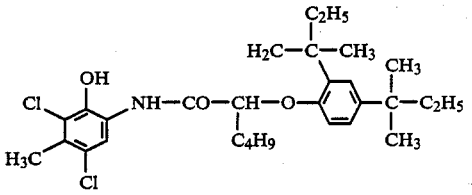

C'-2

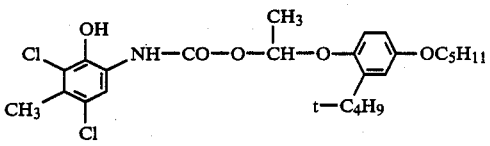

C'-3

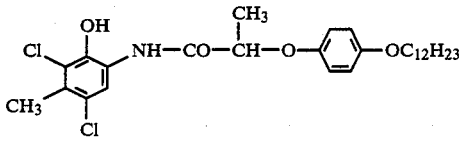

C'-4

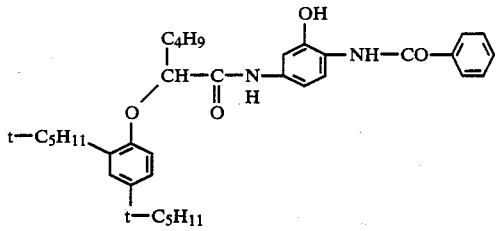

C'-5

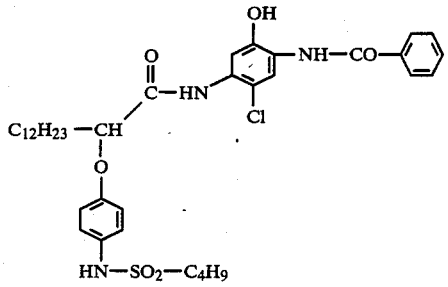

C'-6

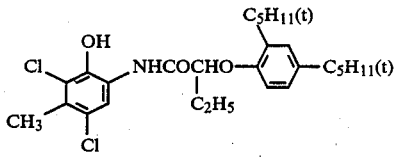

-continued

C'-7

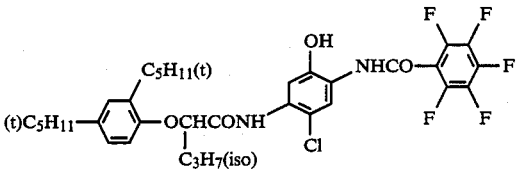

C'-8

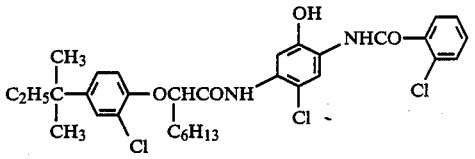

In addition to the above, particularly preferred cyan couplers are phenols having an alkyl group having at least two carbon atoms at the m-position to the OH group. Such couplers are described in German Patent Publication (OLS) No. 3,340,270.

In the present invention, besides the above-mentioned non-diffusible coupler, a DIR compound may preferably be employed.

Further, in addition to the DIR compound, there may also be used in the present invention a compound capable of releasing a development inhibitor in the course of the development, which includes those described in, for example, U.S. Pat. No. 3,297,445 and No. 3,379,529, West German Patent Publication (Offenlegungsschrift) No. 2,417,914, Japanese Provisional Patent Publications No. 15271/1977, No. 9116/1978, No. 123838/1984 and No. 127038/1984.

The DIR compound to be used in the present invention is a compound capable of releasing a development inhibitor by the reaction with an oxidized product of a color developing agent.

As a representative compound for such DIR compounds, there may be mentioned a DIR coupler having introduced, at the active site of the coupler, a group capable of forming a compound having development inhibiting effect when it is eliminated from the active site. Such compounds have been described in, for example, British Patent No. 935,454, U.S. Pat. No. 3,227,554, No. 4,095,984 and No. 4,149,886.

The above-mentioned DIR coupler has such properties that the coupler nucleus forms a dye and, on the other hand, the coupler releases a development inhibitor, at the time when the coupler has undergone coupling reaction with an oxidized product of a color developing agent.

Further, in the present invention, there may also be used a compound which releases a development inhibitor and does not form any dye when it has undergone coupling reaction with an oxidized product of a color developing agent, as described in U.S. Pat. No. 3,652,345, No. 3,928,041, No. 3,958,993, No. 3,961,959 and No. 4,052,213, Japanese Provisional Patent Publications No. 110529/1978, No. 13333/1979 and No. 161237/1980.

Furthermore, so-called DIR compound, as disclosed in Japanese Provisional Patent Publications No. 145135/1979, 114946/1981 and 154234/1982, of which the nucleus forms a dye or a colorless compound when it has reacted with an oxidized product of a color developing agent and the eliminated timing group releases a development inhibition through the intramolecular nucleophilic substitution reaction or the elimination reaction, may also be employed in the present invention.

The present invention may also include a timing DIR compound having the above-mentioned timing group connected with the coupler nucleus which forms a completely diffusible dye when it has reacted with an oxidized product of a color developing agent.

The DIR compound contained in the light-sensitive material according to the present invention may preferably be used in an amount of $1\times10^{-4}$ to $10\times10^{-1}$ mole per one mole of silver.

The light-sensitive silver halide color photographic material according to the present invention may be incorporated with other various kinds of photographic additives. For instance, there may be used, as disclosed in Research Disclosure, No. 17643, as such additives, an antifogging agent, a stabilizer, a ultraviolet absorber, an anti-staining agent, a fluorescent-brightening agent, an antifading agent, an antistatic agent, a film-hardening agent, a surface active agent, a plasticizer, a wetting agent and the like.

In the light-sensitive silver halide color photographic material used in the present invention, the hydrophilic colloid to be employed for preparing an emulsion includes gelatin, gelatin derivatives, graft polymer of gelatin with other polymers, proteins such as albumin and casein, and any synthetic hydrophilic homopolymers and copolymers such as cellulose derivatives (e.g., hydroxyethylcellulose derivatives and carboxymethylcellulose derivatives), starch derivatives, synthetic hydrophilic polymers of homo- or copolymers such as poly(vinyl alcohol), poly(vinylimidazole), polyacrylamide and the like.

As the support for the light-sensitive silver halide color photographic material to be used in the present invention, there may be mentioned, for example, a baryta paper, a polyethylene-coated paper, a polypropylene sunthetic paper, a transparent support which has a reflective layer or uses a reflective material therewith such as a glass plate, cellulose acetate, cellulose nitrate, polyester film such as polyethylene terephthalate, polyamide film, polycarbonate film, polystyrene film and the like. Other usual transparent support may also be used. These support may optionally be selected depending upon the purpose of use of the light-sensitive material according to the present invention.

For coating the silver halide emulsion layers and other photographic constituent layers to be used in the present invention, there may be employed various coating methods such as the dipping coating, the air-doctor coating, the curtain coating, the hopper coating, and the like. There may also be employed a coating method by which two or more layers may be coated simultaneously, as disclosed in U.S. Pat. Nos. 2,761,791 and 2,941,898.

In the present invention, each emulsion layer may optionally be coated at any position. For example, in the case of a light-sensitive material for a full-color photographic paper, layers may preferably be arranged, successively from the side of the support, in the order of a blue-sensitive silver halide emulsion layer, a green-sensitive silver halide emulsion layer and a red-sensitive silver halide emulsion layer. Each of the light-sensitive silver halide layers may consist of two or more layers.

In the light-sensitive material to be used in the present invention, it is optional to provide an intermediate layer having an appropriate thickness. Furhter, various layers such as a filter layer, a curl-preventing layer, a protective layer and an anti-halation layer may optionally be employed in combination. In these constituent layers, there may also be used, as a binder, such a hydrophilic colloid as can be used in the above-mentioned emulsion layers. In these constituent layers, various photographic additives as included in the above-mentioned emulsion layes may also be incorporated.

In the method for processing a light-sensitive silver halide color photographic material according to the present invention, there may be employed, as the light-sensitive silver halide color photographic material, any light-sensitive material which contains a coupler in the emulsion and can be processed by the so-called coupler in emulsion type development system, for example, a color paper, a color negative film, a color positive film, a color reversal film for slide, a color reversal film for moving picture, a color reversal film for TV, a reversal color paper and the like.

POSSIBILITY OF USE IN INDUSTRY

As described in the foregoing, the color developing solution and the processing method fo the present invention have made it possible to provide a color developing solution and a method of procesing a light-sensitive silver halide color photographic material that can achieve excellent storage stability of the color developing solution and excellent photographic performances for fog and maximum density, and is particularly feasible for rapid processing. Also, stable photographic performances can be always obtained and yet a method fo rapid processing for a silver halide color photographic material, excellent in preservability of processing solution can be provided.

CONCRETE EXAMPLES OF THE INVENTION

Next, the present invention will be explained in more detail by way of the following Examples, which however should not be construed to limit the present invention.

Example (1)

Color developing solution each having the following composition were prepared.

| (Color developing solution) | |
|---|---|
| Potassium chloride | 1.0 g |
| Potassium sulfite | 0.1 g |
| Preservative (shown in Table 1) | 2.0 g |
| Chelating agent (shown in Table 1) | 10.0 g |
| Color developing agent [Exemplary compound (A - 1)] | 5.5 g |
| Potassium carbonate | 30 g |

Made up to 1 liter by adding water, and adjusted to pH 10.15 with use of potassium hydroxide or sulfuric acid.

To each of the above color developing solutions, 4 ppm of a ferric ion, 2 ppm of a copper ion and 100 ppm of a calcium ion were added (added by dissolving $FeCl_3$, $CuSO_4.6H_2O$ and $CaCl_2$, respectively), and the solutions were stored at 40° C. in a glass container having an open top rate of 30 $cm^2/1$ (i.e., having an air-contacting area of 30 $cm^2$ per 1 liter of the color developing solution) for a week. Appearances (coloring degrees) of the color developing solutions after a week were observed to obtain the results shown in Table 1. Appearance of the solutions were evaluated by classifying into the following four stages.

| | |
|---|---|
| +++ | A large amount of tar generated |
| ++ | Black colored |
| + | Turned brown (considerably color-changed) |
| – | Little color-changed |

The results are shown in Table 1.

TABLE 1

| Developing solution No. | Preservative | Chelating agent | Appearance of solution after one week |
|---|---|---|---|
| 1 (Comparative) | None | None | +++ |
| 2 (Comparative) | None | Exemplary compound (VII - 1) | +++ |
| 3 (Comparative) | Hydroxylamine sulfate | None | ++ |
| 4 (Comparative) | Hydroxylamine sulfate | Exemplary compound (VII - 1) | + |
| 5 (Comparative) | Exemplary compound (I - 1) | None | + |
| 6 (This invention) | Exemplary compound (I - 1) | Exemplary compound (VII - 1) | – |
| 7 (This invention) | Exemplary compound (I - 1) | Exemplary compound (VII - 7) | – |
| 8 (This invention) | Exemplary compound (I - 1) | Exemplary compound (VII - 8) | – |
| 9 (This invention) | Exemplary compound (I - 2) | Exemplary compound (VII - 1) | – |
| 10 (This invention) | Exemplary compound (I - 3) | Exemplary compound (VII - 7) | – |

As will be clear from the results shown in Table 1, in the cses where sulfates of hydroxylamine are added, color change or blackening has occurred, though somewhat different in appearance depending on whether a chelating agent is present or not, to show that the preservativity is poor. On the other hand, Table 1 clearly shows that in the cases where the preservatives of the present invention were added, the preservativity has been remarkably improved by virtue of the combination with a chelating agent.

Example (2)

The following layers were provided by coating on paper supports laminated with polyethylene, successively in the order from the support side to produce samples of light-sensitive materials.

Layer 1 . . . A layer containing 1.3 g/$m^2$ of gelatin, 0.42 g/$m^2$ (in terms of silver; ditto hereinafter) of a blue-sensitive silver chlorobromide emulsion (95 mole % as AgCl) and $1.0\times10^{-3}$ mole/$m^2$ of the exemplary yellow coupler (Y-5) dissolved in 0.50 g/$m^2$ of dioctyl phthalate.

Layer 2 . . . An intermediate layer comprising 0.68 g/$m^2$ of gelatin.

Layer 3 . . . A layer containing 1.20 g/$m^2$ of gelatin, 0.25 g/$m^2$ of a green-sensitive silver chlorobromide emulsion (98 mole % as AgCl) and $1.0\times10^{-3}$ mole/$m^2$ of the following magenta coupler (M-7) dissolved in 0.28 g/$m^2$ of dioctyl phthalate.

Layer 4 . . . An intermediate layer comprising 1.1 g/$m^2$ of gelatin.

Layer 5 . . . A layer containing 1.4 g/$m^2$ of gelatin, 0.25 g/$m^2$ of a red-sensitive silver chlorobromide emulsion (99 mole % as AgCl) and $1.5\times10^{-3}$ mole/$m^2$ of the exemplary cyan coupler (C'-6) dissolved in 0.20 g/$m^2$ of dibutyl phthalate.

Layer 6 . . . A layer containing 1.0 g/$m^2$ of gelatin and 0.31 g/$m^2$ of Tinuvin 328 (an ultraviolet absorbent produced by Ciba-Geigy Corp.) dissolved in 0.20 g/$m^2$ of dioctyl phthalate.

Layer 7 . . . A layer containing 0.48 g/$m^2$ of gelatin.

As a hardening agent, 2,4-dichloro-6-hydroxy-s-triazine sodium salt was added to Layers 2, 4 and 7 each so as to be in an amount of 0.017 g per 1 g of gelatin.

M-7

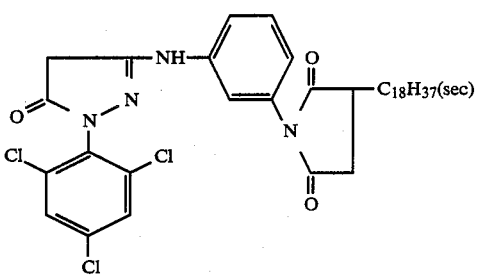

After carrying out wedgewise exposure on these samples according to a conventional method, the following developing processing was carried out.

| | Processing step | Processing temperature | Processing time |
|---|---|---|---|
| [1] | Color developing | 35° C. | 45 sec. |
| [2] | Bleach-fixing | 35° C. | 45 sec. |
| [3] | Washing | 30° C. | 90 sec. |
| [4] | Drying | 60 to 80° C. | 60 sec. |

The color developing solution used was the color developing solution having been stored by the shelf test (for 5 days) carried out in Example (1). The bleach-fixing solution used was the one having the following compositions.

| [Bleach-fixing solution] | |
|---|---|
| Ethylenediaminetetraacetic acid ferric ammonium dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

On each of the samples obtained after the developing, $D_{min}$ (minimum density of the density of the magenta dye having so speedy coupling rate as to cause a problem of fog) at non-developed portions was measured with use of Sakura Photoelectric Densitometer PDA-65 (produced by Konishiroku Photo Industry Co., Ltd).

Results obtained are shown in Table 2.

TABLE 2

| Sample No. | Developing solution No. | Preservative | Chelating agent | $D_{min}$ |
|---|---|---|---|---|
| 1 | 1 | None | None | 0.49 |
| 2 | 2 | None | Examplary compound (VII - 1) | 0.44 |
| 3 | 3 | Hydroxylamine sulfate | None | 0.35 |
| 4 | 4 | Hydroxylamine sulfate | Exemplary compound (VII - 1) | 0.13 |
| 5 | 5 | Exemplary compound (I - 1) | None | 0.15 |
| 6 | 6 | Exemplary compound (I - 1) | Exemplary compound (VII - 1) | 0.02 |
| 7 | 7 | Exemplary compound (I - 1) | Exemplary compound (VII - 7) | 0.02 |
| 8 | 8 | Exemplary compound (I - 1) | Exemplary compound (VII - 8) | 0.02 |
| 9 | 9 | Exemplary compound (I - 2) | Exemplary compound (VII - 1) | 0.02 |
| 10 | 10 | Exemplary compound (I - 3) | Exemplary compound (VII - 7) | 0.02 |

As will be clear from the results shown in Table 2, when the sulfate of hydroxylamine having been conventionally used is used, the minimum density of magenta becomes so high as to bring about problems in practical use. On the other hand, when the preservative of the present invention is used, the minimum density is still higher (but lower than the case where sulfate of hydroxylamine is used), but, using it in combination with the chelating agent of the present invention, the minimum density can be made lower even when contaminated with a heavy metal ion and stored, to exhibit remarkable effects.

In Samples No. 6, No. 7 and No. 8, similar effects were obtained also when preservatives other than those of the present invention, Exemplary Compounds No. (I-4), (I-5) and (I-6), were used. Similar effects were also obtained when the chelating agents of the present invention, (VII-2) to (VII-6) and (VII-9) were used in combination.

Also, by adding 0.5 g/l of the chelating agent (V-2) of the present invention to the developing solutions No. 6 to No. 10, when the same processings were carried out, the minimum densities of the magenta couplers were all 0.01.

Example (3)

Using the light-sensitive color photographic materials produced in Example (2), the following processings were carried out to evaluate silver-developing properties on the color developing solutions No. 2, No. 4 and No. 6 (no color developing agent).

| Standard processing steps (Processing temperature and processing time) | | |
|---|---|---|
| [1] Color developing | 35° C. | 45 sec. |
| [2] Fixing | 35° C. | 45 sec. |
| [3] Washing processing | 30° C. | 90 sec. |
| [4] Drying | 60 to 80° C. | 60 sec. |
| (Fixing solution) | | |
| Ammonium thiosulfate (70% solution) | | 150.0 ml |
| Ammonium sulfite (40% solution) | | 20 ml |

Made up to 1 liter in total by adding water, and adjusted to pH 7.00 with use of ammonium hydroxide or acetic acid.

After developing processing, using PDA-65 (produced by Konishiroku Photo Industry Co., Ltd.), spectral reflection density was measured on the samples by orange light to evaluate $D_{max}$ of the samples. Difference between the spectral reflection density for $D_{max}$ and the spectral reflection density for $D_{min}$ was assumed as a typical characteristics of silver density.

Results are shown in Table 3.

TABLE 3

| Sample No. | Developing solution No. | silver developability |
|---|---|---|
| 11 | 2 | 0.00 |
| 12 | 4 | 0.45 |
| 13 | 6 | 0.03 |

As will be clear from Table 3, Sample No. 12 using hydroxylamine shows a so severe silver developability that the lowering of a color efficiency can be forecasted, but Sample No. 13 according to the present invention shows little silver developability to obtain good results.

Example (4)

In the developing solutions No. 2, No. 4 and No. 6 used in Example (2), the amount of sulfite added was varied as shown in Table 4 to make the same evaluations as in Example (2). In Table 4, the cyan density is set forth.

TABLE 4

| Sample No. | Developing solution No. | Sulfite (mole/l) | Cyan density (maximum reflective density) |
|---|---|---|---|
| 14 | No. 2 | $4 \times 10^{-3}$ | 2.61 |
| 15 | No. 4 | $4 \times 10^{-3}$ | 2.31 |
| 16 | No. 6 | $3.2 \times 10^{-2}$ | 2.15 |
| 17 | No. 6 | $8 \times 10^{-3}$ | 2.32 |
| 18 | No. 6 | $4 \times 10^{-3}$ | 2.57 |
| 19 | No. 6 | $1 \times 10^{-4}$ | 2.60 |

As will be clear from Table 4, the addition of sulfite causes decrease in cyan density at the uppermost layer where the decrease in density due to sulfite is liable to occur. In particular, the decrease in density began to remarkably occur when it is present in excess of $8 \times 10^{-3}$ mole/l of color developing solution.

Example (5)

Silver halides of the color light-sensitive materials produced in Example (2) were composed as shown in Table 5 to measure the maximum color density (reflection density) of yellow, magenta and cyan.

Here, as a developing solution, No. 6, the developing solution of the present invention, was used to carry out the processing.

TABLE 5

| Sample No. | Silver halide composition | | Maximum color density (reflective density) | | |
|---|---|---|---|---|---|
| | AgBr (mole %) | AgCl (mole %) | Yellow density | Magenta density | Cyan density |
| 20 | 100 | — | 1.69 | 1.86 | 1.39 |
| 21 | 70 | 25 | 1.75 | 2.02 | 1.54 |
| 22 | 50 | 50 | 1.96 | 2.15 | 1.76 |
| 23 | 30 | 70 | 2.16 | 2.32 | 2.19 |
| 24 | 20 | 80 | 2.39 | 2.59 | 2.47 |
| 25 | 10 | 90 | 2.46 | 2.66 | 2.54 |
| 26 | 5 | 95 | 2.53 | 2.69 | 2.58 |
| 27 | 0 | 100 | 2.55 | 2.70 | 2.60 |

As will be clear from Table 5, a remarkable decerease in density is found in the case of 70 mole % or less of AgCl even when the color developing solution is used, but, in contrast thereto, the maximum color density is high and excellent in the case of the light-sensitive silver halide color photographic material having the silver halide emulsion layer containing silver halide grains substantially comprised of silver chlorobromide. In particular, there was obtained sufficient maximum color density in the case of 95 mole % or more of AgCl.

Example (6)

Color developing solutions each having the following composition were prepared.

| (Color developing solution) | |
|---|---|
| Potassium chloride | 1.0 g |
| Potassium sulfite | 0.2 g |
| Preservative (shown in Table 6) | 10 g |
| Chelating agent (shown in Table 6) | 10 g |
| Color developing agent (Exemplary compound A - 1) | 5.5 g |
| Potassium carbonate | 30 g |

Made up to 1 liter by adding water, and adjusted to pH 10.15 with use of potassium hydroxide or sulfuric acid.

To each of the above color developing solutions, 4 ppm of a ferric ion, 2 ppm of a copper ion and 100 ppm of a calcium ion were added (added by dissolving $FeCl_3$, $CuSO_4.6H_2O$ and $CaCl_2$, respectively), and the solutions were stored at 40° C. in a glass container having an open top rate of 30 $cm^2/l$ (i.e., having an air-contacting area of 30 $cm^2$ per 1 liter of the color developing solution) for two weeks.

Appearances (coloring degrees) of the color developing solutions after a week were observed in the same manner as in Example (2).

The results are shown in Table 6.

TABLE 6

| Developing solution No. | Preservative | Chelating agent | Appearance of solution after two weeks |
|---|---|---|---|
| 11 (Comparative) | None | None | +++ |
| 12 (Comparative) | None | Exemplary compound (VII - 1) | +++ |
| 13 (Comparative) | Hydroxylamine sulfate | None | ++ |
| 14 (Comparative) | Hydroxylamine sulfate | Exemplary compound (VII - 1) | + |
| 15 (Comparative) | Exemplary compound (I - 1) | None | + |
| 16 (This invention) | Exemplary compound (I - 1) | Exemplary compound (VII - 1 | – |
| 17 (This invention) | Exemplary compound (I - 1) | Exemplary compound (VII - 7 | – |
| 18 (This invention) | Exemplary compound (I - 1) | Exemplary compound (VII - 8) | – |
| 19 (This invention) | Exemplary compound (I - 2) | Exemplary compound (VII - 1) | – |
| 20 (This invention) | Exemplary compound (I - 3) | Exemplary compound (VII - 1) | – |

As will be clear from the results shown in Table 6, in the cses where sulfates of hydroxylamine are added, color change or blackening has occurred, though somewhat different in appearance depending on whether a chelating agent is present or not, to show that the preservativity is poor. On the other hand, Table 6 clearly shows that in the cases where the preservatives of the present invention were added, the preservativity has been remarkably improved by virtue of the combination with a chelating agent.

Example (7)

The following layers were provided by coating on paper supports laminated with polyethylene, successively in the order from the support side to produce samples of light-sensitive materials.

Layer 1 . . . A layer containing 1.0 $g/m^2$ of gelatin, 0.40 $g/m^2$ (in terms of silver; ditto hereinaftr) of a blue-sensitive silver chlorobromide emulsion and $1.0\times10^{-3}$ mole/$m^2$ of the exemplary yellow coupler (Y-5) dissolved in 0.50 $g/m^2$ of dioctyl phthalate.

Layer 2 . . . An intermediate layer comprising 0.65 $g/m^2$ of gelatin.

Layer 3 . . . A layer containing 1.20 $g/m^2$ of gelatin, 0.24 $g/m^2$ of a green-sensitive silver chlorobromide emulsion and $1.0\times10^{-3}$ mole/$m^2$ of the above magenta coupler (M-7) dissolved in 0.27 $g/m^2$ of dioctyl phthalate.

Layer 4 . . . An intermediate layer comprising 1.0 $g/m^2$ of gelatin.

Layer 5 . . . A layer containing 1.4 $g/m^2$ of gelatin, 0.30 $g/m^2$ of a red-sensitive silver chlorobromide emulsion and $1.75\times10^{-3}$ mole/$m^2$ of the cyan coupler (C-76) dissolved in 0.30 $g/m^2$ of dibutyl phthalate.

Layer 6 . . . A layer containing 1.2 $g/m^2$ of gelatin and 0.30 $g/m^2$ of Tinuvin 328 (an ultraviolet absorbent produced by Ciba-Geigy Corp.) dissolved in 0.20 $g/m^2$ of dioctyl phthalate.

Layer 7 . . . A layer containing 0.45 $g/m^2$ of gelatin.

As a hardening agent, 2,4-dichloro-6-hydroxy-s-triazine sodium salt was added to Layers 2, 4 and 7 each so as to be in an amount of 0.017 g per 1 g of gelatin.

The silver halide composition in each of the silver halide emulsions is shown in Table 7.

After carrying out wedgewise exposure on these samples according to a conventional method, the following developing was carried out.

| Processing step | Processing temperature | Processing time |
|---|---|---|
| [1] Color developing | 35° C. | |
| [2] Bleach-fixing | 35° C. | 45 sec. |
| [3] Washing | 30° C. | 90 sec. |
| [4] Drying | 60 to 80° C. | 60 sec. |

The compositions of the processing solutions to be used are as follows:

| (Color developing solution) | |
|---|---|
| Potassium chloride | 1.0 g |
| Potassium sulfite | 2.5 g ($2\times10^{-3}$ mole) |
| Preservative (Exemplary compound (I - 1)) | 15 g |
| Chelating agent (Exemplary compound (VII - 1) | 1.0 g |
| Color developing agent (Exemplary compound A - 1) | 5.5 g |
| Potassium carbonate | 30 g |

Made up to 1 liter by adding water, and adjusted to pH 10.15 with use of potassium hydroxide or sulfuric acid.

The bleach-fixing solution has the same composition as that used in Example (2).

Maximum reflective densities of the yellow dyes when developed at 35° C. for 10 min. were measured with use of Photoelectric Densitometer PDA-65 (produced by Konishiroku Photo Industry Co., Ltd.), and the maximum reflective density of the yellow dye is made 100 and developing times (development converging time) necessary for reaching the maximum reflective density of the yellow dye become 80 are shown in Table 7. The results show development completion time of the light-sensitive material used since they show development converging times of blue-sensitive emulsion layers which are the slowest in developing rate.

TABLE 7

| Sample No. | Silver halide composition AgBr:AgCl (molar ratio) Blue-sensitive layer | Green-sensitive layer | Red-sensitive layer | Development converging time (sec) |
|---|---|---|---|---|
| 28 | 25:75 | 25:75 | 25:75 | 135 |
| 29 | 22:78 | 22:78 | 22:78 | 128 |
| 30 | 20:80 | 20:80 | 20:80 | 96 |
| 31 | 15:85 | 15:85 | 15:85 | 78 |
| 32 | 10:90 | 10:90 | 10:90 | 65 |
| 33 | 5:95 | 5:95 | 5:95 | 48 |
| 34 | 5:95 | 2:98 | 2:98 | 45 |
| 35 | 2:98 | 2:98 | 2:98 | 43 |
| 36 | 2:98 | 100 | 100 | 41 |
| 37 | 100 | 100 | 100 | 38 |

As clearly seen from Table 7, in samples Nos. 30 to 37 having silver chloride contents of 80% or more, it can be seen that the converging times are short and rapid processing is possible. Particularly, in samples Nos. 32 to 37 having silver chloride contents of 90% or more, especially in samples Nos. 33 to 37 having silver chloride contents of 95% or more, it can be understood that rapid processing is possible.

Example (8)

By using color paper samples used in Example (7), following the processing steps of Example (7) and using the processing solutions used in Example (7), the same processings were repeated. Provided that the silver halide composition of the color paper samples were made AgBr:AgCl being 2:98 in blue-sensitive emulsion layer, 5:95 in green-sensitive emulsion layer and 3:97 in red-sensitive emulsion layer, and the cyan couplers were those as shown in Table 8. Also, the color developing time was made 45 seconds, the concentration of potassium sulfite in the color developing solution was as shown in Table 8 and the chelating agents were used as shown in Table 8 with an amount of 1.0 g/liter, respectively. Also, the color developing solution was used that dissolving 4 ppm of a ferric ion, 2 ppm of a copper ion and 100 ppm of a calcium ion (added by dissolving $FeCl_3$, $CuSO_4.6H_2O$ and $CaCl_2$, respectively, and stored at the same conditions as in Example (6) for 5 days. Maximum color densities and minimum color densities of the cyan dyes after processing were measured and shown in Table 8.

TABLE 8

| Sample No. | Cyan coupler | Potassium sulfite | Chelating agent | Cyan density (reflective density) Maximum density | Minimum density |
|---|---|---|---|---|---|
| 38 | Comparative 1 | $8.0 \times 10^{-3}$ | None | 0.15 | 2.24 |
| 39 | Comparative 1 | $8.0 \times 10^{-3}$ | Exemplary compound (VII - 1) | 0.07 | 2.30 |
| 40 | Comparative 2 | $8.0 \times 10^{-3}$ | None | 0.14 | 2.24 |
| 41 | Comparative 2 | $8.0 \times 10^{-3}$ | Exemplary compound (VII - 1) | 0.06 | 2.27 |
| 42 | Exemplary coupler C - 76 | $8.0 \times 10^{-3}$ | None | 0.20 | 2.56 |
| 43 | Exemplary coupler C - 76 | $8.0 \times 10^{-3}$ | Exemplary compound (VII - 1) | 0.02 | 2.59 |
| 44 | Exemplary coupler C - 76 | $8.0 \times 10^{-3}$ | Exemplary compound (VII - 7) | 0.03 | 2.59 |
| 45 | Exemplary coupler C - 76 | $8.0 \times 10^{-3}$ | Exemplary compound (VII - 8) | 0.04 | 2.55 |
| 46 | Exemplary coupler C - 30 | $8.0 \times 10^{-3}$ | Exemplary compound (VII - 1) | 0.02 | 2.59 |
| 47 | Exemplary coupler C - 19 | $8.0 \times 10^{-3}$ | Exemplary compound (VII - 1) | 0.03 | 2.56 |
| 48 | Exemplary coupler C - 76/ Exemplary coupler CC - 8 | $8.0 \times 10^{-3}$ | Exemplary compound (VII - 1) | 0.01 | 2.63 |
| 49 | Exemplary coupler C - 76 | $2.0 \times 10^{-3}$ | Exemplary compound (VII - 1) | 0.03 | 2.65 |
| 50 | Exemplary coupler C - 76 | $4.0 \times 10^{-3}$ | Exemplary compound (VII - 1) | 0.02 | 2.61 |
| 51 | Exemplary coupler C - 76 | $2.0 \times 10^{-3}$ | Exemplary compound (VII - 1) | 0.01 | 2.56 |

As clearly seen from the results in Table 8, when the couplers other than the present invention were employed, there were disadvantages that lowering in the maximum color density of the cyan was remarkable and also the minimum density was high. On the other hand, the cyan couplers of the present invention showed that the minimum density was remarkably high when containing no chelating agent while there was not observed lowering in the maximum color density. However, it can be obtained the results that the both of the maximum color density and the minimum color density were satisfied at the same time by combining the coupler and the chelating agent of the present invention.

Also, in the samples of the present invention, more excellent maximum color density can be obtained by lowering the concentration of the sulfite.

In sample No. 45, when the exemplary compound CC-2, C-1, C-3 and C-58 were employed as the cyan coupler or in sample No. 43, when the exemplary compound VII-1, VII-4 to VII-6 and V-2 to V-4 were employed as the chelating agent, the same results can be obtained, respectively.

Comparative cyan coupler

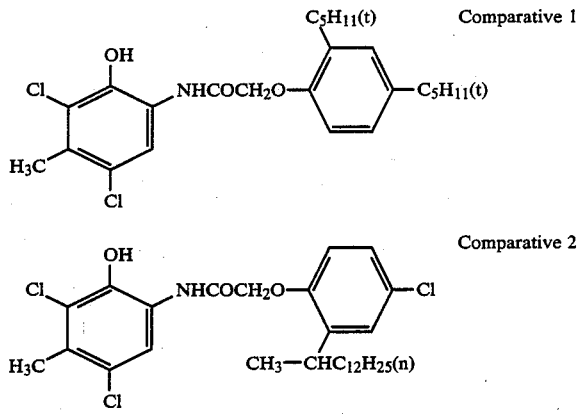

Example (9)

By using the light-sensitive color material prepared in Example (7) (silver halide compositions are shown in Table 9), silver developabilities were evaluated with respect to Nos. 12, 14 and 16 (no color developing agent) as the color developing agents by carrying out the following processings.

| Standard processing steps (Processing temperature and processing time) | | |
|---|---|---|
| [1] Developing | 35° C. | 45 sec. |
| [2] Fixing | 35° C. | 45 sec. |
| [3] Washing processing | 30° C. | 90 sec. |
| [4] Drying | 60 to 80° C. | 60 sec. |
| (Fixing solution) | | |
| Ammonium thiosulfate (70% solution) | | 150 ml |
| Ammonium sulfite (40% solution) | | 20 ml |

Made up to 1 liter in total by adding water, and adjusted to pH 7.00 with use of ammonium hydroxide or acetic acid.

After developing processing, using PDA-65 (produced by Konishiroku Photo Industry Co., Ltd.), spectral reflection density was measured on the samples by orange light to evaluate $D_{max}$ of the samples. Difference between the spectral reflection density for $D_{max}$ and the spectral reflection density for $D_{min}$ was assumed as a typical characteristics of silver density.

Results are shown in Table 9.

TABLE 9

| Sample No. | Color developing solution No. | Silver halide composition AgBr:AgCl (molar ratio) Blue-sensitive layer | Green-sensitive layer | Red-sensitive layer | Reflective silver density |
|---|---|---|---|---|---|
| 52 | 12 | 25:75 | 25:75 | 25:75 | 0.00 |
| 53 | | 20:80 | 20:80 | 20:80 | 0.00 |
| 54 | | 15:85 | 15:85 | 15:85 | 0.00 |
| 55 | | 10:90 | 10:90 | 10:90 | 0.00 |
| 56 | | 5:95 | 5:95 | 5:95 | 0.00 |
| 57 | | 2:98 | 2:98 | 2:98 | 0.00 |
| 58 | | 0:100 | 0:100 | 0:100 | 0.00 |
| 59 | 14 | 25:75 | 25:75 | 25:75 | 0.04 |
| 60 | | 20:80 | 20:80 | 20:80 | 0.19 |
| 61 | | 15:85 | 15:85 | 15:85 | 0.30 |
| 62 | | 10:90 | 10:90 | 10:90 | 0.40 |
| 63 | | 5:95 | 5:95 | 5:95 | 0.47 |
| 64 | | 2:98 | 2:98 | 2:98 | 0.50 |
| 65 | | 0:100 | 0:100 | 0:100 | 0.56 |
| 66 | 16 | 25:75 | 25:75 | 25:75 | 0.00 |
| 67 | | 20:80 | 20:80 | 20:80 | 0.01 |
| 68 | | 15:85 | 15:85 | 15:85 | 0.01 |
| 69 | | 10:90 | 10:90 | 10:90 | 0.02 |
| 70 | | 5:95 | 5:95 | 5:95 | 0.03 |
| 71 | | 2:98 | 2:98 | 2:98 | 0.03 |
| 72 | | 0:100 | 0:100 | 0:100 | 0.03 |

As clearly seen from Table 9, it can be understood that the samples Nos. 59 to 65 using hydroxylamine were each high in silver density and silver developings progressed. Particularly, in samples Nos. 60 to 65 having silver chloride contents of 80% or more, it can be understood that silver developings progressed.

However, in the color developing solution No. 16 using the exemplary compound I-1 of the present invention, silver developings hardly progressed irrelevant to the content of silver chloride.

Example (10)

By using samples Nos. 28, 30 and 33 (provided that the cyan coupler was employed as shown in Table 10) used in Example (7), and using the developing solution No. 16 (provided that potassium sulfite is shown in Table 10) used in Example (6) as the color developing solution, effects to the cyan densities according to the composition of silver halide and sulfite were observed. Developing processing and evaluation method are followed to Example (7).

TABLE 10

| Sample No. | Silver halide composition AgBr:AgCl (molar ratio) (red-sensitive layer) | Potassium sulfite mole/liter color developing solution | Cyan maximum color density: Comparative coupler 1 | C - 76 coupler of this invention |
|---|---|---|---|---|
| 73 | Sample No. 28 used in Example (7) 25:75 | $4.0 \times 10^{-2}$ | 2.25 | 2.29 |
| 74 | Sample No. 28 used in Example (7) 25:75 | $1.0 \times 10^{-2}$ | 2.28 | 2.31 |
| 75 | Sample No. 28 used in Example (7) 25:75 | $4.0 \times 10^{-3}$ | 2.33 | 2.31 |
| 76 | Sample No. 28 used in Example (7) 25:75 | $1.0 \times 10^{-3}$ | 2.35 | 2.32 |
| 77 | Sample No. 30 used in Example (7) 20:80 | $4.0 \times 10^{-2}$ | 2.10 | 2.37 |
| 78 | Sample No. 30 used in Example (7) 20:80 | $1.0 \times 10^{-2}$ | 2.34 | 2.43 |
| 79 | Sample No. 30 used in Example (7) 20:80 | $4.0 \times 10^{-3}$ | 2.50 | 2.48 |
| 80 | Sample No. 30 used in Example (7) 20:80 | $1.0 \times 10^{-3}$ | 2.53 | 2.51 |
| 81 | Sample No. 33 used in | $4.0 \times 10^{-2}$ | 2.15 | 2.45 |

TABLE 10-continued

| Sample No. | Silver halide composition AgBr:AgCl (molar ratio) (red-sensitive layer) | Potassium sulfite mole/liter color developing solution | Cyan maximum color density: Comparative coupler 1 | Cyan maximum color density: C - 76 coupler of this invention |
|---|---|---|---|---|
| | Example (7) 5:95 | | | |
| 82 | Sample No. 33 used in Example (7) 5:95 | $1.0 \times 10^{-2}$ | 2.35 | 2.53 |
| 83 | Sample No. 33 used in Example (7) 5:95 | $4.0 \times 10^{-3}$ | 2.56 | 2.58 |
| 84 | Sample No. 33 used in Example (7) 5:95 | $1.0 \times 10^{-3}$ | 2.58 | 2.58 |

As clearly seen from Table 10, in case where the silver halide composition and silver chloride are other than the present invention (Samples Nos. 73 to 76), while the cyan densities are low since the developing time is short, they are not so afected by the concentration of potassium sulfite and kinds of the cyan coupler. On the other hand, the samples of the present invention (No. 77 to 84) show, when the silver chloride is 80 mole % or more, higher cyan densities even if the developing times are short since the developing rates are fast. However, when the coupler other than the present invention is employed, they remarkably depend on an amount of potassium sulfite, and when the potassium sulfite is $1.0\times10^{-2}$ mole or more, particularly remarkable density is shown. It can be understood that in case where the coupler of the present invention is employed, lowering in the cyan density is less and further when the sulfite concentration is $4.0\times10^{-3}$ or less, extremely excellent maximum density can be obtained.

Example (11)

The following layers were provided by coating on paper supports laminated with polyethylene, successively in the order from the support side to produce samples of light-sensitive materials.

Layer 1 . . . A layer containing 1.0 g/m$^2$ of gelatin, 0.45 g/m$^2$ (in terms of silver; ditto hereinafter) of a blue-sensitive silver halide emulsion and $1.2\times10^{-3}$ mole/m$^2$ of the exemplary yellow coupler (Y-5) dissolved in 0.55 g/m$^2$ of dioctyl phthalate.

Layer 2 . . . An intermediate layer comprising 0.65 g/m$^2$ of gelatin.

Layer 3 . . . A layer containing 1.20 g/m$^2$ of gelatin, 0.24 g/m$^2$ of a green-sensitive silver halide emulsion and $1.0\times10^{-3}$ mole/m$^2$ of the above magenta coupler (M-7) dissolved in 0.27 g/m$^2$ of dioctyl phthalate.

Layer 4 . . . An intermediate layer comprising 1.0 g/m$^2$ of gelatin.

Layer 5 . . . A layer containing 1.3 g/m$^2$ of gelatin, 0.30 g/m$^2$ of a red-sensitive silver halide emulsion and $1.75\times10^{-3}$ mole/m$^2$ of the exemplary cyan coupler (CC-8) dissolved n 0.30 g/m$^2$ of dibutyl phthalate.

Layer 6 . . . A layer containing 1.2 g/m$^2$ of gelatin and 0.30 g/m$^2$ of Tinuvin 328 (an ultraviolet absorbent produced by Ciba-Geigy Corp.) dissolved in 0.20 g/m$^2$ of dioctyl phthalate.

Layer 7 . . . A layer containing 0.45 g/m$^2$ of gelatin.

As a hardening agent, 2,4-dichloro-6-hydroxy-s-triazine sodium was added to Layers 2, 4 and 7 each so as to be in an amount of 0.017 g per 1 g of gelatin.

The silver halide compositions in each of silver halide emulsions are shown in Table 11.

Next, after carrying out wedgewise exposure on these samples according to a conventional method, the following developing processing was carried out.

| Processing step | Processing temperature | Processing time |
|---|---|---|
| [1] Color developing | 35° C. | |
| [2] Bleach-fixing | 35° C. | 45 sec. |
| [3] Washing | 30° C. | 90 sec. |
| [4] Drying | 60 to 80° C. | 60 sec. |

The processing solution used was the one having the following compositions.

| (Color developing solution) | |
|---|---|
| Potassium chloride | 1.0 g |
| Potassium sulfite | $1.5 \times 10^{-3}$ mole |
| Preservative (Exemplary compound (I - 1)) | 10 g |
| Chelating agent (Exemplary compound (VII - 1) | 1.0 g |
| Color developing agent (Exemplary compound A - 1) | 5.5 g |
| Potassium carbonate | 30 g |

Made up to 1 liter by adding water, and adjusted to pH 10.15 with use of potassium hydroxide or sulfuric acid.

The bleach-fixing solution has the same composition as that used in Example 2.

Maximum reflective densities of the yellow dyes when developed at 35° C. for 10 min. were measured with use of Photoelectric Densitometer PDA-65 (produced by Konishiroku Photo Industry Co., Ltd.), and the maximum reflective density of the yellow dye is made 100 and developing times (development converging time) necessary for reaching the maximum reflective density of the yellow dye become 80 are shown in Table 11. The results show development completion time of the light-sensitive material used since they show development converging time of blue-sensitive emulsion layers which are the slowest in developing rate.

TABLE 11

| Sample No. | Silver halide composition AgBr:AgCl (molar ratio): Blue-sensitive layer | Green-sensitive layer | Red-sensitive layer | Development converging time (sec) |
|---|---|---|---|---|
| 85 | 25:75 | 25:75 | 25:75 | 130 |
| 86 | 22:78 | 22:78 | 22:78 | 124 |
| 87 | 20:80 | 20:80 | 20:80 | 92 |
| 88 | 15:85 | 15:85 | 15:85 | 76 |
| 89 | 10:90 | 10:90 | 10:90 | 64 |
| 90 | 5:95 | 5:95 | 5:95 | 46 |
| 91 | 5:95 | 2:98 | 2:98 | 43 |
| 92 | 2:98 | 2:98 | 2:98 | 41 |
| 93 | 2:98 | 100 | 100 | 39 |
| 94 | 100 | 100 | 100 | 38 |

As clearly seen from Table 11, in samples Nos. 87 to 94 having silver chloride contents of 80% or more, it can be seen that the converging times are short and rapid processing is possible. Particularly, in samples Nos. 89 to 94 having silver chloride contents of 90% or more, especially in samples Nos. 90 to 94 having silver chloride contents of 95% or more, it can be understood that rapid processing is possible.

Example (12)

By using color paper samples used in Example (11), following the processing steps of Example (11) and using the processing solutions used in Example (11), the same processings were repeated. Provided that the silver halide composition of the color paper samples were made AgBr:AgCl being 2:98 in blue-sensitive emulsion layer, 3:97 in green-sensitive emulsion layer and 0: 100 in red-sensitive emulsion layer, and the cyan couplers were those as shown in Table 12. Also, the color developing time was made 45 seconds, the concentration of potassium sulfite in the color developing solution was as shown in Table 12 and the chelating agents were used as shown in Table 12 with an amount of 1.0 g/liter, respectively. Also, the color developing solution was used that dissolving 4 ppm of a ferric ion, 2 ppm of a copper ion and 100 ppm of a calcium ion (added by dissolving $FeCl_3$, $CuSO_4.6H_2O$ and $CaCl_2$, respectively, and stored at the same conditions as in Example (6) for 5 days. Maximum color densities and minimum color densities of the cyan dyes after processing were measured and shown in Table 12.

TABLE 12

| Sample No. | Cyan coupler | Potassium sulfite | Chelating agent | Cyan density (reflective density) Maximum density | Minimum density |
|---|---|---|---|---|---|
| 95 | Comparative 1 | $8.0 \times 10^{-3}$ | None | 0.17 | 2.27 |
| 96 | Comparative 1 | $8.0 \times 10^{-3}$ | Exemplary compound (VII - 1) | 0.08 | 2.32 |
| 97 | Comparative 2 | $8.0 \times 10^{-3}$ | None | 0.15 | 2.25 |
| 98 | Comparative 2 | $8.0 \times 10^{-3}$ | Exemplary compound (VII - 1) | 0.08 | 2.29 |
| 99 | Exemplary coupler CC - 8 | $8.0 \times 10^{-3}$ | None | 0.22 | 2.55 |
| 100 | Exemplary coupler CC - 8 | $8.0 \times 10^{-3}$ | Exemplary compound (VII - 1) | 0.03 | 2.59 |
| 101 | Exemplary coupler CC - 8 | $8.0 \times 10^{-3}$ | Exemplary compound (VII - 1) | 0.04 | 2.58 |
| 102 | Exemplary coupler CC - 8 | $8.0 \times 10^{-3}$ | Exemplary compound (VII - 1) | 0.04 | 2.56 |
| 103 | Exemplary coupler CC - 2 | $8.0 \times 10^{-3}$ | Exemplary compound (VII - 1) | 0.03 | 2.56 |
| 104 | Exemplary coupler CC - 4 | $8.0 \times 10^{-3}$ | Exemplary compound (VII - 1) | 0.03 | 2.57 |
| 105 | Exemplary coupler CC - 9 | $8.0 \times 10^{-3}$ | Exemplary compound (VII - 1) | 0.02 | 2.60 |
| 106 | Exemplary coupler CC - 8 | $2.0 \times 10^{-3}$ | Exemplary compound (VII - 1) | 0.03 | 2.67 |
| 107 | Exemplary coupler CC - 8 | $4.0 \times 10^{-3}$ | Exemplary compound (VII - 1) | 0.02 | 2.64 |
| 108 | Exemplary coupler CC - 8 | $2.0 \times 10^{-2}$ | Exemplary compound (VII - 1) | 0.01 | 2.57 |

In Table 12, Comparative cyan couplers 1 and 2 are the same as those used in Example 8.

As clearly seen from the results in Table 12, when the couplers other than the present invention were employed, there were disadvantages that lowering in the maximum color density of the cyan was remarkable and also the minimum density was high. On the other hand, the cyan couplers of the present invention showed that the minimum density was remarkably high when containing no chelating agent while there was not observed lowering in the maximum color density. However, it can be obtained the results that the both of the maximum color density and the minimum color density were satisfied at the same time by combining the coupler and the chelating agent of the present invention.

Also, in the samples of the present invention, more excellent maximum color density can be obtained by lowering the concentration of the sulfite.

In sample No. 102, when the exemplary compound CC-19 was employed as the cyan coupler or in sample No. 100, when the exemplary compound VII-1, VII-4 to VII-6 and V-2 to V-4 were employed as the chelating agent, the same results can be obtained, respectively.

Example (13)

By using the light-sensitive color material prepared in Example (11) (silver halide compositions are shown in Table 13), silver developabilities were evaluated with respect to Nos. 12, 14 and 16 (no color developing agent) as the color developing agents by carrying out the same processings as in Example (9).

Results are shown in Table 13.

TABLE 13

| Sample No. | Color developing solution No. | Silver halide composition AgBr:AgCl (molar ratio) Blue-sensitive layer | Green-sensitive layer | Red-sensitive layer | Reflective silver density |
|---|---|---|---|---|---|
| 109 | 12 | 25:75 | 25:75 | 25:75 | 0.00 |
| 110 | | 20:80 | 20:80 | 20:80 | 0.00 |
| 111 | | 15:85 | 15:85 | 15:85 | 0.00 |
| 112 | | 10:90 | 10:90 | 10:90 | 0.00 |
| 113 | | 5:95 | 5:95 | 5:95 | 0.00 |
| 114 | | 2:98 | 2:98 | 2:98 | 0.00 |
| 115 | | 0:100 | 0:100 | 0:100 | 0.00 |
| 116 | 14 | 25:75 | 25:75 | 25:75 | 0.04 |
| 117 | | 20:80 | 20:80 | 20:80 | 0.19 |
| 118 | | 15:85 | 15:85 | 15:85 | 0.32 |
| 119 | | 10:90 | 10:90 | 10:90 | 0.41 |
| 120 | | 5:95 | 5:95 | 5:95 | 0.47 |
| 121 | | 2:98 | 2:98 | 2:98 | 0.52 |

TABLE 13-continued

| Sample No. | Color developing solution No. | Silver halide composition AgBr:AgCl (molar ratio) Blue-sensitive layer | Green-sensitive layer | Red-sensitive layer | Reflective silver density |
|---|---|---|---|---|---|
| 122 | | 0:100 | 0:100 | 0:100 | 0.59 |
| 123 | 16 | 25:75 | 25:75 | 25:75 | 0.00 |
| 124 | | 20:80 | 20:80 | 20:80 | 0.01 |
| 125 | | 15:85 | 15:85 | 15:85 | 0.02 |
| 126 | | 10:90 | 10:90 | 10:90 | 0.02 |
| 127 | | 5:95 | 5:95 | 5:95 | 0.03 |
| 128 | | 2:98 | 2:98 | 2:98 | 0.03 |
| 129 | | 0:100 | 0:100 | 0:100 | 0.04 |

As clearly seen from Table 13, it can be understood that the samples Nos. 116 to 122 using hydroxylamine were each high in silver density and silver developings progressed. Particularly, in samples Nos. 117 to 122 having silver chloride contents of 80% or more, it can be understood that silver developings progressed. However, in the color developing solution No. 16 using the exemplary compound I-1 of the present invention, silver developings hardly progressed irrelevant to the content of silver chloride.

Example (14)

By using samples Nos. 85, 87 and 90 (provided that the cyan coupler was employed as shown in Table 14) used in Example (6), and using the developing solution No. 16 (provided that potassium sulfite is shown in Table 14) used in Example (6) as the color developing solution, effects to the cyan densities according to the composition of silver halide and sulfite were observed. Developing processing and evaluation method as followed to Example (11).

TABLE 13

| Sample No. | Silver halide composition AgBr:AgCl (molar ratio) (red-sensitive layer) | Potassium sulfite mole/liter color developing solution | Cyan maximum color density Comparative coupler 1 | CC - 8 coupler of this invention |
|---|---|---|---|---|
| 130 | Sample No. 85 used in Example 11 25:75 | $4.0 \times 10^{-2}$ | 2.23 | 2.27 |
| 131 | Sample No. 85 used in Example 11 25:75 | $1.0 \times 10^{-2}$ | 2.25 | 2.30 |
| 132 | Sample No. 85 used in Example 11 25:75 | $4.0 \times 10^{-3}$ | 2.30 | 2.31 |
| 133 | Sample No. 85 used in Example 11 25:75 | $1.0 \times 10^{-3}$ | 2.32 | 2.32 |
| 134 | Sample No. 87 used in Example 11 20:80 | $4.0 \times 10^{-2}$ | 2.07 | 2.36 |
| 135 | Sample No. 87 used in Example 11 20:80 | $1.0 \times 10^{-2}$ | 2.32 | 2.43 |
| 136 | Sample No. 87 used in Example 11 20:80 | $4.0 \times 10^{-3}$ | 2.49 | 2.47 |
| 137 | Sample No. 87 used in Example 11 20:80 | $1.0 \times 10^{-3}$ | 2.52 | 2.50 |
| 138 | Sample No. 90 used in Example 11 5:95 | $4.0 \times 10^{-2}$ | 2.11 | 2.42 |
| 139 | Sample No. 90 used in Example 11 5:95 | $1.0 \times 10^{-2}$ | 2.32 | 2.51 |
| 140 | Sample No. 90 used in Example 11 5:95 | $4.0 \times 10^{-3}$ | 2.55 | 2.58 |
| 141 | Sample No. 90 used in Example 11 5:95 | $1.0 \times 10^{-3}$ | 2.58 | 2.58 |

As clearly seen from Table 14, in case where the silver halide composition and silver chloride are other than the present invention (Samples Nos. 130 to 133), while the cyan densities are low since the developing time is short, they are not so affected by the concentration of potassium sulfite and kinds of the cyan coupler. On the other hand, the samples of the present invention (No. 134 to 141) show, when the silver chloride is 80 mole % or more, higher cyan densities even if the developing times are short since the developing rates are fast. However, when the coupler other than the present invention is employed, they remarkably depend on an amount of potassium sulfite, and when the potassium sulfite is $1.0\times10^{-2}$ mole or more, particularly remarkable density is shown. It can be understood that in case where the coupler of the present invention is employed, lowering in the cyan density is less and further when the sulfite concentation is $4.0\times10^{-3}$ or less, extremely excellent maximum density can be obtained.

Example (15)

Using the following light-sensitive materials, processing solutions and processing steps, experiments were carried out.

[Light-sensitive material]

The following layers were provided by coating on paper supports laminated with polyethylene, successively in the order from the support side to produce samples of light-sensitive materials.

As the polyethylene coated papers, used were those prepared by adding 6.8% by weight of anatase type titanium oxide to a mixture comprising 200 parts by weight of polyethylene having an average molecular weight of 100,000 and a density of 0.95 and 20 parts by weight of polyethylene having an average molecular weight of 2,000 and a density of 0.80, forming on the surface of a fine quality paper having a weight of 170 g/m$^2$ a coating layer having a thickness of 0.035 mm by the extrusion coating method and forming on a back surface thereof a coating layer composed of only polyethylene having a thickness of 0.040 mm. On the polyethylene coated surface of the support surface, pretreating was carried out by corona discharge, each layer was successively coated thereon.

First layer

A blue-sensitive silver halide emulsion layer comprising a silver halide emulsion having the silver halide composition shown in Table 15, wherein said emulsion contains 350 g of gelatin per mole of silver halide, being sensitized with use of $2.5\times10^{-4}$ mole per mole of silver halide, of a sensitizing dye having the following structure (using isopropyl alcohol as a solvent),

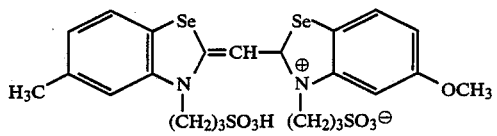

and contained 200 mg/m$^2$ of 2,5-di-t-butylhydroquinone and $2\times10^{-1}$ of mole of exemplary yellow coupler (Y-5) per mole of silver halide, dissolved and dispersed in dibutyl phthalate; and coated to have silver weight of 300 mg/m$^2$.

Second layer

A gelatin layer containing 300 mg/m$^2$ of di-t-butylhydroquinone dissolved and dispersed in dibutyl phthalate and, as an ultraviolet absorbing agent, 200 mg/m$^2$ of a mixture comprising 2-(2'-hydroxy-3',5'-di-t-butylphenyl)benzotriazole, 2-(2'-hydroxy-5'-t-butylphenyl)-benzotriazole, 2-(2'-hydroxy-3'-t-butyl-5'-methylphenyl)-5-chlorobenzotriazole and 2-(2'-hydroxy-3',5'-di-t-butylphenyl)-5-chlorobenzotriazole; and coated to have a gelatin amount of 1,900 mg/m$^2$.

Third layer

A green-sensitive silver halide emulsion layer comprising a silver halide emulsion having the silver halide composition shown in Table 15, wherein said emulsion contains 450 g of gelatin per mole of silver halide, being sensitized with use of $2.5\times10^{-4}$ mole per mole of silver halide, of a sensitizing dye having the following structure:

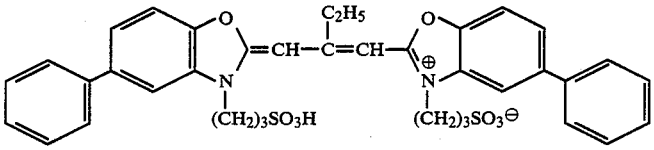

and contains $1.5\times10^{-1}$ mole of exemplary magenta coupler (M-5) per mole of silver halide as a magenta coupler dissolved and dispersed in a solvent obtained by mixing dibutyl phthalate and tricresyl phosphate in 2:1; and coated to have silver weight of 230 mg/m$^2$. As an antioxidant, 0.3 mole of 2,2,4-trimethyl-6-lauryloxy-7-t-octylchroman per mole of coupler was further contained.

Fourth layer

A gelatin layer containing 30 mg/m$^2$ of di-t-butylhydroquinone dissolved and dispersed in dioctyl phthalate and, as an ultraviolet absorbing agent, 500 mg/m$^2$ of a mixture comprising 2-(2'-hydroxy-3',5'-di-t-butylphenyl)benzotriazole, 2-(2'-hydroxy-5'-t-butylphenyl)-benzotriazole, 2-(2'-hydroxy-3'-t-butyl-5'-methylphenyl)-5-chlorobenzotriazole and 2-(2'-hydroxy-3',5'-di-t-butylphenyl)-5-chlorobenzotriazole (2:1, 5:1, 5:2); and coated to have a gelatin amount of 1,900 mg/m$^2$.

Fifth layer

A red-sensitive silver halide emulsion layer comprising a silver halide emulsion having the silver halide composition shown in Table 15, wherein said emulsion contains 500 g of gelatin per mole of silver halide, being sensitized with use of $2.5\times10^{-5}$ mole per mole of silver halide, of a sensitizing dye having the following structure:

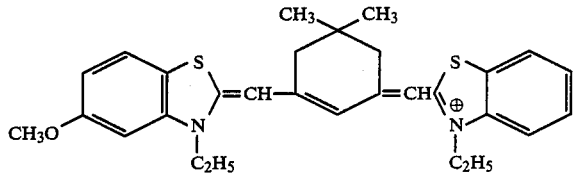

and contains 150 mg/m$^2$ of 2,5-di-t-butylhydroquinone and as a cyan coupler $3.5\times10^{-1}$ mole of exemplay cyan coupler (C'-7) per mole of silver halide dissolved and dispersed in dibutyl phthalate; and coated to have silver weight of 280 mg/m$^2$.

Sixth layer

A gelatin layer, coated to have a gelatin amount of 900 mg/m$^2$.

The silver halide emulsions used in the respective light-sensitive emulsion layer (the first, third and fifth layers) were prepared according to the procedures disclosed in Japanese Patent Publication No. 7772/1971, respectively sensitized with use of sodium thiosulfate pentahydrate, and contained 4-hydroxy-6-methyl-1,3,3a,7-tetrazaindene as a stabilizer, bis(vinylsulfonylmethyl)ether as a hardening agent and saponin as a coating auxiliary.

The above light-sensitive materials in which the silver halide composition in the respective layers was varied as shown in Table 15 were subjected to step exposure to light, and processed using the processing steps and processing solutions shown below (in which preservatives of color developing solutions were varied, and no preservative is contained in a comparative example). Maximum density of yellow dyes of the samples obtained was measured, and its proportion to the comparative example containing no preservative was calculated. Results are shown in Table 15.

| | | |
|---|---|---|
| Standard processing steps: | | |
| [1] Color developing | 35° C. | 50 sec. |
| [2] Bleach-fixing | 35° C. | 50 sec. |
| [3] Washing | 25 to 35° C. | 1 min. |
| [4] Drying | 75 to 100° C. | about 2 min. |
| Composition of processing solutions: | | |
| <Color developing tank solution> | | |
| Ethylene glycol | | 15 ml |
| Potassium sulfite | | $5\times10^{-3}$ mole |
| Sodium chloride | | 2.0 g |
| Potassium carbonate | | 30.0 g |
| Triethanolamine | | 10 g |
| 3-Methyl-4-amino-N—ethyl-N—(β-methanesulfonamidoethyl)aniline sulfate | | 5.0 g |
| Brightening agent (4,4'-diaminostilbene type) | | 1.0 g |
| Preservative shown in Table 15 | | 5.0 g |
| Ethylenediaminetetraacetic acid | | 2.0 g |
| Disodium 1,2-dihydroxybenzene-3,5-disulfonate | | 0.2 g |
| Made up to 1 liter by adding water, and adjusted to pH 10.20 with use of KOH and $H_2SO_4$. | | |
| <Bleach-fixing tank solution) | | |
| Ethylenediaminetetraacetic acid ferric ammonium salt dihydrate | | 60 g |

-continued

| | |
|---|---|
| Ethylenediaminetetraacetic acid | 3 g |
| Ammonium thiosulfate (70% solution) | 100 ml |
| Ammonium sulfite (40% solution) | 27.5 ml |

Made up to 1 liter in total by adding water, and adjusted to pH 7.1 with use of potassium carbonate or glacial acetic acid.

TABLE 15

| Emulsion No. | Composition of silver halide: Silver chloride (mole %) | Silver bromide (mole %) | Maximum density (%) (assuming as 100 the density in the processing without the respective preservatives): HAS* | DEHA* | DMHA* | DPHA* |
|---|---|---|---|---|---|---|
| A | 10% | 90% | 97 | 100 | 99 | 98 |
| B | 50% | 50% | 93 | 98 | 98 | 97 |
| C | 70% | 30% | 71 | 98 | 97 | 95 |
| D | 90% | 10% | 59 | 97 | 95 | 92 |
| E | 96% | 4% | 50 | 95 | 94 | 89 |
| F | 100% | 0% | 21 | 92 | 91 | 86 |

*Remarks (preservative)
HAS: Hydroxylamine sulfate
DEHA: Diethylhydroxylamine
DMHA: Dimethylhydroxylamine
DPHA: Dipropylhydroxylamine As will be clear from Table 15, (although there is no remarkable difference in the maximum density depending on whether the preservative is present or not or the type thereof is the case where the silver chloride is contained in a small amount) the maximum density is not lowered and understood to be very favourable in the case of the emulsions containing 70 mole % or more of silver chloride (Emulsions No. C, D, E and F) as DEHA, DMHA and DPHA are used as preservatives in the color developing solution.

Example (16)

To respective color developing solutions to which the preservatives used in Example (15) (the respective preservatives HAS, DEHA, DMHA and DPHA shown in Table 16), 4 ppm of a ferric ion as $FeCl_3$ and 2 ppm of a copper ion as $CuSO_4$ were each added, and the resulting solutions were stored for 10 days, keeping the temperature at 35° C. These were compared with a color developing solution containing no preservative, available immediately after the preparation (to which, however, similar to the color developing solution to which the above preservatives are added, 4 ppm of a ferric ion as $FeCl_3$ and 2 ppm of a copper ion as $CuSO_4$ were each added), to make comparison of the color developing solutions under the running condition. After developing was carried out using the above respective solutions in the same manner as in Example (15), the gamma value of yellow dyes (the values between the density of 0.8 and the density of 1.8) was determined, and its proportion to the comparative example containing no preservative immediately after the preparation was calculated. Results are shown in Table 16.

TABLE 16

| Emulsion No. | Composition of silver halide: Silver chloride (mole %) | Silver bromide (mole %) | Maximum density (%) (assuming as 100 the density in the processing without the respective preservatives): HAS* | DEHA* | DMHA* | DPHA* |
|---|---|---|---|---|---|---|
| A | 10% | 90% | 109 | 101 | 99 | 99 |
| B | 50% | 50% | 115 | 101 | 101 | 100 |
| C | 70% | 30% | 120 | 102 | 103 | 104 |
| D | 90% | 10% | 132 | 103 | 104 | 106 |
| E | 96% | 4% | 140 | 105 | 106 | 106 |
| F | 100% | 0% | 145 | 105 | 107 | 108 |

*Same meanings as in Table 15.

(The gamma values of the above yellow dyes were measured for the reflection density by use of PDA-65 (produced by Konishiroku Photo Industry Co., Ltd.)

It is preferable for the gamma value not to be changed even when the color developing solution is allowed to stand with time lapse. As will be clear from Table 16, change in the gamma value depending on the type of the preservatives is not seen so much in the case where the silver chloride is contained in a small amount, but the gamma value does not change and is under stood to be very favourable in the case of the emulsions containing 70% or more of silver chloride even when the color developing solution is stored, as DEHA, DMHA and DPHA are used as preservatives.

Example (17)

Varying as shown in Table 17 the concentration of potassium sulfite in the color developing solution used in Example (15), further adding 4 ppm of ferric ion and 2 ppm of copper ion, and using a comparative example containing $5.0\times10^{-3}$ mole of potassium sulfite without any preservative, developing was carried out in the same manner as in Example (15). Maximum density of yellow dyes was measured and the proportion to the case where the maximum density in the comparative example containing $5.0\times10^{-1}$ mole of potassium sulfite without any preservative was assumed as 100 was calculated. Results obtained are shown in Table 17.

As mentioned in the foregoing, addition of sulfite in a smaller amount may preferably not lower the color density of a light-sensitive material, but may make poor the preservativity. In the case the sulfite is used in combination with the above respective preservatives, the color developing agent can be preserved, but problems may arise in the color density as mentioned above.

TABLE 17

| Emulsion No. | Composition of silver halide: Silver chloride (mole %) | Silver bromide (mole %) | Preservative HAS 5 g/liter, Potassium sulfite (mole/1): $2.5 \times 10^{-4}$ | $1.0 \times 10^{-3}$ | $1.0 \times 10^{-2}$ | $3.0 \times 10^{-2}$ | Preservative DEHA 5 g/liter, Potassium sulfite (mole/1): $2.5 \times 10^{-4}$ | $1.0 \times 10^{-3}$ | $1.0 \times 10^{-2}$ | $3.0 \times 10^{-2}$ |
|---|---|---|---|---|---|---|---|---|---|---|
| A | 10% | 90% | 102 | 99 | 98 | 94 | 102 | 100 | 98 | 92 |
| B | 50% | 50% | 100 | 100 | 95 | 88 | 100 | 99 | 98 | 89 |
| C | 70% | 30% | 82 | 80 | 75 | 61 | 100 | 98 | 97 | 85 |
| D | 90% | 10% | 69 | 65 | 63 | 50 | 98 | 98 | 96 | 80 |
| E | 96% | 4% | 60 | 57 | 54 | 45 | 98 | 98 | 95 | 74 |
| F | 100% | 0% | 32 | 26 | 23 | 22 | 97 | 96 | 91 | 68 |

Values in the table refer to the yellow dye maximum density (%) (assuming as 100 the maximum density in the comparative example containing potassium sulfite without any preservative)

As will be clear from Table 17, hydroxylamine ("HAS" in the table) tends to be remarkably concerned with the influence by the silver halide composition or the sulfite concentration as compared with DEHA, and the maximum density of yellow dyes may be too extremely lowered to obtian the finish satisfactory as a photograph where a light-sensitive material containing the silver halide grains of the present invention containing a larger amount of silver chloride is processed. In contract thereto, in the case the DEHA is used, there can be little influence by the silver halide composition and the change depending on the sulfite concentration is not seen so much. However, the density is clearly lowered in the case outside the present invention, where as much as $3.0 \times 10^{-2}$ mole of sulfite is used.

TABLE 18

| Processing solution No. | Potassium sulfite (mole/liter) | Preservative HAS (5 g/liter) | Preservative HAS (5 g/liter) |
|---|---|---|---|
| 21 | $2.5 \times 10^{-4}$ | +++ | + |
| 22 | $1.0 \times 10^{-3}$ | + | — |
| 23 | $1.0 \times 10^{-2}$ | — | — |
| 24 | $3.0 \times 10^{-2}$ | — | — |

As will be clear from Table 18, it is shown that DEHA can attain better preservativity and may not readily result in the formation of tar as compared with HAS.

Example (19)

To further solve the problem of the formation of tar, the color developing solution of the present invention should preferably contain no solvent of poor solubility, in particular, benzyl alcohol. Comparison of the case where benzyl alcohol is contained in the color developing solution with the case where it is not contained was specifically carried out in the following manner.

Preparation of Emulsion G

A silver chloride emulsion was prepared according to the sumultaneous mixing of 0.3N NaCl and 0.3N $AgNO_3$ in a 2.6% gelatin solution while controlling pAg. Using this emulsion as a base, its size was increased to the volume of 40 times by further adding 2N NaCl and 2N $AgNO_3$. This AgCl grains were provided with AgBr/AgCl shells according to the simultaneous mixing of a KBr/NaCl solution containing 40 mole % of bromide and an $AgNO_3$ solution.

The emulsion obtained was a monodispersed emulsion comprising grains having an average grain size of 0.60 μm, wherein AgCl content was 96 mole % based on the total silver halide and AgBr content was 4 mole %.

Subsequently, the following light-sensitive silver halide color photographic material was produced using Emulsion G.

The following layers were provided by coating on paper supports laminated with polyethylene, successively in the order from the support side to produce samples of light-sensitive materials.

Layer 1 . . . A layer containing 1.20 g/m² of gelatin, 0.40 g/m² (in terms of silver; ditto hereinafter) of a blue-sensitive silver halide emulsion and $1.0 \times 10^{-3}$ mole/m² of the exemplary yellow coupler (Y-5) dissolved in 0.55 g/m² of dioctyl phthalate.

Layer 2 . . . An intermediate layer comprising 0.70 g/m² of gelatin.

Layer 3 . . . A layer containing 1.20 g/m² of gelatin, 0.22 g/m² of a green-sensitive silver halide emulsion and $1.0 \times 10^{-3}$ mole/m² of the exemplary magenta coupler (M-5) dissolved in 0.30 g/m² of dioctyl phthalate.

Layer 4 . . . An intermediate layer comprising 0.70 g/m² of gelatin.

Layer 5 . . . A layer containing 1.20 g/m² of gelatin, 0.28 g/m² of a red-sensitive silver halide emulsion and $1.75 \times 10^{-3}$ mole/m² of the exemplary cyan coupler (C'-7) dissolved in 0.25 g/m² of dibutyl phthalate.

Layer 6 . . . A layer containing 1.0 g/m² of gelatin and 0.32 g/m² of Tinuvin 328 (an ultraviolet absorber, produced by Ciba-Geigy Corp.) dissolved in 0.25 g/m² of dioctyl phthalate.

Layer 7 . . . A layer containing 0.48 g/m² of gelatin.

As a hardening agent, 2,4-dichloro-6-hydroxy-s-triazine sodium salt was added to Layers 2, 4 and 7 each so as to be in an amount of 0.017 g per 1 g of gelatin.

After an image was printed on the color paper sample thus produced, continuous processing was carried out by using an automatic processing machine and according to the processing steps shown below.

Processing step

| | | |
|---|---|---|
| [1] Color developing | 35° C. | 45 sec. |
| [2] Bleach-fixing | 35° C. | 45 sec. |
| [3] Stabilizing substituting for washing | 30° C. | 90 sec. |
| [4] Drying | 60 to 80° C. | 1 min. 30 sec. |

The color developing solution used had the following composition.

| [Color developing solution] | |
|---|---|
| Potassium chloride | 2.0 g |
| Potassium sulfite | $65 \times 10^{-3}$ mole |
| Color developing agent (3-methyl-4-amino-N—ethyl-N—(β-methanesulfonamidoethyl) aniline sulfate) | 5.0 g |
| Diethylhydroxylamine (85%) | 5.0 g |

-continued

| [Color developing solution] | |
|---|---|
| Triethanolamine | 10.0 g |
| Potassium carbonate | 30 g |
| Sodium ethylenediaminetetraacetate | 2.0 g |
| Brightening agent (4,4-diaminostilbenedisulfonic acid derivative) | 2.0 g |

Made up to 1 liter by adding water, and adjusted to pH 10.15 with use of potassium hydroxide or sulfuric acid.

| [Color developing replenishing solution] | |
|---|---|
| Potassium chloride | 2.5 g |
| Potassium sulfite (50% solution) | $7.0 \times 10^{-3}$ mole |
| Color developing agent (3-methyl-4-amino-N—ethyl-N—(β-methanesulfonamidoethyl) aniline sulfate | 8.0 g |
| Diethylhydroxylamine (85%) | 7.0 g |
| Triethanolamine | 10.0 g |
| Potassium carbonate | 30 g |
| Sodium ethylenediaminetetraacetate | 2.0 g |

Made up to 1 liter by adding water, and adjusted to pH 10.40 with use of potassium hydroxide or sulfuric acid.

| [Bleach-fixing tank solution] | |
|---|---|
| Ethylenediaminetetraacetic acid ferric ammonium dihydrate | 60.0 g |
| Ethylenediaminetetraacetic acid | 3.0 g |
| Ammonium thiosulfate (70% solution) | 100.0 ml |
| Ammonium sulfite (40% solution) | 27.5 ml |

Made up to 1 liter in total by adding water, and adjusted to pH 5.50 with use of aqueous ammonia or glacial acetic acid.

| [Bleach-fixing replenishing solution] | |
|---|---|
| Ethylenediaminetetraacetic acid ferric ammonium dihydrate | 70.0 g |
| Ethylenediaminetetraacetic acid | 3.0 g |
| Ammonium thiosulfate (70% solution) | 120.0 ml |
| Ammonium sulfite (40% solution) | 35 ml |

Made up to 1 liter in total by adding water, and adjusted to pH 5.40 with use of aqueous ammonia or glacial acetic acid.

[Stabilizing tank solution substituting for water washing and replenishing solution]

| | |
|---|---|
| Orthophenylphenol | 0.2 g |
| 1-Hydroxyethylidene-1,1-diphosphonic acid (60% aqueous solution) | 2.0 g |
| aqueous ammonia | 3.0 g |

Made up to 1 liter in total by adding water, and adjusted to pH 7.8 with use of aqueous ammonia or glacial acetic acid.

Comparison

| [Color developing solution] | |
|---|---|
| Benzyl alcohol | 15 ml |
| Ethylene glycol | 15 ml |
| Potassium sulfite | 3.5 g |
| Potassium bromide | 0.7 g |

-continued

| [Color developing solution] | |
|---|---|
| Sodium chloride | 0.2 g |
| Potassium carbonate | 30.0 g |
| Hydroxylamine sulfate | 3.0 g |
| Polyphosphoric acid (TPPS) | 2.5 g |
| 3-Methyl-4-amino-N—ethyl-N—(β-methane-sulfonamidoethyl)aniline sulfate | 5.5 g |
| Brightening agent (4,4-diaminostilbenedisulfonic acid derivative) | 1.0 g |
| Potassium hydroxide | 2.0 g |

Made up to 1 liter by adding water. The pH was adjusted to 10.15.

| [Color developing replenishing solution] | |
|---|---|
| Benzyl alcohol | 20 ml |
| Ethylene glycol | 20 ml |
| Potassium sulfite | 4.0 g |
| Potassium carbonate | 30.0 g |
| Hydroxylamine sulfate | 4.0 g |
| Polyphosphoric acid | 3.0 g |
| 3-Methyl-4-amino-N—ethyl-N—(β-methane-sulfonamidoethyl)aniline sulfate | 7.0 g |
| Brightening agent (4,4-diaminostilbenedisulfonic acid derivative) | 1.5 g |
| Potassium hydroxide | 3.0 g |

Made up to 1 liter as a whole by adding water. The pH was adjusted to 10.40. A bleach-fixing solution and a stabilizing solution substituting for water washing were the same as above.

The continuous processing was carried out by filling an automatic processing machine with the above color developing tank solution, bleach-fixing tank solution and stabilizing tank solution while replenishing solution and bleach-fixing replenishing solution and stabilizing replenishing solution substituting for water washing through a measuring pump at intervals of 3 minutes while processing the above color paper sample. The color developing tank was replenished in an amount of 220 ml, the bleach-fixing tank was replenished with the bleach-fixing replenishing solution in an amount of 220 ml per 1 $m^2$ of the color paper, and the stabilizing tank was replenished with 250 ml of the stabilizing solution substituting for water washing.

The stabilizing tank in the automatic processing machine was constituted of stabilizing tanks comprising a first tank to a third tank provided in the direction of the flow, and the replenishment was carried out from the final tank, taking the multi-tank counter current system in which an overflowed solution from the final tank is flowed into the tank posterior thereto and this overflowed solution is further flowed into another tank posterior thereto.

After preparation of the developing solution, a sample subjected to step exposure (wedge exposure) was passed, and the above light-sensitive silver halide color photographic material was further processed 2,000 $m^2$ over a period of 30 days. Thereafter, the same sensitive material with the sample subjected to the step exposure after the preparation of the developing solution was processed. As a result, when processed with use of the developing solution of the present invention, there was little change in the photographic dye density immediately after the preparation or after the continuous processing, and, as a matter of course, no formation of tar was seen at all in the developing tank because benzyl alcohol was not contained.

On the other hand, when processed with use of the comparative developing solution, a remarkable lowering of density was seen immediately after the preparation, and, also in the subsequent continuous processing, there occurs remarkable change in the photographic dye density. Moreover, tar was remarkably seen in the color developing tank, in particular, at a squeesee portion and interface with the tank solution.

Accordingly, it is preferable to use the color developing solution containing substantially no benzyl alcohol also when processing the light-sensitive material of the present invention with a color developing solution.

We claim:

1. A color developing solution for a light-sensitive silver halide color photographic material comprising a compound represented by formula I and at least one compound selected from the group of compounds consisting of those represented by formula II and formula III:

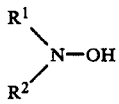

I.

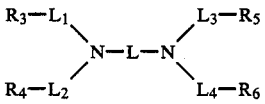

II.

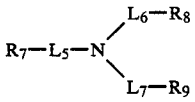

III.

wherein, $R^1$ and $R^2$ each represent an alkyl group having 1 to 3 carbon atoms; L represents an alkylene group, a cycloalkylene group, a phenylene group, $-L_8-O-L_8-O-L_8-$ or $-L_9-Z-L_9-$, where Z represents

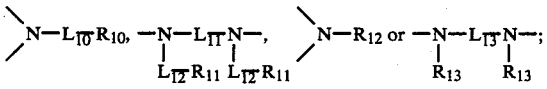

$L_1$ to $L_{13}$ each represent an alkylene group; $R_3$ to $R_{13}$ each represent a hydrogen atom, a hydroxyl group, a carboxylic acid group or its salt, or the phosphonic acid group or its salt, provided that at least two of $R_3$ to $R_6$ are the carboxylic acid group or its salt or the phosphonic acid group or its salt, and at least two of $R_5$ to $R_7$ are the carboxylic acid group or its salt or the phosphonic acid group or its salt, and provided that no hydroxylamine sulfate is present in the color developing solution.

2. The color developing solution for a light-sensitive silver halide color photographic material according to claim 1, wherein a concentration of a sulfite is $5\times10^{-4}$ to $2\times10^{-2}$ mole per liter of the color developing solution.

3. The color developing solution for a light-sensitive silver halide color photographic material according to claim 1, further comprising a p-phenylenediamine type compound having a water soluble group or groups.

4. The color developing solution for a light-sensitive silver halide color photographic material according to claim 3, wherein said water soluble group is at least one selected from the group consisting of $-(CH_2)_n-CH_2OH$, $-(CH_2)_m-NHSO_2-(CH_2)_n-CH_3$, $-(CH_2)_mO-(CH_2)_n-CH_3$, $-(CH_2CH_2O)_nC_mH_{2m+1}$ wherein m and n each represent an integer of 0 or more, a —COOH group and a $-SO_3H$ group, and is attached to an amino group or benzene ring of the p-phenylenediamine type compound.

5. The color developing solution for a light-sensitive silver halide color photographic material according to claim 1, further comprising a triazylstylbene type fluorescent brightening agent represented by formula VIII:

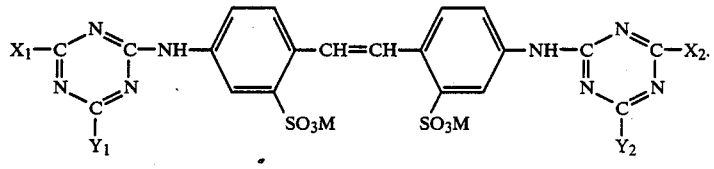

VIII wherein $X_1$, $X_2$, $Y_1$ and $Y_2$ each represent a hydroxy group, a halogen atom such as chlorine or bromine, a morpholino group, alkoxy group, an aryloxy group, an alkyl group, an aryl group, an amino group, an alkylamino group, or an arylamino group, and M represents a hydrogen atom, sodium, potassium, ammonium or lithium.

6. The color developing solution for a light-sensitive silver halide color photographic material according to claim 1, wherein the compound represented by formula III is a compound represented by formula VII:

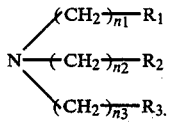

VII wherein $R_1$, $R_2$ and $R_3$ each represent a hydrogen atom, a hydroxy group, a carboxylic acid group or its salt or a phosphoric acid group or its salt, said salt of the carboxylic acid group and the phosphoric acid group selected from the group of salts consisting of salts of an alkali metal atom and salts of an alkaline earth metal atom, provided that at least one of $R_1$, $R_2$ and $R_3$ is a hydroxyl group, and only one of $R_1$, $R_2$ and $R_3$ is a carboxylic acid group or its salt or a phosphoric acid group or its salt, and wherein $n_1$, $n_2$ and $n_3$ each represent an integer of 1 to 3.

7. The color developing solution for a light-sensitive silver halide color photographic material according to claim 1, wherein the compound represented by the formula II or III is at least one selected from the group consisting of ethylenediaminetetraacetic acid, diethylenetriaminepentaacetic acid, triethylenetetraminehexaacetic acid, 1,3-diaminopropan-2-ol-tetraacetic acid, ethylenediaminetetramethylenephosphonic acid, nitrilotriacetic acid, iminodiacetic acid and nitrilotrimethylenephosphonic acid.

8. The color developing solution for a light-sensitive silver halide color photographic material according to claim 1, wherein a concentration of a sulfite is $5\times10^{-4}$ to $4\times10^{-3}$ mole per liter of the color developing solution.

9. A method of processing a light-sensitive silver halide color photographic material having silver halide emulsion layers containing silver halide grains substantially comprised of silver chloride, comprising the steps of:

imagewise exposing a light-sensitive silver halide color photographic material;

processing said material with at least one color developing step employing a color developing solution comprising the compound represented by formula I and at least one compound selected from the group of compounds represented by formula II and formula III:

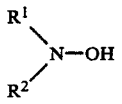
I.

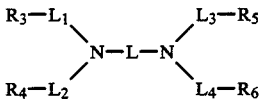
II.

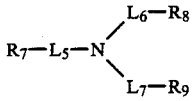
III.

wherein, $R^1$ and $R^2$ each represent an alkyl group having 1 to 3 carbon atoms; L represents an alkylene group, a cycloalkylene group, a phenylene group, $-L_8-O-L_8-O-L_8-$ or $-L_9-Z-L_9-$, where Z represents

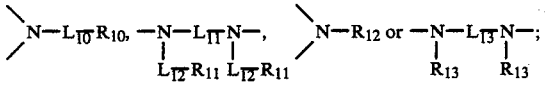

$L_1$ to $L_{13}$ each represent an alkylene group; $R_3$ to $R_{13}$ each represent a hydrogen atom, a hydroxyl group, a carboxylic acid group or its salt, or a phosphonic acid group or its salt, provided that at least two of $R_3$ to $R_6$ are the carboxylic acid group or its salt or the phosphonic acid group or its salt, and at least two of $R_5$ to $R_7$ are the carboxylic acid group or its salt or the phosphonic acid group, and provided that no hydroxylamine sulfate is present in the developing solution.

10. The method according to claim 9, wherein at least one layer of said silver halide emulsion layers contains at least one cyan coupler selected from the group consisting of a cyan coupler represented by formula (C-1) and a cyan coupler represented by formula (C-2):

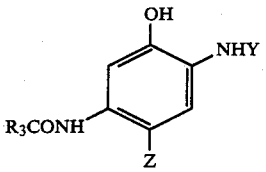
(C-1)

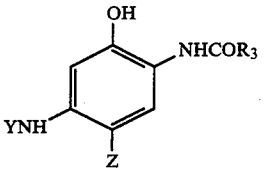
(C-2)

wherein Y represents

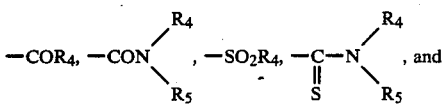

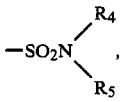

$-CONHCOR_4$ or $-CONHSO_2R_4$ and where $R_4$ represents an alkyl group, and alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring; $R_3$ represents a ballast group; and Z represents a hydrogen atom or a group eliminatable through the coupling reaction with the oxidized product of an aromatic primary amine series color developing agent.

11. The method according to claim 9, wherein at least one layer of said silver halide emulsion layers contains at least one cyan coupler represented by formula (C):

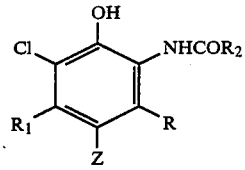
(C)

wherein one of R and $R_1$ represents a hydrogen atom and the other is a straight or branched alkyl group having at least 2 to 12 carbon atoms; X represents a hydrogen atom or a group eliminatable through the coupling reaction with an oxidized product of an aromatic primary amine series color developing agent; and $R_2$ represents a ballast group.

12. The method according to claim 9, wherein said silver halide emulsion layer is a silver halide emulsion layer containing silver halide grains comprising 80 mole % or more of silver chloride.

13. The method according to claim 9, wherein a concentration of a sulfite is $5\times10^{-4}$ to $2\times10^{-2}$ mole per liter of the color developing solution.

14. The method according to claim 9, further comprising a p-phenylenediamine type compound having a water soluble group or groups.

15. The method according to claim 14, wherein said water-soluble group is at least one selected from the group consisting of $-(CH_2)_n-CH_2OH$, $-(CH_2)_m-NHSO_2-(CH_2)_n-CH_3$, $-(CH_2)_mO-(CH_2)_n-CH_3$, $-(CH_2CH_2O)_nC_mH_{2m+1}$ wherein m and n each represent an integer of 0 or more, a —COOH group and a $-SO_3H$ group, and is attached to an amino group or benzene ring of the p-phenylenediamine type compound.

16. The method according to claim 9, further comprising a triazylstylbene type fluorescent brightening agent represented by formula VIII:

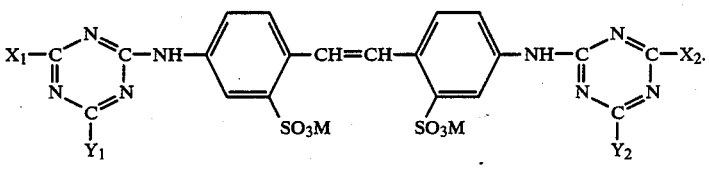

VIII wherein $X_1$, $X_2$, $Y_1$ and $Y_2$ each represent a hydroxy group, a halogen atom, a morpholino group, an alkoxy group, an aryloxy group, an alkyl group, an aryl group, an amino group, an alkylamino group, an arylamino group and M represents a hydrogen atom, sodium, potassium, ammonium or lithium.

17. The method according to claim 9, wherein the compound represented by the formula III is a compound represented by formula:

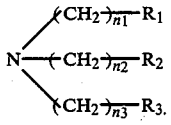

VII wherein $R_1$, $R_2$ and $R_3$ each represent a hydrogen atom, a hydroxy group, a carboxylic acid group or its salt or a phosphoric acid group or its salt, wherein said salt of the carboxylic acid group and the phosphoric acid group is selected from the salts consisting of salts of an alkali metal atom and salts of an alkaline earth metal atom, provided that at least one of $R_1$, $R_2$ and $R_3$ is a hydroxyl group, and only one of $R_1$, $R_2$ and $R_3$ is a carboxylic acid group or its salt or a phosphoric acid group or its salt, and wherein $n_1$, $n_2$ and $n_3$ each represent an integer of 1 to 3.

18. The method according to claim 9, wherein the compound represented by the formula II or III is at least one selected from the group consisting of ethylenediaminetetraacetic acid, diethylenetriamine-pentaacetic acid, triethylenetetraminedexaacetic acid, 1,3-diaminopropan-2-ol-tetraacetic acid, ethylenediaminetetramethylenephosphonic acid, nitriacetic acid, iminodiacetic acid and nitrilotrimethylenephosphonic acid.

19. The method according to claim 9, wherein a concentration of a sulfite is $5\times10^{-4}$ to $4\times10^{-3}$ mole per liter of the color developing solution.

* * * * *